US009867430B2

(12) United States Patent
Hammerslag et al.

(10) Patent No.: US 9,867,430 B2
(45) Date of Patent: Jan. 16, 2018

(54) REEL BASED CLOSURE SYSTEM

(71) Applicant: Boa Technology, Inc., Denver, CO (US)

(72) Inventors: Gary Hammerslag, Steamboat Springs, CO (US); Mark Soderberg, Conifer, CO (US); Christopher K. Holmes, Denver, CO (US); Peter F. Costa, Denver, CO (US); Bruce K. Johnson, Denver, CO (US)

(73) Assignee: Boa Technology Inc., Denver, CO (US)

( * ) Notice: Subject to any disclaimer, the term of this patent is extended or adjusted under 35 U.S.C. 154(b) by 0 days.

(21) Appl. No.: 15/083,638

(22) Filed: Mar. 29, 2016

(65) Prior Publication Data

US 2016/0206047 A1 Jul. 21, 2016

Related U.S. Application Data

(63) Continuation of application No. 14/565,262, filed on Dec. 9, 2014, now Pat. No. 9,339,082, which is a (Continued)

(51) Int. Cl.

| | |
|---|---|
| ***A43C 11/16*** | (2006.01) |
| ***A43B 5/16*** | (2006.01) |
| ***A43C 1/00*** | (2006.01) |

(52) U.S. Cl.

CPC ..... *A43C 11/165* (2013.01); *A43B 5/1666* (2013.01); *A43C 1/00* (2013.01); (Continued)

(58) Field of Classification Search

CPC ..... A43C 11/16; A43C 11/165; A43C 1/00; A43C 1/003; Y10T 24/2183

See application file for complete search history.

(56) References Cited

U.S. PATENT DOCUMENTS

| | | | |
|---|---|---|---|
| 59,332 | A | 10/1866 | White et al. |
| 80,834 | A | 8/1868 | Prussia |

(Continued)

FOREIGN PATENT DOCUMENTS

| | | |
|---|---|---|
| AT | 127075 | 2/1932 |
| AT | 244804 | 1/1966 |

(Continued)

OTHER PUBLICATIONS

U.S. Appl. No. 09/956,601, filed Sep. 18, 2001, Hammerslag.

(Continued)

*Primary Examiner* — Abigail Troy

(74) *Attorney, Agent, or Firm* — Kilpatrick Townsend & Stockton LLP

(57) ABSTRACT

Disclosed is a closure system used in combination in any of a variety of applications including clothing, for example as a footwear lacing system comprising a lace attached to a tightening mechanism. The lace extends through a series of guide members positioned along two opposing footwear closure portions. The lace and guides preferably have low friction surfaces to facilitate sliding of the lace along the guide members so that the lace evenly distributes tension across the footwear member. The tightening mechanism allows incremental adjustment of the tension of the lace. The closure system allows a user to quickly loosen the lace and inhibits unintentional and/or accidental loosing of the lace.

25 Claims, 61 Drawing Sheets

Related U.S. Application Data continuation of application No. 14/228,075, filed on Mar. 27, 2014, which is a continuation of application No. 13/343,658, filed on Jan. 4, 2012, now abandoned, which is a continuation of application No. 11/842,009, filed on Aug. 20, 2007, now Pat. No. 8,091,182, which is a continuation of application No. 11/263,253, filed on Oct. 31, 2005, now abandoned, which is a continuation-in-part of application No. 10/459,843, filed on Jun. 12, 2003, now Pat. No. 7,591,050.

(60) Provisional application No. 60/623,341, filed on Oct. 29, 2004, provisional application No. 60/704,831, filed on Aug. 2, 2005.

(52) U.S. Cl.
CPC ..... *A43C 1/003* (2013.01); *A43C 11/16* (2013.01); *Y10T 24/2183* (2015.01)

(56) References Cited

U.S. PATENT DOCUMENTS 117,530 A 8/1871 Foote
228,946 A 6/1880 Schulz
230,759 A 8/1880 Drummond
746,563 A 12/1903 McMahon
819,993 A 5/1906 Haws et al.
908,704 A 1/1909 Sprinkle
1,060,422 A 4/1913 Bowdish
1,062,511 A 5/1913 Short
1,083,775 A 1/1914 Thomas
1,090,438 A 3/1914 Worth et al.
1,170,472 A 2/1916 Barber
1,288,859 A 12/1918 Feller et al.
1,390,991 A 9/1921 Fotchuk
1,393,188 A 10/1921 Whiteman
1,412,486 A 4/1922 Paine
1,416,203 A 5/1922 Hobson
1,429,657 A 9/1922 Trawinski
1,466,673 A 9/1923 Solomon et al.
1,469,661 A 10/1923 Migita
1,481,903 A 1/1924 Hart
1,502,919 A 7/1924 Seib
1,530,713 A 3/1925 Clark
1,862,047 A 6/1932 Boulet et al.
1,995,243 A 3/1935 Clarke
2,088,851 A 8/1937 Gantenbein
2,109,751 A 3/1938 Matthias et al.
2,124,310 A 9/1938 Murr, Jr.
2,316,102 A 4/1943 Preston
2,539,026 A 1/1951 Mangold
2,611,940 A 9/1952 Cairns
2,673,381 A 3/1954 Dueker
2,907,086 A 10/1959 Ord
2,991,523 A 7/1961 Del Conte
3,035,319 A 5/1962 Wolff
3,112,545 A 12/1963 Williams
3,163,900 A 1/1965 Martin
3,169,325 A 2/1965 Fesl
3,193,950 A 7/1965 Shu-Lien Liou
3,197,155 A 7/1965 Chow
3,221,384 A 12/1965 Aufenacker
3,276,090 A 10/1966 Nigon
3,401,437 A 9/1968 Christpohersen
3,430,303 A 3/1969 Perrin et al.
3,491,465 A 1/1970 Martin
3,545,106 A 12/1970 Martin
3,618,232 A 11/1971 Shnuriwsky
3,668,791 A 6/1972 Salzman et al.
3,678,539 A 7/1972 Graup
3,703,775 A 11/1972 Gatti
3,729,779 A 5/1973 Porth
3,738,027 A 6/1973 Schoch
3,793,749 A 2/1974 Gertsch et al.
3,808,644 A 5/1974 Schoch
3,834,048 A 9/1974 Maurer
3,934,346 A 1/1976 Sasaki et al.
3,975,838 A 8/1976 Martin
4,130,949 A 12/1978 Seidel
4,142,307 A 3/1979 Martin
4,227,322 A 10/1980 Annovi
4,261,081 A 4/1981 Lott
4,267,622 A 5/1981 Burnett-Johnston
4,408,403 A 10/1983 Martin
4,433,456 A 2/1984 Baggio
4,463,761 A 8/1984 Pols et al.
4,480,395 A 11/1984 Schoch
4,507,878 A 4/1985 Semouha
4,551,932 A 11/1985 Schoch
4,555,830 A 12/1985 Petrini et al.
4,574,500 A 3/1986 Aldinio et al.
4,616,524 A 10/1986 Biodia
4,619,057 A 10/1986 Sartor et al.
4,620,378 A 11/1986 Sartor
4,631,839 A 12/1986 Bonetti et al.
4,631,840 A 12/1986 Gamm
4,633,599 A 1/1987 Morell et al.
4,654,985 A 4/1987 Chalmers
4,660,300 A 4/1987 Morell et al.
4,660,302 A 4/1987 Arieh et al.
4,680,878 A 7/1987 Pozzobon et al.
4,719,670 A 1/1988 Kurt
4,719,709 A 1/1988 Vaccari
4,719,710 A 1/1988 Pozzobon
4,722,477 A 2/1988 Floyd
4,741,115 A 5/1988 Pozzobon
4,748,726 A 6/1988 Schoch
4,760,653 A 8/1988 Baggio
4,780,969 A 11/1988 White, Jr.
4,787,124 A 11/1988 Pozzobon et al.
4,790,081 A 12/1988 Benoit et al.
4,796,829 A 1/1989 Pozzobon et al.
4,799,297 A 1/1989 Baggio et al.
4,802,291 A 2/1989 Sartor
4,811,503 A 3/1989 Iwama
4,826,098 A 5/1989 Pozzobon et al.
4,841,649 A 6/1989 Baggio et al.
4,856,207 A 8/1989 Datson
4,870,723 A 10/1989 Pozzobon et al.
4,870,761 A 10/1989 Tracy
4,884,760 A 12/1989 Baggio et al.
4,924,605 A 5/1990 Spademan
4,937,953 A 7/1990 Walkhoff
4,961,544 A 10/1990 Biodia
5,001,817 A 3/1991 DeBortoli et al.
5,016,327 A 5/1991 Klausner
5,042,177 A 8/1991 Schoch
5,062,225 A 11/1991 Gorza
5,065,480 A 11/1991 DeBortoli
5,065,481 A 11/1991 Walkhoff
5,117,567 A 6/1992 Berger
5,152,038 A 10/1992 Schoch
5,157,813 A 10/1992 Carroll
5,158,428 A 10/1992 Gessner et al.
5,177,882 A 1/1993 Berger
5,181,331 A 1/1993 Berger
5,184,378 A 2/1993 Batra
D333,552 S 3/1993 Berger et al.
5,249,377 A 10/1993 Walkhoff
5,259,094 A 11/1993 Zepeda
5,315,741 A 5/1994 Dubberke
5,319,868 A 6/1994 Hallenbeck
5,319,869 A 6/1994 McDonald et al.
5,325,613 A 7/1994 Sussmann
5,327,662 A 7/1994 Hallenbeck
5,335,401 A 8/1994 Hanson
5,341,583 A 8/1994 Hallenbeck
5,345,697 A 9/1994 Quellais
5,355,596 A 10/1994 Sussmann
5,357,654 A 10/1994 Hsing-Chi
5,371,957 A 12/1994 Gaudio
5,381,609 A 1/1995 Hieblinger

(56) References Cited

U.S. PATENT DOCUMENTS 5,392,535 A 2/1995 Van Noy et al.
5,425,161 A 6/1995 Schoch
5,425,185 A 6/1995 Gansler
5,430,960 A 7/1995 Richardson
5,433,648 A 7/1995 Frydman
5,463,822 A 11/1995 Miller
5,477,593 A 12/1995 Leick
5,502,902 A 4/1996 Sussmann
5,511,325 A 4/1996 Hieblinger
5,535,531 A 7/1996 Karabed et al.
5,537,763 A 7/1996 Donnadieu et al.
5,557,864 A 9/1996 Marks
5,566,474 A 10/1996 Leick et al.
5,596,820 A 1/1997 Edauw et al.
5,599,000 A 2/1997 Bennett
5,599,288 A 2/1997 Shirley et al.
5,600,874 A 2/1997 Jungkind
5,606,778 A 3/1997 Jungkind
D379,113 S 5/1997 McDonald et al.
5,638,588 A 6/1997 Jungkind
5,640,785 A 6/1997 Egelja
5,647,104 A 7/1997 James
5,651,198 A 7/1997 Sussmann
5,669,116 A 9/1997 Jungkind
5,692,319 A 12/1997 Parker et al.
5,718,021 A 2/1998 Tatum
5,718,065 A 2/1998 Locker
5,720,084 A 2/1998 Chen
5,732,483 A 3/1998 Cagliari
5,736,696 A 4/1998 Del Rosso
5,737,854 A 4/1998 Sussmann
5,755,044 A 5/1998 Veylupek
5,756,298 A 5/1998 Burczak
5,761,777 A 6/1998 Leick
5,772,146 A 6/1998 Kawamoto et al.
5,784,809 A 7/1998 McDonald
5,791,021 A 8/1998 James
5,791,068 A 8/1998 Bernier et al.
5,819,378 A 10/1998 Doyle
5,833,640 A 11/1998 Vazquez, Jr. et al.
5,845,371 A 12/1998 Chen
5,909,946 A 6/1999 Okajima
5,934,599 A 8/1999 Hammerslag
5,937,542 A 8/1999 Bourdeau
5,956,823 A 9/1999 Borel
6,029,323 A 2/2000 Dickie et al.
6,038,791 A 3/2000 Cornelius et al.
6,052,921 A 4/2000 Oreck
6,070,886 A 6/2000 Cornelius et al.
6,070,887 A 6/2000 Cornelius et al.
6,073,370 A 6/2000 Okajima
6,083,857 A 7/2000 Bottger
6,088,936 A 7/2000 Bahl
6,102,412 A 8/2000 Staffaroni
D430,724 S 9/2000 Matis et al.
6,119,318 A 9/2000 Maurer
6,119,372 A 9/2000 Okajima
6,128,836 A 10/2000 Barret
6,148,489 A 11/2000 Dickie et al.
6,202,953 B1 3/2001 Hammerslag
6,240,657 B1 6/2001 Weber et al.
6,256,798 B1 7/2001 Egolf et al.
6,267,390 B1 7/2001 Maravetz et al.
6,286,233 B1 9/2001 Gaither
6,289,558 B1 9/2001 Hammerslag
6,311,633 B1 11/2001 Keire
6,401,364 B1 6/2002 Burt
6,416,074 B1 7/2002 Maravetz et al.
6,467,195 B2 10/2002 Pierre et al.
6,477,793 B1 11/2002 Pruitt et al.
6,543,159 B1 4/2003 Carpenter et al.
6,568,103 B2 5/2003 Durocher
6,606,804 B2 8/2003 Kaneko et al.
6,694,643 B1 2/2004 Hsu
6,708,376 B1 3/2004 Landry
6,711,787 B2 3/2004 Jungkind et al.
6,735,829 B2 5/2004 Hsu
6,757,991 B2 7/2004 Sussmann
6,775,928 B2 8/2004 Grande et al.
6,792,702 B2 9/2004 Borsoi et al.
6,802,439 B2 10/2004 Azam et al.
6,823,610 B1 11/2004 Ashley
6,877,256 B2 4/2005 Martin et al.
6,922,917 B2 8/2005 Kerns et al.
6,938,913 B2 9/2005 Elkington
6,941,683 B2 9/2005 Freed
6,945,543 B2 9/2005 De Bertoli et al.
6,976,972 B2 12/2005 Bradshaw
6,993,859 B2 2/2006 Martin et al.
D521,226 S 5/2006 Douglas et al.
7,076,843 B2 7/2006 Sakabayashi
7,082,701 B2 8/2006 Dalgaard et al.
7,096,559 B2 8/2006 Johnson et al.
7,134,224 B2 11/2006 Elkington et al.
7,266,911 B2 9/2007 Holzer et al.
7,281,341 B2 10/2007 Reagan et al.
7,293,373 B2 11/2007 Reagan et al.
7,331,126 B2 2/2008 Johnson
7,343,701 B2 3/2008 Pare et al.
7,367,522 B2 5/2008 Chen
7,386,947 B2 6/2008 Martin et al.
7,392,602 B2 7/2008 Reagan et al.
7,401,423 B2 7/2008 Reagan et al.
7,490,458 B2 2/2009 Ford
7,568,298 B2 8/2009 Kerns
7,584,528 B2 9/2009 Hu
7,591,050 B2 9/2009 Hammerslag
7,597,675 B2 10/2009 Ingimundarson et al.
7,600,660 B2 10/2009 Kasper et al.
7,617,573 B2 11/2009 Chen
7,624,517 B2 12/2009 Smith
7,648,404 B1 1/2010 Martin
7,650,705 B2 1/2010 Donnadieu et al.
7,694,354 B2 4/2010 Philpott et al.
7,757,412 B2 7/2010 Farys
7,774,956 B2 8/2010 Dua et al.
7,841,106 B2 11/2010 Farys
7,871,334 B2 1/2011 Young et al.
7,877,845 B2 2/2011 Signori
7,908,769 B2 3/2011 Pellegrini
7,950,112 B2 5/2011 Hammerslag et al.
7,954,204 B2 6/2011 Hammerslag et al.
7,963,049 B2 6/2011 Messmer
7,992,261 B2 8/2011 Hammerslag et al.
D646,790 S 10/2011 Castillo et al.
8,056,150 B2 11/2011 Stokes et al.
8,074,379 B2 12/2011 Robinson, Jr. et al.
8,091,182 B2 1/2012 Hammerslag et al.
8,109,015 B2 2/2012 Signori
D663,850 S 7/2012 Joseph
D663,851 S 7/2012 Joseph
8,215,033 B2 7/2012 Carboy et al.
8,231,074 B2 7/2012 Hu et al.
D665,088 S 8/2012 Joseph
8,235,321 B2 8/2012 Chen
8,245,371 B2 8/2012 Chen
8,266,827 B2 9/2012 Dojan et al.
8,277,401 B2 10/2012 Hammerslag et al.
8,302,329 B2 11/2012 Hurd et al.
8,303,527 B2 11/2012 Joseph
8,308,098 B2 11/2012 Chen
8,353,087 B2 1/2013 Chen
8,434,200 B2 5/2013 Chen
8,713,820 B2 5/2014 Kerns et al.
8,984,719 B2 3/2015 Soderberg et al.
9,101,181 B2 8/2015 Soderberg et al.
9,179,729 B2 11/2015 Cotterman et al.
2002/0050076 A1 5/2002 Borsoi et al.
2002/0062579 A1 5/2002 Caeran
2002/0095750 A1 7/2002 Hammerslag
2002/0129518 A1 9/2002 Borsoi et al.
2002/0148142 A1 10/2002 Oorei et al.
2002/0166260 A1 11/2002 Borsoi
2002/0178548 A1 12/2002 Freed

(56) References Cited

U.S. PATENT DOCUMENTS

| | | | |
|---|---|---|---|
| 2003/0079376 | A1 | 5/2003 | Oorei et al. |
| 2003/0177662 | A1 | 9/2003 | Elkington et al. |
| 2003/0204938 | A1 | 11/2003 | Hammerslag |
| 2005/0054962 | A1 | 3/2005 | Bradshaw |
| 2005/0060912 | A1 | 3/2005 | Holzer et al. |
| 2005/0081403 | A1 | 4/2005 | Mathieu |
| 2005/0087115 | A1 | 4/2005 | Martin |
| 2005/0097780 | A1 | 5/2005 | Pellegrini |
| 2005/0098673 | A1 | 5/2005 | Huang |
| 2005/0102861 | A1 | 5/2005 | Martin |
| 2005/0126043 | A1 | 6/2005 | Reagan et al. |
| 2005/0198866 | A1 | 9/2005 | Wiper et al. |
| 2006/0156517 | A1 | 7/2006 | Hammerslag et al. |
| 2006/0179685 | A1 | 8/2006 | Borel et al. |
| 2006/0185193 | A1 | 8/2006 | Pellegrini |
| 2007/0063459 | A1 | 3/2007 | Kavarsky |
| 2007/0068040 | A1 | 3/2007 | Farys |
| 2007/0084956 | A1 | 4/2007 | Chen |
| 2007/0113524 | A1 | 5/2007 | Lander |
| 2007/0128959 | A1 | 6/2007 | Cooke |
| 2007/0169378 | A1 | 7/2007 | Sodeberg et al. |
| 2008/0016717 | A1 | 1/2008 | Ruban |
| 2008/0060167 | A1 | 3/2008 | Hammerslag et al. |
| 2008/0060168 | A1 | 3/2008 | Hammerslag et al. |
| 2008/0066272 | A1 | 3/2008 | Hammerslag et al. |
| 2008/0066345 | A1 | 3/2008 | Hammerslag et al. |
| 2008/0066346 | A1 | 3/2008 | Hammerslag et al. |
| 2008/0083135 | A1 | 4/2008 | Hammerslag et al. |
| 2008/0172848 | A1 | 7/2008 | Chen |
| 2009/0071041 | A1 | 3/2009 | Hooper |
| 2009/0090029 | A1 | 4/2009 | Kishino |
| 2009/0172928 | A1 | 7/2009 | Messmer et al. |
| 2009/0184189 | A1 | 7/2009 | Soderberg et al. |
| 2009/0277043 | A1 | 11/2009 | Graser et al. |
| 2010/0064547 | A1 | 3/2010 | Kaplan et al. |
| 2010/0101061 | A1 | 4/2010 | Ha |
| 2010/0139057 | A1 | 6/2010 | Soderberg et al. |
| 2010/0154254 | A1 | 6/2010 | Fletcher |
| 2010/0175163 | A1 | 7/2010 | Litke |
| 2010/0251524 | A1 | 10/2010 | Chen |
| 2010/0299959 | A1 | 12/2010 | Hammerslag et al. |
| 2010/0319216 | A1 | 12/2010 | Grenzke et al. |
| 2011/0000173 | A1 | 1/2011 | Lander |
| 2011/0071647 | A1 | 3/2011 | Mahon |
| 2011/0167543 | A1 | 7/2011 | Kovacevich et al. |
| 2011/0191992 | A1 | 8/2011 | Chen |
| 2011/0197362 | A1 | 8/2011 | Chella et al. |
| 2011/0225843 | A1 | 9/2011 | Kerns et al. |
| 2011/0258876 | A1 | 10/2011 | Baker et al. |
| 2011/0266384 | A1 | 11/2011 | Goodman et al. |
| 2012/0000091 | A1 | 1/2012 | Cotterman et al. |
| 2012/0004587 | A1 | 1/2012 | Nickel et al. |
| 2012/0005995 | A1 | 1/2012 | Emery |
| 2012/0023717 | A1 | 2/2012 | Chen |
| 2012/0101417 | A1 | 4/2012 | Joseph |
| 2012/0102783 | A1 | 5/2012 | Swigart et al. |
| 2012/0157902 | A1 | 6/2012 | Castillo et al. |
| 2012/0228419 | A1 | 9/2012 | Chen |
| 2012/0246974 | A1 | 10/2012 | Hammerslag et al. |
| 2013/0012856 | A1 | 1/2013 | Hammerslag et al. |
| 2013/0014359 | A1 | 1/2013 | Chen |
| 2013/0025100 | A1 | 1/2013 | Ha |
| 2013/0091667 | A1 | 4/2013 | Zerfas et al. |
| 2013/0092780 | A1 | 4/2013 | Soderberg et al. |
| 2013/0269219 | A1 | 10/2013 | Burns et al. |
| 2013/0277485 | A1 | 10/2013 | Soderberg et al. |
| 2013/0340283 | A1 | 12/2013 | Bell et al. |
| 2015/0033519 | A1 | 2/2015 | Hammerslag et al. |
| 2015/0089835 | A1 | 4/2015 | Hammerslag et al. |

FOREIGN PATENT DOCUMENTS

| | | | |
|---|---|---|---|
| AT | 361808 | | 4/1981 |
| CA | 2112789 | | 8/1994 |
| CA | 2114387 | | 8/1994 |
| CH | 41765 | | 9/1907 |
| CH | 111341 | | 11/1925 |
| CH | 199766 | | 9/1938 |
| CH | 204 834 | A | 5/1939 |
| CH | 523 669 | | 7/1972 |
| CH | 562 015 | | 5/1975 |
| CH | 577 282 | | 7/1976 |
| CH | 612 076 | | 7/1979 |
| CH | 537 164 | | 7/1981 |
| CH | 624 001 | | 7/1981 |
| CH | 471 553 | | 12/1984 |
| DE | 123050 | | 8/1901 |
| DE | 555211 | | 7/1932 |
| DE | 589232 | | 12/1933 |
| DE | 641976 | | 2/1937 |
| DE | 1661668 | | 7/1953 |
| DE | 7043154.8 | | 11/1970 |
| DE | 1 785 220 | | 5/1971 |
| DE | 2062795 | | 6/1972 |
| DE | 7045778.2 | | 1/1974 |
| DE | 7047038 | | 1/1974 |
| DE | 23 41 658 | | 3/1974 |
| DE | 24 14 439 | | 10/1975 |
| DE | 29 00 077 | A1 | 7/1980 |
| DE | 29 14 280 | | 10/1980 |
| DE | 31 01 952 | A1 | 9/1982 |
| DE | 81 01 488.0 | | 7/1984 |
| DE | 3635 168 | A1 | 5/1987 |
| DE | 36 26 837 | | 2/1988 |
| DE | 3822113 | | 1/1990 |
| DE | 4230652 | A1 | 3/1994 |
| DE | 4230653 | A1 | 3/1994 |
| DE | 43 02 401 | A1 | 8/1994 |
| DE | 43 05 671 | A1 | 9/1994 |
| DE | 9413147 | | 10/1994 |
| DE | 9315776 | | 2/1995 |
| DE | 196 24 553 | | 1/1998 |
| DE | 19945045 | A1 | 3/2001 |
| EP | 0 056 953 | | 8/1982 |
| EP | 0 099 504 | | 2/1984 |
| EP | 0 123 050 | | 10/1984 |
| EP | 0 155 596 | | 9/1985 |
| EP | 0 201 051 | | 11/1986 |
| EP | 0 255 869 | | 2/1988 |
| EP | 0 393 380 | | 10/1990 |
| EP | 0 589 232 | A1 | 3/1994 |
| EP | 0 589 233 | A1 | 3/1994 |
| EP | 0 614 624 | | 9/1994 |
| EP | 0 614 625 | A1 | 9/1994 |
| EP | 0 651 954 | A1 | 5/1995 |
| EP | 0 679 346 | | 11/1995 |
| EP | 0 693 260 | | 1/1996 |
| EP | 0 717 942 | | 6/1996 |
| EP | 0 734 662 | A1 | 10/1996 |
| EP | 0 848 917 | | 6/1998 |
| EP | 0 858 819 | | 8/1998 |
| EP | 0 858 821 | | 8/1998 |
| EP | 0 923 965 | | 6/1999 |
| EP | 0 937 487 | A1 | 8/1999 |
| EP | 1163860 | | 12/2001 |
| EP | 1 219 195 | | 7/2002 |
| EP | 1 236 412 | A | 9/2002 |
| EP | 2359708 | | 8/2011 |
| FR | 1 374 110 | | 10/1964 |
| FR | 1 404 799 | | 7/1965 |
| FR | 2 019 991 | A | 7/1970 |
| FR | 2 108 428 | | 5/1972 |
| FR | 2.108.429 | | 5/1972 |
| FR | 2.173.451 | | 10/1973 |
| FR | 2.175.684 | | 10/1973 |
| FR | 2399811 | | 3/1979 |
| FR | 2 565795 | | 12/1985 |
| FR | 2 598 292 | A1 | 11/1987 |
| FR | 2 726 440 | A1 | 5/1996 |
| FR | 2 814 919 | A1 | 4/2002 |
| GB | 11673 | | 7/1899 |
| GB | 2 449 722 | A | 12/2008 |
| IT | 1220811 | | 6/1990 |
| IT | PD 2003 A 000197 | | 4/2003 |

(56) References Cited

FOREIGN PATENT DOCUMENTS

| | | |
|---|---|---|
| IT | PD 2003 A 000198 | 3/2005 |
| JP | 49-28618 | 3/1974 |
| JP | 51-2776 | 1/1976 |
| JP | 51-121375 | 10/1976 |
| JP | 51-131978 | 10/1976 |
| JP | 53-124987 | 3/1977 |
| JP | 54-108125 | 2/1978 |
| JP | 62-57346 | 4/1987 |
| JP | 63-80736 | 5/1988 |
| JP | 8-9202 | 6/1993 |
| JP | 7-208 | 1/1995 |
| JP | 6-284906 | 2/1996 |
| JP | 3030988 | 11/1996 |
| JP | 8308608 | 11/1996 |
| JP | 3031760 | 12/1996 |
| JP | 10-199366 | 7/1998 |
| JP | 2001-197905 | 7/2001 |
| JP | 2004-016732 | 1/2004 |
| JP | 2004-041666 | 2/2004 |
| KR | 20-0367882 | 11/2004 |
| KR | 20-0400568 | 8/2005 |
| KR | 10-0598627 | 7/2006 |
| KR | 10-0953398 | 4/2010 |
| KR | 10-1028468 | 4/2011 |
| WO | WO 94/27456 | 12/1994 |
| WO | WO 95/11602 | 5/1995 |
| WO | WO 95/03720 | 9/1995 |
| WO | WO 99/09850 | 3/1999 |
| WO | WO 99/15043 | 4/1999 |
| WO | WO 99/43231 | 9/1999 |
| WO | WO 00/53045 | 9/2000 |
| WO | WO 00/76337 A1 | 12/2000 |
| WO | WO00/76603 | 12/2000 |
| WO | WO 01/08525 | 2/2001 |
| WO | WO 02/051511 | 7/2002 |
| WO | WO 2004/093569 | 11/2004 |
| WO | WO 2004/093589 | 11/2004 |
| WO | WO/2007/016983 | 2/2007 |
| WO | WO 2008/015214 | 2/2008 |
| WO | WO/2015/035885 | 3/2015 |

OTHER PUBLICATIONS

ASOLO® Boot Brochure Catalog upon information and belief date is as early as Aug. 22, 1997, 12 pages.

International Search Report and Written Opinion for PCT/US2004/019032 mailed Dec. 23, 2004, all pages.

International Preliminary Report on Patentability for PCT/US2004/019032 issued Dec. 13, 2005, all pages.

International Search Report and Written Opinion for PCT/US2005/039273 mailed Nov. 20, 2007, all pages.

International Preliminary Report on Patentability for PCT/US2005/039273 issued Dec. 17, 2007, all pages.

International Search Report for PCT/US98/16314 mailed Oct. 13, 1998, 1 page.

International Search Report in PCT/US2000/019440 Dec. 21, 2000, 1 page.

Supplementary Partial European Search Report for EP 05819488, dated Feb. 18, 2011, 1 page.

International Search Report and Written Opinion for PCT/US2007/000317 mailed Jun. 13, 2007, all pages.

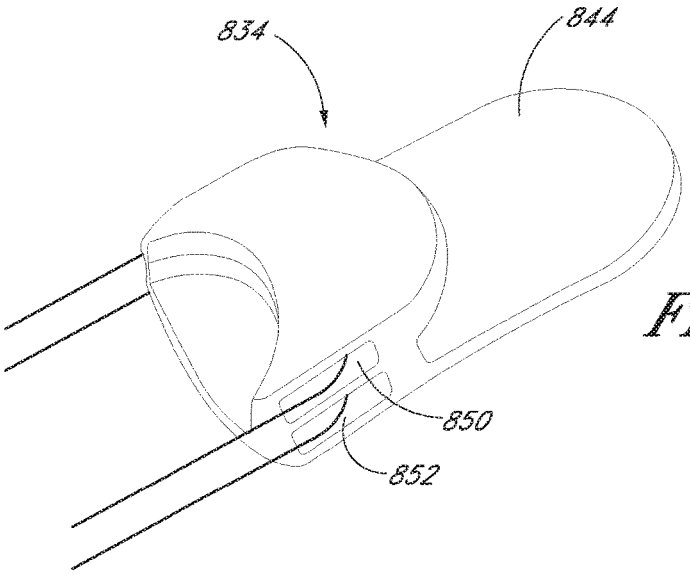
FIG. 29A
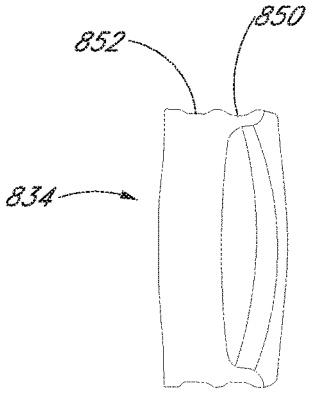
FIG. 29B
FIG. 29C
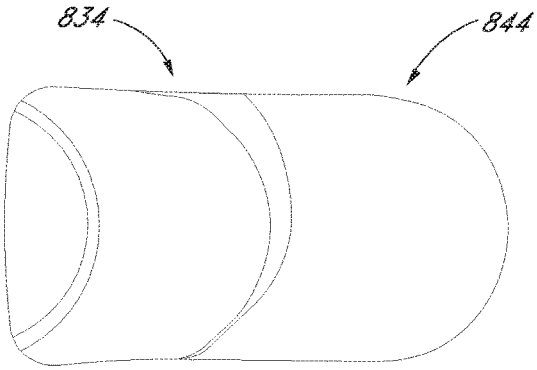
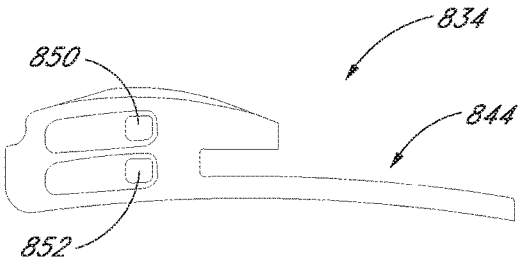
FIG. 29D

FIG. 54A
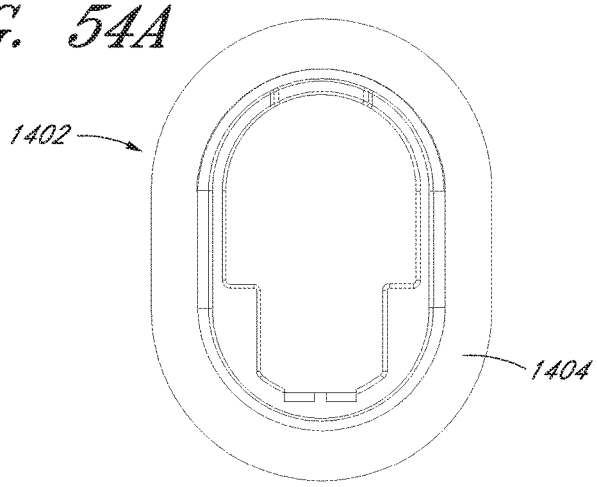
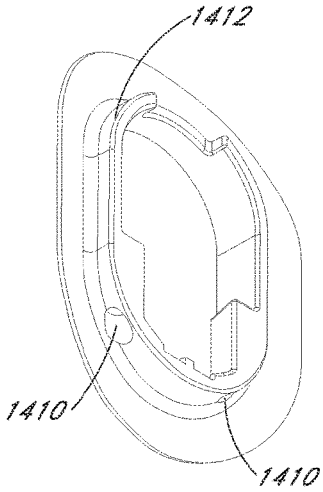
FIG. 54B
FIG. 54E
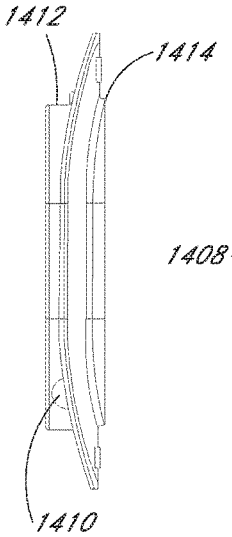
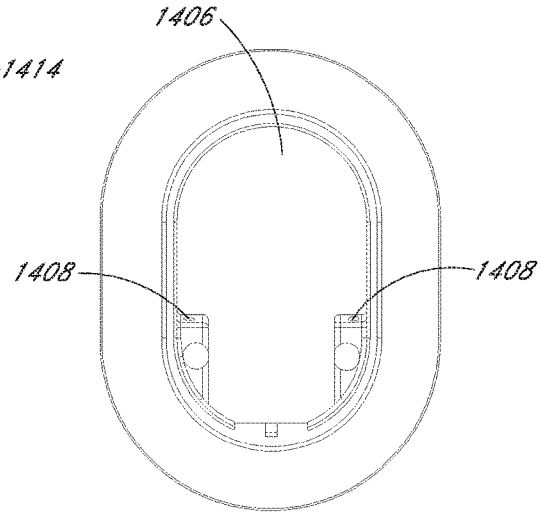
FIG. 54C
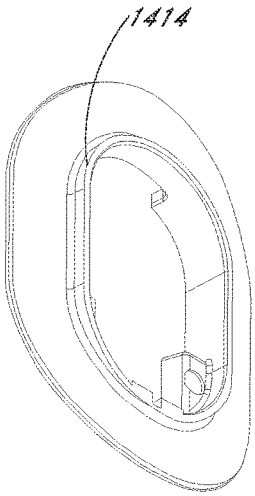
FIG. 54D
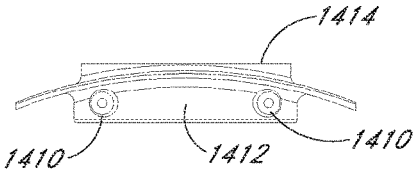
FIG. 54F

REEL BASED CLOSURE SYSTEM

CROSS-REFERENCE TO RELATED APPLICATIONS

This application is a continuation of U.S. patent application Ser. No. 14/565,262, filed Dec. 9, 2014, which is a continuation of U.S. patent application Ser. No. 14/228,075 filed Mar. 27, 2014, which is a continuation of U.S. patent application Ser. No. 13/343,658, filed Jan. 4, 2012, which is a continuation of U.S. patent application Ser. No. 11/842,009, filed Aug. 20, 2007, now U.S. Pat. No. 8,091,182, which is a continuation of U.S. patent application Ser. No. 11/263,253, filed Oct. 31, 2005, which is a continuation-in-part of U.S. patent application Ser. No. 10/459,843, filed Jun. 12, 2003, now U.S. Pat. No. 7,591,050. U.S. patent application Ser. No. 11/263,253 also claims the benefit of U.S. Provisional Patent Application No. 60/623,341, filed Oct. 29, 2004, and U.S. Provisional Patent Application No. 60/704,831, filed Aug. 2, 2005.

INCORPORATE BY REFERENCE

This application hereby incorporates by reference U.S. patent application Ser. No. 14/565,262, filed Dec. 9, 2014; U.S. patent application Ser. No. 14/228,075 filed Mar. 27, 2014; U.S. patent application Ser. No. 13/343,658, filed Jan. 4, 2012; U.S. Pat. No. 8,091,182, issued Jan. 10, 2012; U.S. patent application Ser. No. 11/263,253, filed Oct. 31, 2005; U.S. Pat. No. 7,591,050, issued Sep. 22, 2009; U.S. patent application Ser. No. 09/993,296 filed Nov. 14, 2001; U.S. patent application Ser. No. 09/956,601 filed on Sep. 18, 2001; U.S. Pat. No. 6,289,558, issued Sep. 18, 2001; U.S. Pat. No. 6,202,953, issued Mar. 20, 2001; U.S. Pat. No. 5,934,599, issued Aug. 10, 1999; U.S. Provisional Patent Application No. 60/623,341, filed Oct. 29, 2004; and U.S. Provisional Patent Application No. 60/704,831, filed Aug. 2, 2005, in their entireties.

BACKGROUND OF THE INVENTION

Field of the Invention

The present invention relates to closure systems used in combination in any of a variety of applications including clothing, for example in a low-friction lacing system for footwear that provides equilibrated tightening pressure across a wearer's foot.

Description of the Related Art

There currently exist a number of mechanisms and methods for tightening a shoe or boot around a wearer's foot. A traditional method comprises threading a lace in a zig-zag pattern through eyelets that run in two parallel rows attached to opposite sides of the shoe. The shoe is tightened by first tensioning opposite ends of the threaded lace to pull the two rows of eyelets towards the midline of the foot and then tying the ends in a knot to maintain the tension. A number of drawbacks are associated with this type of lacing system. First, laces do not adequately distribute the tightening force along the length of the threaded zone, due to friction between the lace and the eyelets, so that portions of the lace are slack and other portions are in tension. Consequently, the higher tensioned portions of the shoe are tighter around certain sections of the foot, particularly the ankle portions which are closer to the lace ends. This is uncomfortable and can adversely affect performance in some sports.

Another drawback associated with conventional laces is that it is often difficult to untighten or redistribute tension on the lace, as the wearer must loosen the lace from each of the many eyelets through which the laces are threaded. The lace is not easily released by simply untightening the knot. The friction between the lace and the eyelets often maintains the toe portions and sometimes much of the foot in tension even when the knot is released. Consequently, the user must often loosen the lace individually from each of the eyelets. This is especially tedious if the number of eyelets is high, such as in ice-skating boots or other specialized high performance footwear.

Another tightening mechanism comprises buckles which clamp together to tighten the shoe around the wearer's foot. Typically, three to four or more buckles are positioned over the upper portion of the shoe. The buckles may be quickly clamped together and drawn apart to tighten and loosen the shoe around the wearer's foot. Although buckles may be easily and quickly tightened and untightened, they also have certain drawbacks. Specifically, buckles isolate the closure pressure across three or four points along the wearer's foot corresponding to the locations of the buckles. This is undesirable in many circumstances, such as for the use of sport boots where the wearer desires a force line that is evenly distributed along the length of the foot. Another drawback of buckles is that they are typically only useful for hard plastic or other rigid material boots. Buckles are not as practical for use with softer boots, such as ice skates or snowboard boots.

There is therefore a need for a tightening system for footwear that does not suffer from the aforementioned drawbacks. Such a system should automatically distribute lateral tightening forces along the length of the wearer's ankle and foot. The tightness of the shoe should desirably be easy to loosen and incrementally adjust. The tightening system should close tightly and should not loosen up with continued use.

SUMMARY OF THE INVENTION

There is provided in accordance with one aspect of the present invention, a footwear lacing system. The system comprises a footwear member including first and second opposing sides configured to fit around a foot. A plurality of lace guide members are positioned on the opposing sides. A lace is guided by the guide members, the lace being rotationally connected to a spool that is rotatable in a winding direction and an unwinding direction. A tightening mechanism is attached to the footwear member, and coupled to the spool, the tightening mechanism including a control for winding the lace around the spool to place tension on the lace thereby pulling the opposing sides towards each other. A safety device is moveable between a secure position in which the spool is unable to rotate in an unwinding direction, and a releasing position in which the spool is free to rotate in an unwinding direction.

In one embodiment, the lace is slideably positioned around the guide members to provide a dynamic fit in response to movement of the foot within the footwear. The guide members may have a substantially C-shaped cross section.

Additionally, the tightening mechanism is a rotatable reel that is configured to receive the lace. In accordance with one embodiment, a knob rotates the spool and thereby winds the lace about the spool. In some embodiments, rotating the knob in an unwinding direction releases the spool and allows the lace to unwind. A safety device can be attached, such as a lever, that selectively allows the knob to rotate in an unwinding direction to release the spool. Alternatively, the safety device can be a rotatable release that is rotated separately from the knob to release the spool.

In certain embodiments, the footwear lacing system is attached to footwear having a first opposing side configured to extend from one side of the shoe, across the upper midline of the shoe, and to the opposing side of the shoe. As such, the reel can be mounted to the first opposing side.

In one embodiment, the lace is formed of a polymeric fiber.

According to another aspect of the footwear lacing system, a closure system for footwear having an upper with a lateral side and a medial side, the closure system comprising at least a first lace guide attached to the lateral side of the upper, at least a second lace guide attached to the medial side of the upper, and each of the first and second lace guides comprising a lace pathway, a lace slideably extending along the lace pathway of each of the first and second lace guides. Additionally, a tightening reel of the footwear for retracting the lace and thereby advancing the first lace guide towards the second lace guide to tighten the footwear is positioned on the footwear, and a lock is moveable between a coupled position and an uncoupled position wherein the lock allows the reel to be only rotatable in a forward direction when the lock is engaged, and allows the reel to be rotatable in a reverse direction when the lock is disengaged.

An embodiment also includes a closed loop lace wherein the lace is permanently mounted in the reel. Accordingly, each of the at least first and second lace guides comprise an open channel to receive the closed loop lace.

According to another embodiment of the footwear lacing system, a spool and lace unit is provided for use in conjunction with a footwear lacing system comprises a spool having ratchet teeth disposed on its periphery configured to interact with a pawl for inhibiting relative rotation of the spool in at least one direction, and a lace securely attached to the spool. Optionally, the lace can be formed of a lubricious polymer having a relatively low elasticity and high tensile strength. Alternatively, the lace can be formed of a multi-strand polymeric cable. Alternatively, the lace can be formed of a multi-strand metallic cable, preferably with a lubricious polymer casing.

BRIEF DESCRIPTION OF THE DRAWINGS

FIG. 29A-D are perspective, end elevation, top plan and side elevation views of one embodiment of a double-deck lace guide for use in embodiments of a multi-zone lacing system.

FIGS. 54A through 54K are various views of one element that may be included in an embodiment of a tightening mechanism

DETAILED DESCRIPTION OF PREFERRED EMBODIMENTS

Figure 1:
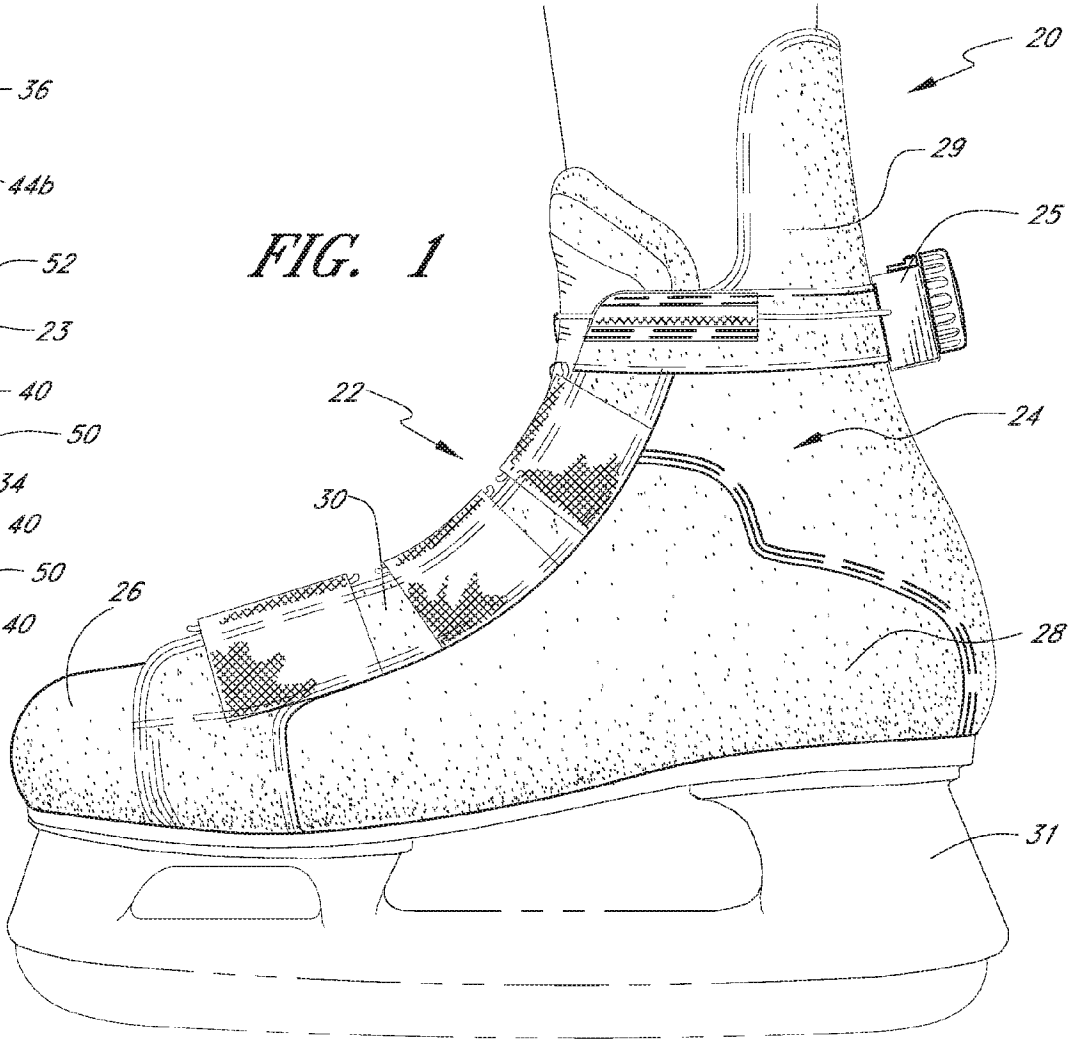
FIG. 1 is a side view of a sport boot including a lacing system configured in accordance with the present invention.

Referring to FIG. 1, there is disclosed one embodiment of a sport boot 20 prepared in accordance with the present invention. The sport boot 20 generally comprises an ice skating or other action sport boot which is tightened around a wearer's foot using a lacing system 22. The lacing system 22 includes a lace 23 (FIG. 2) that is threaded through the boot 20 and attached at opposite ends to a tightening mechanism 25, as described in detail below. As used herein, the terms lace and cable have the same meaning unless specified otherwise. The lace 23 is a low friction lace that slides easily through the boot 20 and automatically equilibrates tightening of the boot 20 over the length of the lacing zone, which generally extends along the ankle and foot. Although the present invention will be described with reference to an ice skating boot, it is to be understood that the principles discussed herein are readily applicable to any of a wide variety of footwear, and are particularly applicable to sports shoes or boots suitable for snow boarding, roller skating, skiing and the like.

The boot 20 includes an upper 24 comprising a toe portion 26, a heel portion 28, and an ankle portion 29 that surrounds the wearer's ankle. An instep portion 30 of the upper 24 is interposed between the toe portion 26 and the ankle portion 29. The instep portion 30 is configured to fit around the upper part of the arch of the medial side of the wearer's foot between the ankle and the toes. A blade 31 (shown in phantom lines) extends downward from the bottom of the boot 20 in an ice-skating embodiment.

Figure 2:
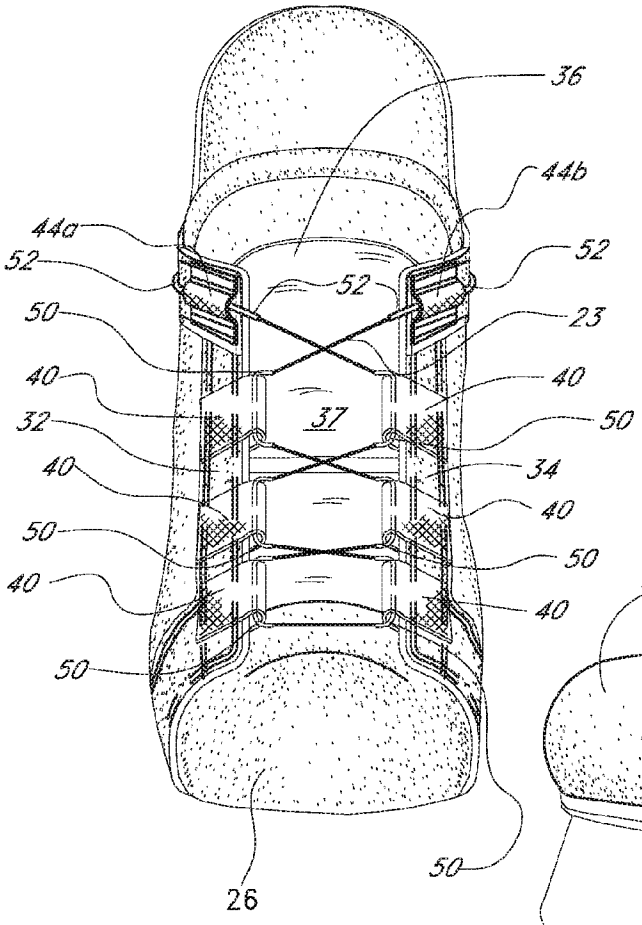
FIG. 2 is a front view of the sport boot of FIG. 1.

FIG. 2 is a front elevational view of the boot 20. As shown, the top of the boot 20 generally comprises two opposed closure edges or flaps 32 and 34 that partially cover a tongue 36. Generally, the lace 23 may be tensioned to draw the flaps 32 and 34 toward each other and tighten the boot 20 around the foot, as described in detail below. Although the inner edges of the flaps 32 and 34 are shown separated by a distance, it is understood that the flaps 32 and 34 could also be sized to overlap each other when the boot 20 is tightened, such as is known with ski footwear. Thus, references herein to drawing opposing sides of footwear towards each other refers to the portion of the footwear on the sides of the foot. This reference is thus generic to footwear in which opposing edges remain spaced apart even when tight (e.g. tennis shoes) and footwear in which opposing edges may overlap when tight (e.g. certain snow skiing boots). In both, tightening is accomplished by drawing opposing sides of the footwear towards each other.

Referring to FIG. 2, the tongue 36 extends rearwardly from the toe portion 26 toward the ankle portion 29 of the boot 20. Preferably, the tongue 36 is provided with a low friction top surface 37 to facilitate sliding of the flaps 32 and 34 and lace 23 over the surface of the tongue 32 when the lace 23 is tightened. The low friction surface 37 may be formed integrally with the tongue 32 or applied thereto such as by adhesives, heat bonding, stitching or the like. In one embodiment, the surface 37 is formed by adhering a flexible layer of nylon or polytetrafluoroethylene to the top surface of the tongue 36. The tongue 36 is preferably manufactured of a soft material, such as leather.

The upper 24 may be manufactured from any from a wide variety of materials known to those skilled in the art. In the case of a snow board boot, the upper 24 is preferably manufactured from a soft leather material that conforms to the shape of the wearer's foot. For other types of boots or shoes, the upper 24 may be manufactured of a hard or soft plastic. It is also contemplated that the upper 24 could be manufactured from any of a variety of other known materials.

As shown in FIG. 2, the lace 23 is threaded in a crossing pattern along the midline of the foot between two generally parallel rows of side retaining members 40 located on the flaps 32 and 34. In the illustrated embodiment, the side retaining members 40 each consist of a strip of material looped around the top and bottom edges of the flaps 32 and 34 so as to define a space in which guides 50 are positioned.

The lace 23 slides through the guides 50 during tightening and untightening of the lace 23, as described more fully below. In the illustrated embodiment, there are three side retaining members 40 on each flap 32, 34 although the number of retaining members 40 may vary. In some embodiments, four, five or six or more retaining members 40 may be desirable on each side of the boot.

In certain boot designs, it may be possible during the tightening process for an opposing pair of lace guides to "bottom out" and come in contact with each other before that portion of the boot is suitably tightened. Further tightening of the system will not produce further tightening at that point. Rather, other portions of the boot which may already be sized appropriately would continue to tighten. In the embodiment illustrated in FIG. 2, the side retaining members 40 each consist of a strip of material looped around the guides 50. Additional adjustability may be achieved by providing a releasable attachment between the side retaining members 40 and the corresponding flap 32 or 34 of the shoe. In this manner, the side retaining member 40 may be moved laterally away from the midline of the foot to increase the distance between opposing lace guides.

One embodiment of the adjustable side retaining member 40 may be readily constructed, that will appear similar to the structure disclosed in FIG. 2. In the adjustable embodiment, a first end of the strip of material is attached to the corresponding flap 32 or 34 using conventional means such as rivets, stitching, adhesives, or others known in the art. The strip of material loops around the guide 50, and is folded back over the outside of the corresponding flap 32 or 34 as illustrated. Rather than stitching the top end of the strip of material to the flap, the corresponding surfaces between the strip of material and the flap may be provided with a releasable engagement structure such as hook and loop structures (e.g., Velcro®), or other releasable engagement locks or clamps which permits lateral-medial adjustability of the position of the guide 50 with respect to the edge of the corresponding flap 32 or 34.

The guides 50 may be attached to the flaps 32 and 34 or to other spaced apart portions of the shoe through any of a variety of manners, as will be appreciated by those of skill in the art in view of the disclosure herein. For example, the retaining members 40 can be deleted and the guide 50 sewn directly onto the surface of the flap 32 or 34 or opposing sides of the upper. Stitching the guide 50 directly to the flap 32 or 34 may advantageously permit optimal control over the force distribution along the length of the guide 50. For example, when the lace 23 is under relatively high levels of tension, the guide 50 may tend to want to bend and to possibly even kink near the curved transition in between longitudinal portion 51 and transverse portion 53 as will be discussed. Bending of the guide member under tension may increase friction between the guide member and the lace 23, and, severe bending or kinking of the guide member 50 may undesirably interfere with the intended operation of the lacing system. Thus, the attachment mechanism for attaching the guide member 50 to the shoe preferably provides sufficient support of the guide member to resist bending and/or kinking. Sufficient support is particularly desirable on the inside radius of any curved portions particularly near the ends of the guide member 50.

As shown in FIGS. 1 and 2, the lace 23 also extends around the ankle portion 29 through a pair of upper retaining members 44*a* and 44*b* located on the ankle portion 29. The upper retaining members 44*a* and 44*b* each comprise a strip of material having a partially raised central portion that defines a space between the retaining members 44 and the upper 24. An upper guide member 52 extends through each of the spaces for guiding the lace 23 around either side of the ankle portion 29 to the tightening mechanism 25.

Figure 3:
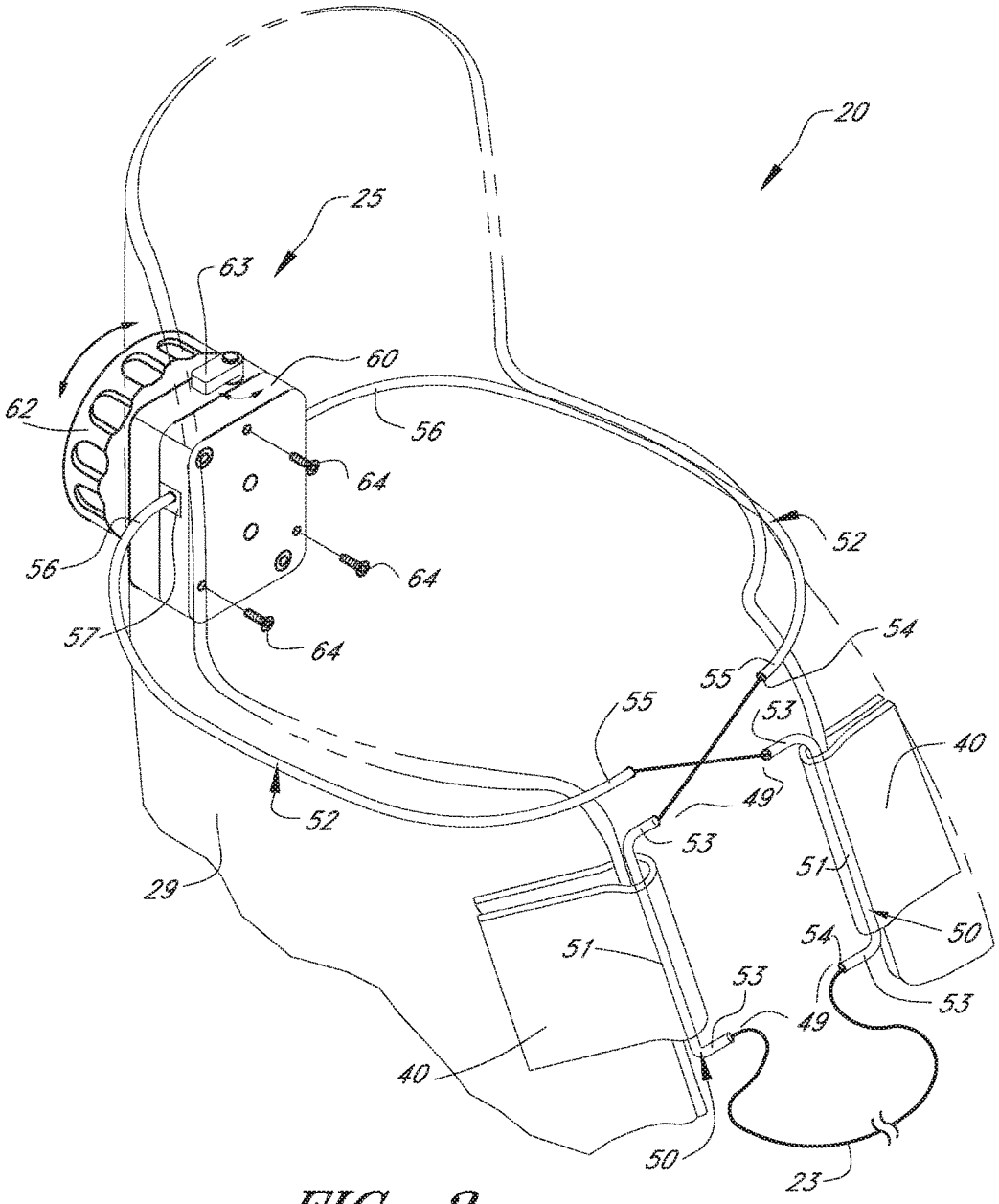
FIG. 3 is a perspective schematic view of the lacing system of the sport boot of FIG. 1.

FIG. 3 is a schematic perspective view of the lacing system 22 of the boot 20. As shown, each of the side and top guide members 50 and 52, has a tube-like configuration having a central lumen 54. Each lumen 54 has an inside diameter that is larger than the outside diameter of the lace 23 to facilitate sliding of the lace 23 through the side and top guide members 50, 52 and prevent binding of the lace 23 during tightening and untightening. In one embodiment, the inside diameter of the lumen is approximately 0.040 inches, to cooperate with a lace having an outside diameter of about 0.027". However, it will be appreciated that the diameter of the lumen 54 can be varied to fit specific desired lace dimensions and other design considerations. The wall thickness and composition of the guides 50, 52 may be varied to take into account the physical requirements imposed by particular shoe designs.

Thus, although the guides 50 are illustrated as relatively thin walled tubular structures, any of a variety of guide structures may be utilized as will be apparent to those of skill in the art in view of the disclosure herein. For example, either permanent (stitched, glued, etc.) or user removable (Velcro, etc.) flaps 40 may be utilized to hold down any of a variety of guide structures. In one embodiment, the guide 50 is a molded block having a lumen extending therethrough. Modifications of the forgoing may also be accomplished, such as by extending the length of the lace pathway in a structure such as that illustrated in FIG. 4, such that the overall part has a shallow "U" shaped configuration which allows it to be conveniently retained by the retention structure 40. Providing a guide member 50 having increased structural integrity over that which would be achieved by the thin tube illustrated in FIG. 2 may be advantageous in embodiments of the invention where the opposing guides 50 may be tightened sufficiently to "bottom out" against the opposing corresponding guide, as will be apparent to those of skill in the art in view of the disclosure herein. Solid and relatively harder lace guides as described above may be utilized throughout the boot, but may be particularly useful in the lower (e.g. toe) portion of the boot.

In general, each of the guide members 50 and 52 defines a pair of openings 49 that communicate with opposite ends of the lumen 54. The openings 49 function as inlets/outlets for the lace 23. The openings desirably are at least as wide as the cross-section of the lumen 54.

As may be best seen in FIG. 3, each top guide 52 has an end 55 which is spaced apart from a corresponding side guide 50 on the opposing side of the footwear, with the lace 23 extending therebetween. As the system is tightened, the spacing distance will be reduced. For some products, the wearer may prefer to tighten the toe or foot portion more than the ankle. This can be conveniently accomplished by limiting the ability of the side guide 50 and top guide 52 to move towards each other beyond a preselected minimum distance during the tightening process. For this purpose, a selection of spacers having an assortment of lengths may be provided with each system. The spacers may be snapped over the section of lace 23 between a corresponding end 55 of top guide 52 and side guide 50. When the ankle portion of the boot is sufficiently tight, yet the wearer would like to additionally tighten the toe or foot portion of the boot, a spacer having the appropriate length may be positioned on the lace 23 in-between the top guide 52 and side guide 50.

Further tightening of the system will thus not be able to draw the top guide 52 and corresponding side guide 50 any closer together.

The stop may be constructed in any of a variety of ways, such that it may be removably positioned between the top guide 52 and side guide 50 to limit relative tightening movement. In one embodiment, the stop comprises a tubular sleeve having an axial slot extending through the wall, along the length thereof. The tubular sleeve may be positioned on the boot by advancing the slot over the lace 23, as will be apparent to those of skill in the art. A selection of lengths may be provided, such as ½ inch, 1 inch, 1½ inch, and every half inch increment, on up to 3 or 4 inches or more, depending upon the position of the reel on the boot and other design features of a particular embodiment of the boot. Increments of ¼ inch may also be utilized, if desired.

FIGS. 30-33 illustrate an embodiment of a dynamic spacer configured to allow a user to selectively determine an amount of spacing between portions of a footwear item. The structure of FIGS. 30-33 comprises a pair of stops 920 carried by first and second compression bands 902, 904 sandwiched between a bottom cover 906 and a top cover 908. A drive mechanism 910 comprising a knob 940 can be provided to move the stops 920 laterally.

In use, a dynamic spacer such as that shown in FIGS. 30-33, can be positioned on a tongue between the flaps (or vamps) of a footwear item. In some embodiments, the dynamic spacer is positioned between a pair of lace guides. As described above, when the laces 23 are tightened, the flaps will be drawn towards one another. However, in the region of the dynamic spacer, the flap edges (or the lace guides) will abut the stops 920, thereby preventing further tightening of that region of the footwear item. The dynamic spacer 900 is generally configured to allow a user to adjust a spacing between the stops, and thereby to adjust an amount of tightening in the region of the dynamic spacer. As above, in some embodiments, a wearer may wish to provide more spacing (i.e. a looser fit) at a toe portion of a footwear item. Alternatively, in other embodiments, a user may wish to provide more spacing in an upper section of a footwear item.

Figure 31:
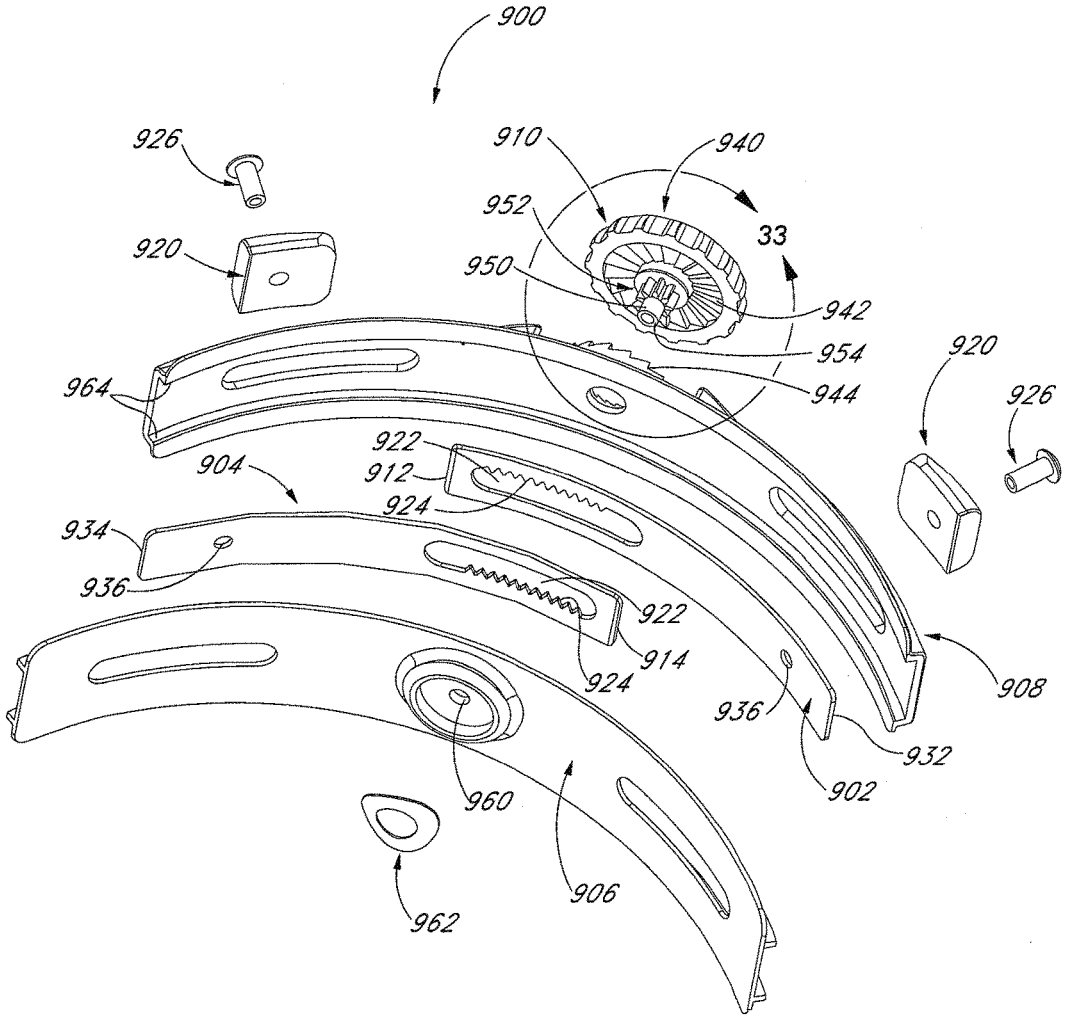
FIG. 31 is an exploded bottom perspective view of one embodiment of a vamp structure.
Figure 32:
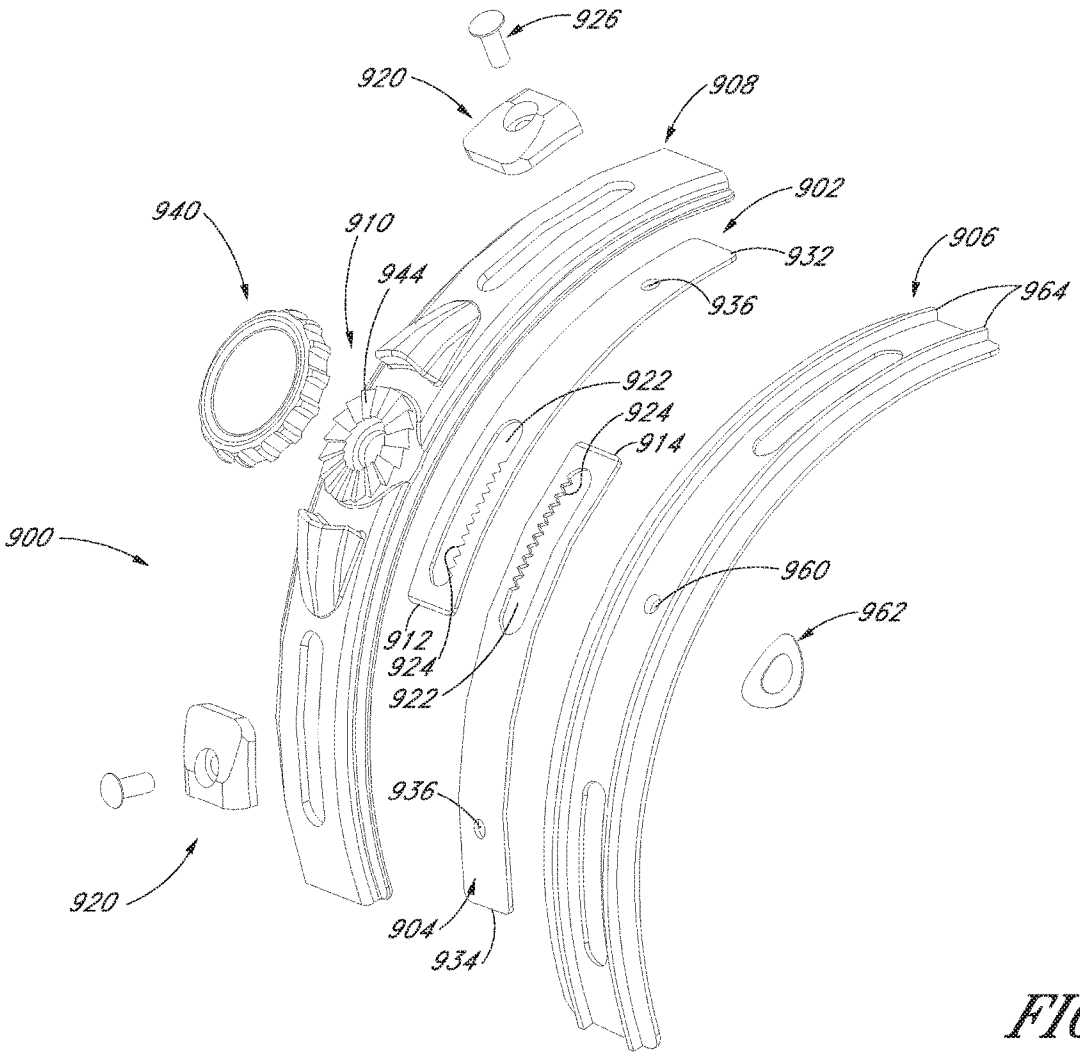
FIG. 32 is an exploded top perspective view of one embodiment of a vamp structure.
Figure 33:
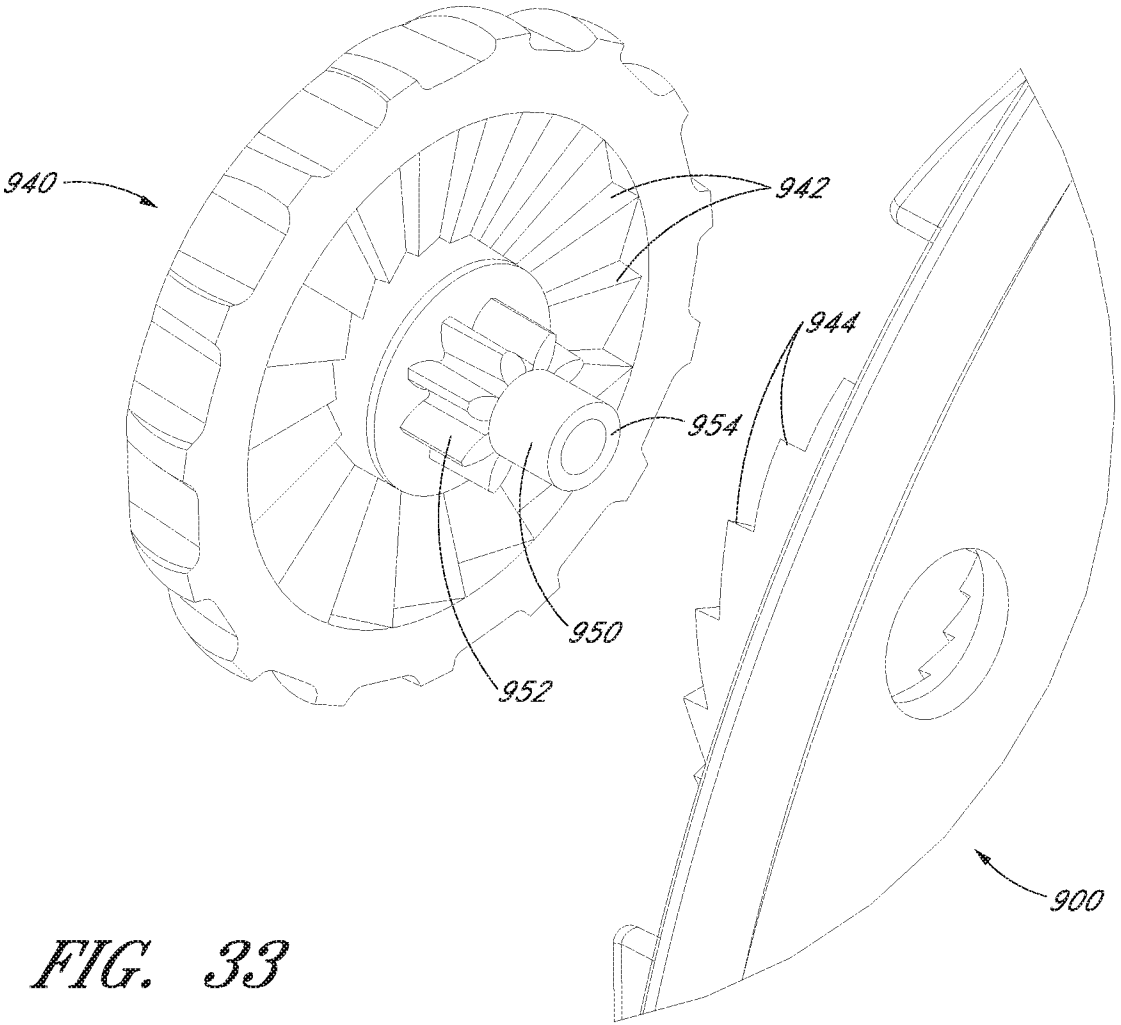
FIG. 33 is a detail view of an embodiment of a tightening mechanism for use in a vamp structure.
Figure 34:
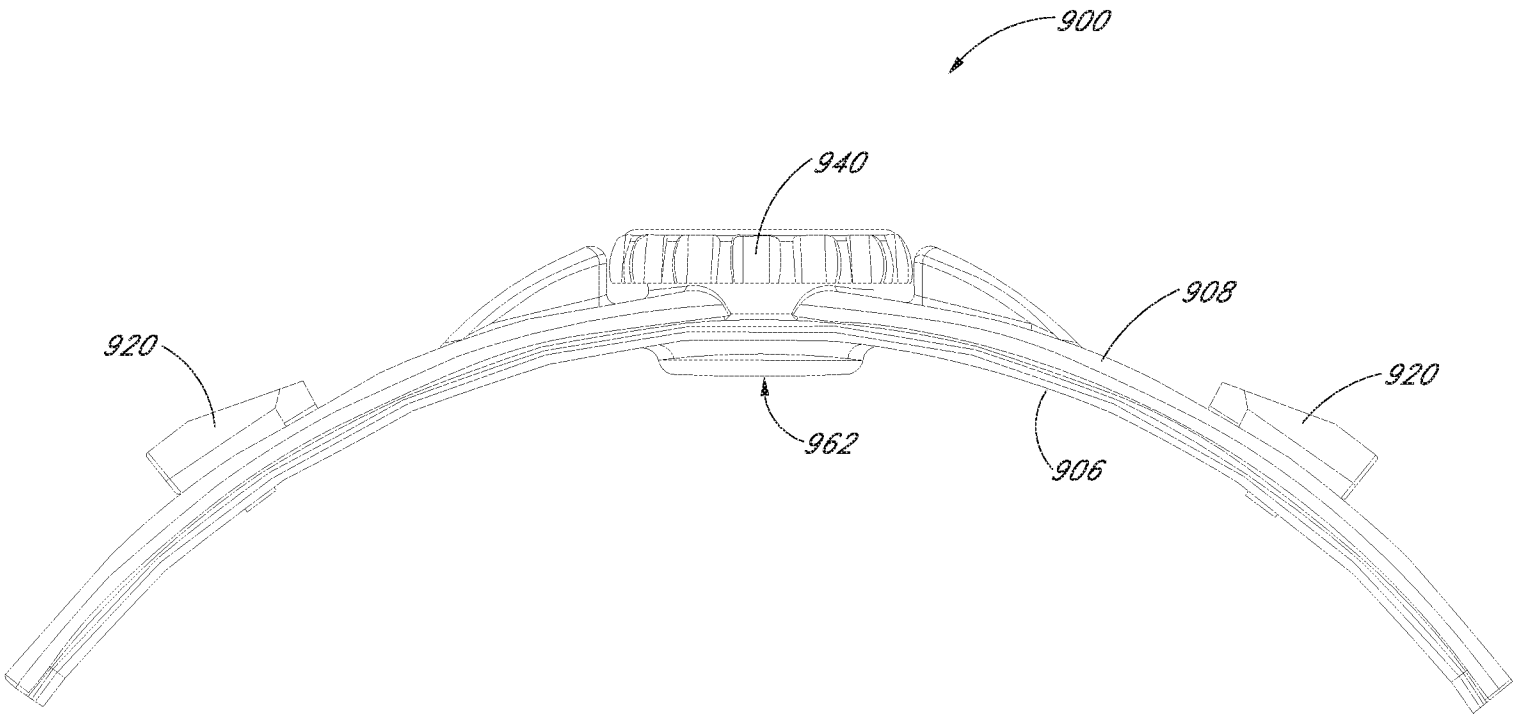
FIG. 34 is a side elevation view of one embodiment of an assembled vamp.

The stops 920 are generally carried by the first and second compression bands 902, 904. With reference to FIGS. 30 and 31 each of the first 902 and second 904 compression bands comprises an elongate slot 922 adjacent a distal end 912, 914 of the compression bands 902, 904. Each slot 922 includes a plurality of teeth 924 on one edge, the other edge remaining substantially smooth and free of teeth. The bands 902, 904 are positioned as shown in FIGS. 30 and 31 such that the slots 922 overlap, thereby positioning the teeth 924 of each compression band 902, 904 on opposite sides of a centerline of the dynamic spacer 900.

Adjacent to their proximal ends 932, 934, the compression bands 902, 904 can also include attachment holes 936 configured to be secured to the stops 920. In the embodiments illustrated in FIG. 30 and, the stops 920 can be secured to the compression straps 902, 904 by fasteners 926 which can extend through the stops 920, through slots in the top cover 908, through the fastener holes 936 in the compression bands 902, 904 and through slots in the bottom cover 906. In some embodiments, the fasteners 926 can also comprise a retaining member positioned below the bottom cover 906 to retain the fastener in the spacer. The fasteners can be rivets, screws, bolts, pins, or any other suitable devices. Similarly, the retaining members can be crimped rivet ends, washers, nuts, or any other suitable device.

FIGS. 30-62 illustrate embodiments of a drive mechanism 910 for use with a dynamic spacer 900. The drive mechanism 910 generally comprises a knob 940 configured to rotate in a direction corresponding to a laterally outward movement of the stops 920 (i.e. a counter-clockwise direction in the illustrated embodiment). In some embodiments, the knob 940 is also configured to be locked or otherwise prevented from rotating in a direction corresponding to a laterally inward movement of the stops 920 (i.e. a clockwise direction in the illustrated embodiment). In the illustrated embodiment, the knob 940 comprises a plurality of face ratchet teeth 942 on an underside thereof. The top cover 908 can also be provided with a plurality of mating face ratchet teeth 944 configured to engage the teeth 942 of the knob 940. In the illustrated embodiments, the mating ratchet teeth 942, 944 are generally configured to resist a clockwise rotation of the knob 940, thereby preventing the stops 920 from being pushed laterally inwards by the footwear flap edges. In alternative embodiments, other one-way rotational structures and/or other locking structures can also be used. For example, pins, latches, levers, or other devices can be used to prevent rotation of the knob and/or lateral movement of the stops 920. In some embodiments, the knob 940 is also configured to be releasable in order to allow the stops 920 to move laterally inwards in order to allow for increased tightening in the area of the dynamic spacer 900.

In the illustrated embodiment, the knob 940 also includes a shaft 950 extending from its underside and including a drive gear 952 configured to engage the teeth 924 of each of the first 902 and second 904 compression bands. The gear 952 can be any suitable type as desired. The number and/or a spacing of teeth provided on the gear can be varied depending on a degree of mechanical advantage desired. In alternative embodiments, additional gears can also be provided in order to provide additional mechanical advantage to the drive mechanism. For example, in some embodiments, a substantial mechanical advantage may be desirable in order to allow a wearer to more easily loosen a section of a footwear item by turning the knob 940 and driving the stops 920 further apart.

In some embodiments, the shaft 950 is of sufficient length that the distal end 954 of the shaft 950 extends through a central aperture 960 in the bottom cover 906 when the dynamic spacer 900 is assembled. A spring washer 962 can be secured to the distal end 954 of the shaft 950 after the shaft 950 has been inserted through the central aperture 960 in the bottom cover 906. The spring washer 962 is generally configured to bias the knob 940 downward along the axis of the shaft 950, thereby maintaining the ratchet teeth 942, 944 in engagement with one another. In some embodiments, the spring washer 962 can also be configured to allow a degree of upward motion of the knob 940 in order to allow the face ratchet teeth 942 to disengage, thereby allowing the stops 920 to move laterally inward.

In some embodiments, the top cover 908 and bottom cover 906 include rails 964 configured to retain and guide the first and second compression bands 902, 904 along a desired path. A material of the compression bands 902, 904 and a space between the top and bottom covers 906, 908 are generally selected to prevent the compression bands from buckling under the compressive force that will be applied by the footwear flap edges engaging the stops 920.

The dynamic spacer 900 can be secured to a footwear item by attaching the bottom and/or top covers 906, 908 to a portion of a footwear item by any suitable means, such as rivets, adhesives, stitches, hook-and-loop fasteners, etc. Additionally, in some embodiments, the dynamic spacer 900 can be configured to releasably attach to portions of a footwear item. For example, in some embodiments, a tongue of a boot may comprise a plurality of attachment locations for a dynamic spacer, such as at an upper section, an instep section, a toe section, etc. A dynamic spacer can then be removed from any of the attachment locations and moved to another of the attachment locations for a different fit. In still further embodiments, a dynamic spacer need not be attached to any portion of a footwear item. For example, a dynamic spacer can simply be held in place by friction created by a compressive force between the flaps of the footwear.

In alternative embodiments, other drive mechanisms can also be provided. For example, a rack-and-pinion type drive gear and teeth can be oriented such that a rotational axis of the drive gear is positioned perpendicular to the orientation of the illustrated embodiments. In still further embodiments, other mechanical transmission elements, such as worm screws, cable/pulley arrangements, or lockable sliding elements, can alternatively be used to provide an adjustable position between the stops 920.

In FIG. 3, the top guide 52 is illustrated for simplicity as unattached to the corresponding side flap 32. However, in an actual product, the top guide 52 is preferably secured to the side flap 32. For example, upper retaining member 44*a*, discussed above, is illustrated in FIG. 2. Alternatively, the top guide 52 may extend within the material of or between the layers of the side flap 32. As a further alternative, or in addition to the foregoing, the end 55 of top guide 52 may be anchored to the side flap 32 using any of a variety of tie down or clamping structures. The lace 23 may be slideably positioned within a tubular sleeve extending between the reel and the tie down at the end 55 of the sleeve.

Any of a variety of flexible tubular sleeves may be utilized, such as a spring coil with or without a polymeric jacket similar to that used currently on bicycle brake and shift cables. The use of a flexible but axially noncompressible sleeve for surrounding the lace 23 between the reel and the tie down at the end 55 isolates the tightening system from movement of portions of the boot, which may include hinges or flexibility points as is understood in the art. The tie down may comprise any of a variety of structures including grommets, rivets, staples, stitched or adhesively bonded eyelets, as will be apparent to those of skill in the art in view of the disclosure herein.

In the illustrated embodiment, the side guide members 50 each have a generally U-shape that opens towards the midline of the shoe. Preferably, each of the side guide members 50 comprise a longitudinal portion 51 and two inclined or transverse portions 53 extending therefrom. The length of the longitudinal portion 51 may be varied to adjust the distribution of the closing pressure that the lace 23 applies to the upper 24 when the lace 23 is under tension. In addition, the length of the longitudinal portion 51 need not be the same for all guide members 50 on a particular shoe. For example, the longitudinal portion 51 may be shortened near the ankle portion 29 to increase the closing pressure that the lace 23 applies to the ankles of the wearer. In general, the length of the longitudinal portion 51 will fall within the range of from about 2" to about 3", and, in some embodiments, within the range of from about 3" to about 4". In one snowboard application, the longitudinal portion 51 had a length of about 2". The length of the transverse portion 53 is generally within the range of from about $\chi$" to about 1". In one snowboard embodiment, the length of transverse portion 53 was about 2". Different specific length combinations can be readily optimized for a particular boot design through routine experimentation by one of ordinary skill in the art in view of the disclosure herein.

In between the longitudinal portion 51 and transverse portion 53 is a curved transition. Preferably, the transition has a substantially uniform radius throughout, or smooth progressive curve without any abrupt edges or sharp changes in radius. This construction provides a smooth surface over which the lace 23 can slide, as it rounds the corner. The transverse section 53 can in some embodiments be deleted, as long as a rounded cornering surface is provided to facilitate sliding of the lace 23. In an embodiment which has a transverse section 53 and a radiused transition, with a guide member 50 having an outside diameter of 0.090" and a lace 23 having an outside diameter of 0.027", the radius of the transition is preferably greater than about 0.1", and generally within the range of from about 0.125" to about 0.4".

Referring to FIG. 3, the upper guide members 52 extend substantially around opposite sides of the ankle portion 29. Each upper guide member 52 has a proximal end 56 and a distal end 55. The distal ends 55 are positioned near the top of the tongue 36 for receipt of the lace 23 from the uppermost side guide members 50. The proximal ends 56 are coupled to the tightening mechanism 25. In the illustrated embodiment, the proximal ends 56 include rectangular coupling mounts 57 that engage with the tightening mechanism 25 for feeding the ends of the lace 23 therein, as described more fully below. The guide members 50 and/or 52 are preferably manufactured of a low friction material, such as a lubricous polymer or metal, that facilitates the slideability of the lace 23 therethrough. Alternatively, the guides 50, 52 can be made from any convenient substantially rigid material, and then be provided with a lubricous coating on at least the inside surface of lumen 54 to enhance slideability. The guide members 50 and 52 are preferably substantially rigid to prevent bending and kinking of the guide members 50, 52 and/or the lace 23 within any of the guide members 50 and 52 as the lace 23 is tightened. The guide members 50, 52 may be manufactured from straight tube of material that is cold bent or heated and bent to a desired shape.

As an alternative to the previously described tubular guide members, the guide members 50 and/or 52 comprise an open channel having, for example, a semicircular or "U" shaped cross section. The guide channel is preferably mounted on the boot such that the channel opening faces away from the midline of the boot, so that a lace under tension will be retained therein. One or more retention strips, stitches or flaps may be provided for "closing" the open side of the channel, to prevent the lace from escaping when tension on the lace is released. The axial length of the channel can be preformed in a generally U configuration like the illustrated tubular embodiment, and may be continuous or segmented as described in connection with the tubular embodiment.

Several guide channels may be molded as a single piece, such as several guide channels molded to a common backing support strip which can be adhered or stitched to the shoe. Thus, a right lace retainer strip and a left lace retainer strip can be secured to opposing portions of the top or sides of the shoe to provide a right set of guide channels and a left set of guide channels.

Figure 4:
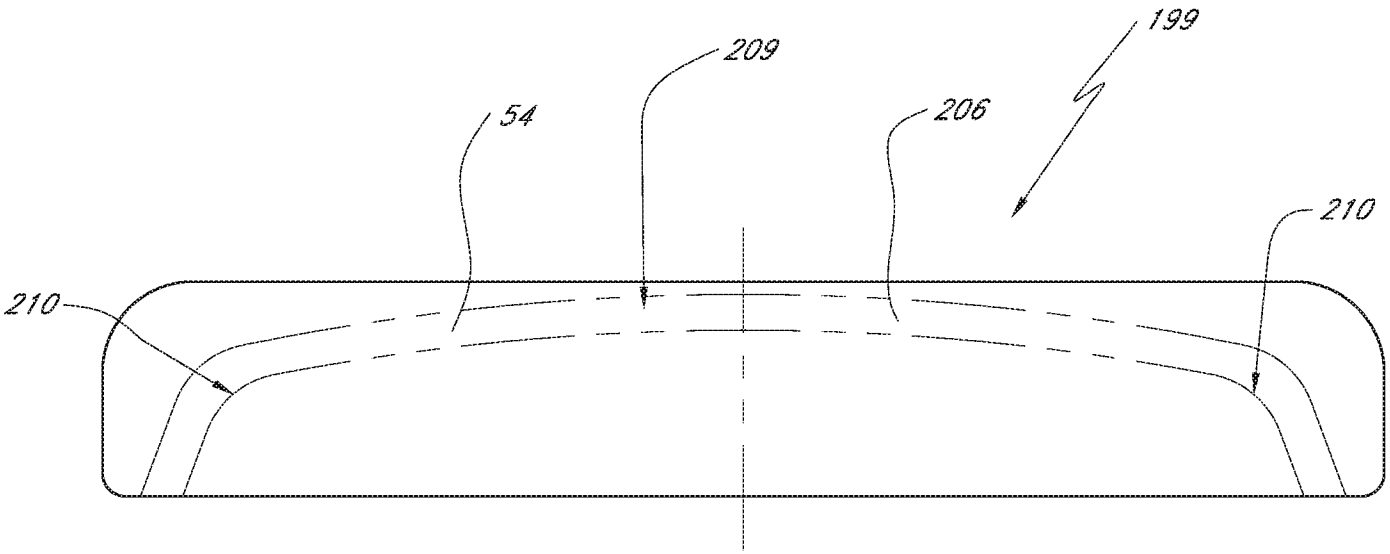
FIG. 4 is a top plan view of the multi-piece guide member.

With reference to FIG. 4, the gap 206 is elongated so that it defines a lace pathway that functions as the lumen 54 for the lace 23. The lumen 54 preferably includes an elongate region 209 that extends generally lengthwise along the edges of the flaps 32 or 34 when the guide member 199 is mounted on the boot. The elongate region 209 may be straight or may be defined by a smooth curve along the length thereof, such as a continuous portion of a circle or ellipse. As an example, the elongate region 209 may be defined by a portion of an ellipse having a major axis of about 0.5 inches to about 2 inches and a minor axis of about 0.25 inches to about 1.5 inches. In one embodiment, the major axis is approximately 1.4 inches and the minor axis is about 0.5 inches. The lumen 54 further includes a transverse region 210 on opposite ends of the elongate region 209. The transverse region 210 extends at an incline to the edges of the flaps 32 and 34. Alternatively, the elongate region 209 and the transverse region 210 may be merged into one region having a continuous circular or elliptical profile to spread load evenly along the length of the lumen 54 and thereby reduce total friction in the system.

Referring to FIG. 4, each of the guide members 199 has a predetermined distance between the first opening 207*a* and second opening 207*b* to the lace pathway therein. The effective linear distance between the first and second openings to the lace pathway may affect the fit of the boot.

The lace 23 may be formed from any of a wide variety of polymeric or metal materials or combinations thereof, which exhibit sufficient axial strength and bendability for the present application. For example, any of a wide variety of solid core wires, solid core polymers, or multi-filament wires or polymers, which may be woven, braided, twisted or otherwise oriented can be used. A solid or multi-filament metal core can be provided with a polymeric coating, such as PTFE or others known in the art, to reduce friction. In one embodiment, the lace 23 comprises a stranded cable, such as a 7 strand by 7 strand cable manufactured of stainless steel. In order to reduce friction between the lace 23 and the guide members 50, 52 through which the lace 23 slides, the outer surface of the lace 23 is preferably coated with a lubricous material, such as nylon or Teflon. In a preferred embodiment, the diameter of the lace 23 ranges from 0.024 inches to 0.060 inches and is preferably 0.027 inches. The lace 23 is desirably strong enough to withstand loads of at least 40 pounds and preferably at least about 90 pounds. In certain embodiments the lace is rated at least about 100 pounds up to as high as 200 pounds or more. A lace 23 of at least five feet in length is suitable for most footwear sizes, although smaller or larger lengths could be used depending upon the lacing system design.

The lace 23 may be formed by cutting a piece of cable to the desired length. If the lace 23 comprises a braided or stranded cable, there may be a tendency for the individual strands to separate at the ends or tips of the lace 23, thereby making it difficult to thread the lace 23 through the openings in the guide members 50, 52. As the lace 23 is fed through the guide members, the strands of the lace 23 easily catch on the curved surfaces within the lace guide members. The use of a metallic lace, in which the ends of the strands are typically extremely sharp, also increases the likelihood of the cable catching on the guide members during threading. As the tips of the strands catch on the guide members and/or the tightening mechanism, the strands separate, making it difficult or impossible for the user to continue to thread the lace 23 through the tiny holes in the guide members and/or the tightening mechanism. Unfortunately, unstranding of the cable is a problem unique to the present replaceable-lace system, where the user may be required to periodically thread the lace through the lace guide members and into the corresponding tightening mechanism.

One solution to this problem is to provide the tips or ends 59 of the lace 23 with a sealed or bonded region 61 wherein the individual strands are retained together to prevent separation of the strands from one another. For clarity of illustration, the bonded region 61 is shown having an elongate length. However, the bonded region 61 may also be a bead located at just the extreme tip of the lace 23 and, in one embodiment, could be a bonded tip surface as short as 0.002 inch or less.

After the 7×7 multistrand stainless steel cable described above has been tightened and untightened a number of times, the cable tends to kink or take a set. Kink resistance of the cable may be improved by making the cable out of a nickel titanium alloy such as nitinol. Other materials may provide desirable kink resistance, as will be appreciated by those of skill in the art in view of the disclosure herein. In one particular embodiment, a 1×7 multi-strand cable may be constructed having seven nitinol strands, each with a diameter within the range of from about 0.005 inches to about 0.015 inches woven together. In one embodiment, the strand has a diameter of about 0.010 inches, and a 1×7 cable made with that strand has an outside diameter ("OD") of about 0.030 inches. The diameter of the nitinol strands may be larger than a corresponding stainless steel embodiment due to the increased flexibility of nitinol, and a 1×7 construction and in certain embodiments a 1×3 construction may be utilized.

In a 1×3 construction, three strands of nitinol, each having a diameter within the range of from about 0.007 inches to about 0.025 inches, preferably about 0.015 inches are drawn and then swaged to smooth the outside. A drawn multistrand cable will have a nonround cross-section, and swaging and/or drawing makes the cross-section approximately round. Swaging and/or drawing also closes the interior space between the strands, and improves the crush resistance of the cable. Any of a variety of additives or coatings may also be utilized, such as additives to fill the interstitial space between the strands and also to add lubricity to the cable. Additives such as adhesives may help hold the strands together as well as improve the crush resistance of the cable. Suitable coatings include, among others, PTFE, as will be understood in the art.

In an alternate construction, the lace or cable comprises a single strand element. In one application, a single strand of a nickel titanium alloy wire such as nitinol is utilized. Advantages of the single strand nitinol wire include both the physical properties of nitinol, as well as a smooth outside diameter which reduces friction through the system. In addition, durability of the single strand wire may exceed that of a multi strand since the single strand wire does not crush and good tensile strength or load bearing capacity can be achieved using a small OD single strand wire compared to a multi strand braided cable. Compared to other metals and alloys, nitinol alloys are extremely flexible. This is useful since the nitinol laces are able to navigate fairly tight radii curves in the lace guides and also in the small reel. Stainless steel or other materials tend to kink or take a set if a single strand was used, so those materials are generally most useful in the form of a stranded cable. However, stranded cables have the disadvantage that they can crush in the spool when the lace is wound on top of itself. In addition, the stranded cables are not as strong for a given diameter as a monofilament wire because of the spaces in between the strands. Strand packing patterns in multistrand wire and the resulting interstitial spaces are well understood in the art. For a given amount of tensile strength, the multistrand cables therefore present a larger bulk than a single filament wire. Since the reel is preferably minimized in size the strongest lace for a given diameter is preferred. In addition, the stranded texture of multistrand wires create more friction in the lace guides and in the spool. The smooth exterior surface of a single strand creates a lower friction environment, better facilitating tightening, loosening and load distribution in the dynamic fit of the present invention.

Single strand nitinol wires having diameters within the range of from about 0.020 inches to about 0.040 inches may be utilized, depending upon the boot design and intended performance. In general, diameters which are too small may lack sufficient load capacity and diameters which are too large may lack sufficient flexibility to be conveniently threaded through the system. The optimal diameter can be determined for a given lacing system design through routine experimentation by those of skill in the art in view of the disclosure herein. In many boot embodiments, single strand nitinol wire having a diameter within the range of from about 0.025 inches to about 0.035 inches may be desirable. In one embodiment, single strand wire having a diameter of about 0.030 inches is utilized.

The lace may be made from wire stock, shear cut or otherwise severed to the appropriate length. In the case of shear cutting, a sharpened end may result. This sharpened end is preferably removed such as by deburring, grinding, and/or adding a solder ball or other technique for producing a blunt tip. In one embodiment, the wire is ground or coined into a tapered configuration over a length of from about ½ inch to about 4 inches and, in one embodiment, no more than about 2 inches. The terminal ball or anchor is preferably also provided as discussed below. Tapering the end of the nitinol wire facilitates feeding the wire through the lace guides and into the spool due to the increased lateral flexibility of the reduced cross section.

Provision of an enlarged cross sectional area structure at the end of the wire, such as by welding, swaging, coining operations or the use of a melt or solder ball, may be desirable in helping to retain the lace end within the reel as well as facilitating feeding the lace end through the lace guides and into the reel. In one embodiment of the reel, discussed elsewhere herein, the lace end is retained within the reel under compression by a set screw. While set screws may provide sufficient retention in the case of a multi strand wire, set screw compression on a single stand cable may not produce sufficient retention force because of the relative crush resistance of the single strand. The use of a solder ball or other enlarged cross sectional area structure at the end of the lace can provide an interference fit behind the set screw, to assist retention within the reel.

In one example, a 0.030 inch diameter single strand lace is provided with a terminal ball having a diameter within the range of from about 0.035 inches to about 0.040 inches. In addition to or as an alternative to the terminal ball or anchor, a slight angle or curve may be provided in the tip of the lace. This angle may be within the range of from about 5° to about 25°, and, in one embodiment about 15°. The angle includes approximately the distal ⅛ inch of the lace. This construction allows the lace to follow tight curves better, and may be combined with a rounded or blunted distal end which may assist navigation and locking within the reel. In one example, a single strand wire having a diameter of about 0.030 inches is provided with a terminal anchor having a diameter of at least about 0.035 inches. Just proximal to the anchor, the lace is ground to a diameter of about 0.020 inches, which tapers over a distance of about an inch in the proximal direction up to the full 0.030 inches. Although the term "diameter" is utilized to describe the terminal anchor, Applicant contemplates nonround anchors such that a true diameter is not present. In a noncircular cross-section embodiment, the closest approximation of the diameter is utilized for the present purposes.

As an alternative terminal anchor on the lace, a molded piece of plastic or other material may be provided on the end of each single strand. In a further variation, each cable end is provided with a detachable threading guide. The threading guide may be made from any of a variety of relatively stiff plastics like nylon, and be tapered to be easily travel around the corners of the lace guides. After the lace is threaded through the lace guides, the threading guide may be removed from the lace and discarded, and the lace may be then installed into the reel.

The terminal anchor on the lace may also be configured to interfit with any of a variety of connectors on the reel. Although set screws are a convenient mode of connection, the reel may be provided with a releasable mechanism to releasably receive the larger shaped end of the lace which snaps into place and is not removable from the reel unless it is released by an affirmative effort such as the release of a lock or a lateral movement of the lace within a channel. Any of a variety of releasable interference fits may be utilized between the lace and the reel, as will be apparent to those of skill in the art in view of the disclosure herein.

As shown in FIG. 3, the tightening mechanism 25 is mounted to the rear of the upper 24 by fasteners 64. Although the tightening mechanism 25 is shown mounted to the rear of the boot 20, it is understood that the tightening mechanism 25 could be located at any of a wide variety of locations on the boot 20. In the case of an ice skating boot, the tightening mechanism is preferably positioned over a top portion of the tongue 36. The tightening mechanism 25 may alternatively be located on the bottom of the heel of the boot, on the medial or the lateral sides of the upper or sole, as well as anywhere along the midline of the shoe facing forward or upward. Location of the tightening mechanism 25 may be optimized in view of a variety of considerations, such as overall boot design as well as the intended use of the boot. The shape and overall volume of the tightening mechanism 25 can be varied widely, depending upon the gear train design, and the desired end use and location on the boot. A relatively low profile tightening mechanism 25 is generally preferred. The mounted profile of the tightening mechanism 25 can be further reduced by recessing the tightening mechanism 25 into the wall or tongue of the boot. Boots for many applications have a relatively thick wall, such as due to structural support and/or thermal insulation and comfort requirements. The tightening mechanism may be recessed into the wall of the boot by as much as:" or more in some locations and for some boots, or on the order of about χ" or 2" for other locations and/or other boots, without adversely impacting the comfort and functionality of the boot.

Any of a variety of spool or reel designs can be utilized in the context of the present invention, as will be apparent to those of skill in the art in view of the disclosure herein.

Depending upon the gearing ratio and desired performance, one end of the lace can be fixed to a guide or other portion of the boot and the other end is wound around the spool. Alternatively, both ends of the lace can be fixed to the boot, such as near the toe region and a middle section of the lace is attached to the spool.

Any of a variety of attachment structures for attaching the ends of the lace to the spool can be used. In addition to the illustrated embodiment, the lace may conveniently be attached to the spool by threading the lace through an aperture and providing a transversely oriented set screw so that the set screw can be tightened against the lace and to attach the lace to the spool. The use of set screws or other releasable clamping structures facilitates disassembly and reassembly of the device, and replacement of the lace as will be apparent to those of skill in the art.

In any of the embodiments disclosed herein, the lace may be rotationally coupled to the spool either at the lace ends, or at a point on the lace that is spaced apart from the ends. In addition, the attachment may either be such that the user can remove the lace with or without special tools, or such that the user is not intended to be able to remove the lace from the spool. Although the device is disclosed primarily in the context of a design in which the lace ends are attached to the spool, the lace ends may alternatively be attached elsewhere on the footwear. In this design, an intermediate point on the lace is connected to the spool such as by adhesives, welding, interference fit or other attachment technique. In one design the lace extends through an aperture which extends through a portion of the spool, such that upon rotation of the spool, the lace is wound around the spool. The lace ends may also be attached to each other, to form a continuous lace loop.

It is contemplated that a limit on the expansion of portions of the boot due to the sliding of the lace 23 could be accomplished such as through one or more straps that extend transversely across the boot 20 at locations where an expansion limit or increased tightness or support are desired. For instance, a strap could extend across the instep portion 30 from one side of the boot 20 to another side of the boot. A second or lone strap could also extend around the ankle portion 29.

Figure 5:
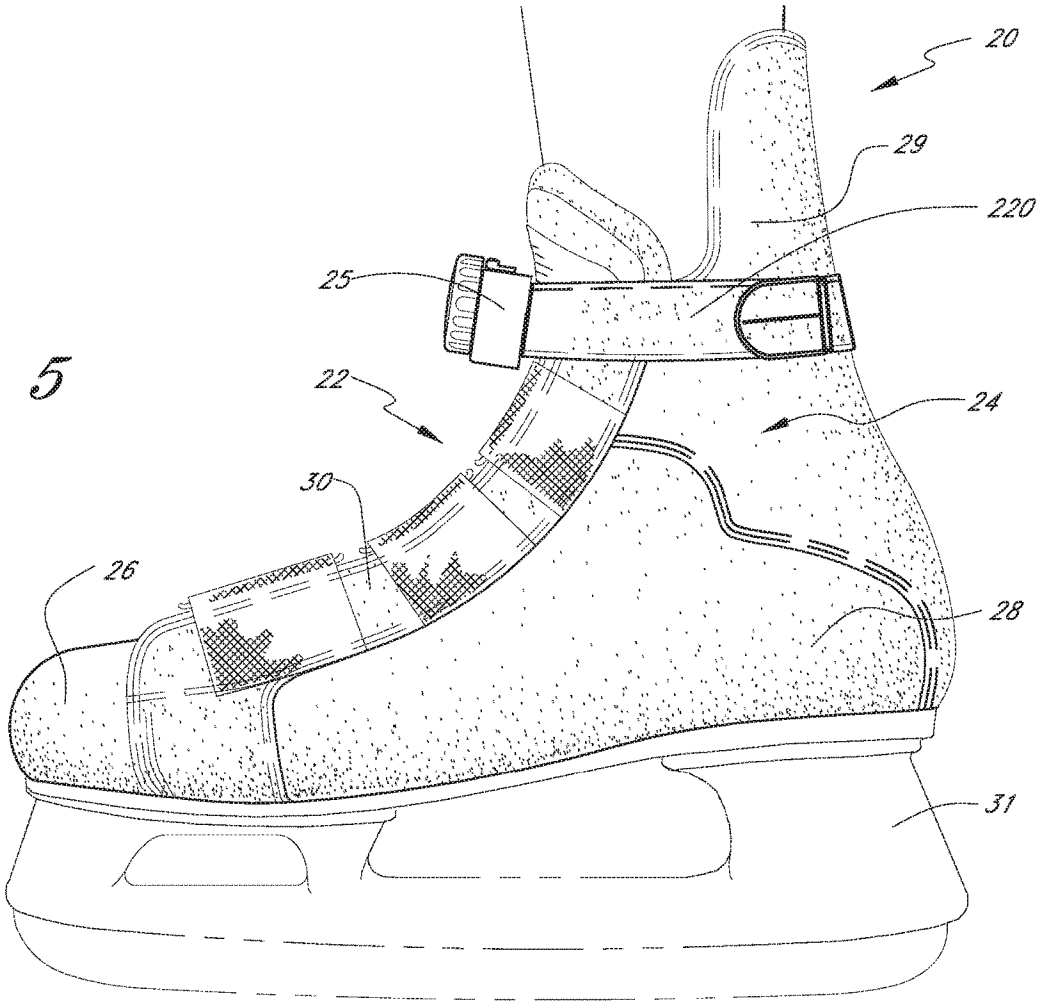
FIG. 5 is a side view of the sport boot including an ankle support strap.

With reference to FIG. 5, an expansion limiting strap 220 is located on the ankle portion of the boot 20 to supplement the closure provided by the lace 23 and provide a customizable limit on expansion due to the dynamic fit achieved by the lacing system of the present invention. The limit strap 220 may also prevent or inhibit the wearer's foot from unintentionally exiting the boot 20 if the lace 20 is unlocked or severed or the reel fails. In the illustrated embodiment, the strap 220 extends around the ankle of the wearer. The location of the limit strap 220 can be varied depending upon boot design and the types of forces encountered by the boot in a particular athletic activity.

For example, in the illustrated embodiment, the limit strap 220 defines an expansion limiting plane which extends generally horizontally and transverse to the wearer's ankle or lower leg. The inside diameter or cross section of the footwear thus cannot exceed a certain value in the expansion limiting plane, despite forces imparted by the wearer and the otherwise dynamic fit. The illustrated location tends to limit the dynamic opening of the top of the boot as the wearer bends forward at the ankle. The function of the limit strap 220 may be accomplished by one or more straps, wires, laces or other structures which encircle the ankle, or which are coupled to other boot components such that the limit strap in combination with the adjacent boot components provide an expansion limiting plane. In one embodiment the expansion limiting strap surrounds the ankle as illustrated in FIG. 5. The anterior aspect of the strap is provided with an aperture for receiving the reel assembly therethrough. This allows the use of the expansion limiting strap in an embodiment having a front mounted reel.

In an alternative design, the expansion limiting plane is positioned in a generally vertical orientation, such as by positioning the limit strap 220 across the top of the foot anterior of the ankle, to achieve a different limit on dynamic fit. In this location, the expansion limiting strap 220 may encircle the foot inside or outside of the adjacent shoe components, or may connect to the sole or other component of the shoe to provide the same net force effect as though the strap encircled the foot.

The limit strap 220 may also create a force limiting plane which resides at an angle in between the vertical and horizontal embodiments discussed above, such as in an embodiment where the force limiting plane inclines upwardly from the posterior to the anterior within the range of from about 25° to about 75° from the plane on which the sole of the boot resides. Positioning the limit strap 220 along an inclined force limiting plane which extends approximately through the ankle can conveniently provide both a limit on upward movement of the foot within the boot, as well as provide a controllable limit on the anterior flexing of the leg at the ankle with respect to the boot.

The strap 220 preferably includes a fastener 222 that could be used to adjust and maintain the tightness of the strap 220. Preferably, the fastener 222 is capable of quick attachment and release, so that the wearer can adjust the limit strap 220 without complication. Any of a variety of fasteners such as corresponding hook and loop (e.g., Velcro) surfaces, snaps, clamps, cam locks, laces with knots and the like may be utilized, as will be apparent to those of skill in the art in view of the disclosure herein.

The strap 220 is particularly useful in the present low-friction system. Because the lace 23 slides easily through the guide members, the tension in the lace may suddenly release if the lace is severed or the reel fails. This would cause the boot to suddenly and completely open which could cause injury to the wearer of the boot, especially if they were involved in an active sport at the time of failure. This problem is not present in traditional lacing systems, where the relatively high friction in the lace, combined with the tendency of the lace to wedge with the traditional eyelets on the shoe, eliminates the possibility of the lace suddenly and completely loosening.

The low-friction characteristics of the present system also provides the shoe with a dynamic fit around the wearer's foot. The wearer's foot tends to constantly move and change orientation during use, especially during active sports. This shifting causes the tongue and flaps of the shoe to shift in response to the movement of the foot. This is facilitated by the low-friction lacing system, which easily equilibrates the tension in the lace in response to shifting of the wearer's foot. The strap 220 allows the user to regulate the amount of dynamic fit provided by the boot by establishing an outer limit on the expansion which would otherwise have occurred due to the tension balancing automatically accomplished by the readjustment of the lace throughout the lace guide system.

For example, if the wearer of the boot in FIG. 5 did not have the ankle strap 220, when he flexed his ankle forward during skating, the increased forward force at the top of the boot would cause the tongue to move out slightly while the laces lower in the boot would tighten. As the wearer straightened his ankle out again, closure force would equalize and the tongue would stay tight against his ankle. If the strap 220 were wrapped around his ankle however, it would prevent or reduce this forward movement of the ankle and tongue reducing the dynamic fit characteristics of the boot in the plane of the strap 220 and providing a very different fit and feel of the boot. Thus, the strap provides an effective means for regulating the amount of dynamic fit inherent in the low friction closure system. Since traditional lacing systems have so much friction in them, they do not provide this dynamic fit and consequently would not benefit from the strap in the same way.

Similar straps are commonly used in conjunction with traditional lacing systems but for entirely different reasons. They are used to provide additional closure force and leverage to supplement shoelaces but are not needed for safety and are not used to regulate dynamic fit.

The footwear lacing system 22 described herein advantageously allows a user to incrementally tighten the boot 20 around the user's foot. The low friction lace 23 combined with the low friction guide members 50, 52 produce easy sliding of lace 23 within the guide members 50 and 52. The low friction tongue 36 facilitates opening and closure of the flaps 32 and 34 as the lace is tightened. The lace 23 equilibrates tension along its length so that the lacing system 23 provides an even distribution of tightening pressure across the foot. The tightening pressure may be incrementally adjusted by turning the knob on the tightening mechanism 25. A user may quickly untighten the boot 20 by simply turning or lifting or pressing the knob or operating any alternative release mechanism to automatically release the lace 23 from the tightening mechanism 25.

Figure 6:
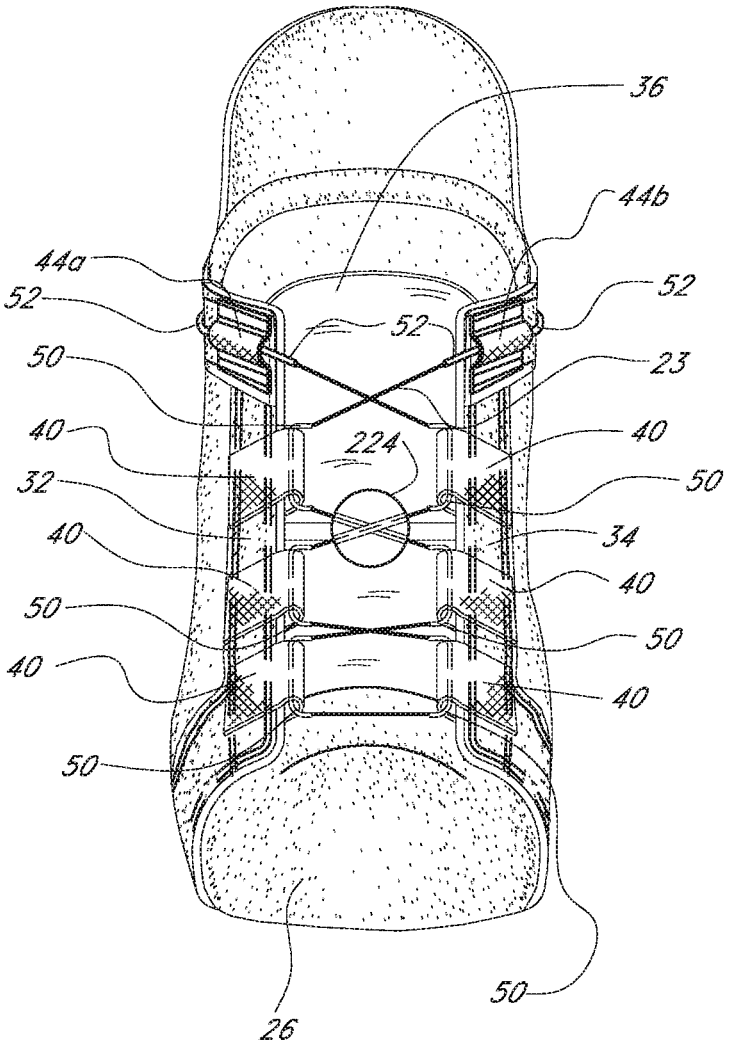
FIG. 6 is a front view of the sport boot including a central lace guide member disposed adjacent the tongue of the boot.

As illustrated in FIG. 6, at least one anti-abrasion member 224 is disposed adjacent the tongue 36 and between the flaps 32, 34. The anti-abrasion member 224 comprises a flat disc-like structure having a pair of internal channels or lumen 127*a,b* arranged in a crossing pattern so as to define a crossing point 230. The lumen 127*a,b* are sized to receive the lace 23 therethrough. The lumen 127*a,b* are arranged to prevent contact between adjacent sections of the lace 23 at the crossing point 230. The anti-abrasion member 224 thereby prevents chafing of the lace 23 at the crossing point 230. The anti-abrasion member 224 also shields the lace 23 from the tongue 36 to inhibit the lace 23 from chafing or abrading the tongue 36.

The anti-abrasion member 224 may alternatively take the form of a knife edge or apex for minimizing the contact area between the lace 23 and the anti-abrasion member 224. For example, at a crossing point where lace 23 crosses tongue 36, an axially extending (e.g. along the midline of the foot or ankle) ridge or edge may be provided in-between the boot tongue 36 and the lace 23. This anti-abrasion member 224 is preferably molded or otherwise formed from a lubricious plastic such as PTFE, or other material as can be determined through routine experimentation. The lace 23 crosses the apex so that crossing friction would be limited to a small contact area and over a lubricious surface rather than along the softer tongue material or through the length of a channel or lumen as in previous embodiments. Tapered sides of the anti-abrasion member 224 would ensure that the anti-abrasion member 224 stayed reasonably flexible as well as help distribute the downward load evenly laterally across the foot. The length along the midline of the foot would vary depending upon the boot design. It may be as short as one inch long or less and placed on the tongue just where the one or more lace crossings are, or it may extend along the entire length of the tongue with the raised ridge or crossing edge more prominent in the areas where the lace crosses and less prominent where more flexibility is desired. The anti-abrasion member 224 may be formed integrally with or attached to the tongue or could float on top of the tongue as in previously described disks.

In one embodiment, the anti-abrasion member 224 is fixedly mounted on the tongue 36 using any of a wide variety of well known fasteners, such as rivets, screws, snaps, stitching, glue, etc. In another embodiment, the anti-abrasion member 224 is not attached to the tongue 36, but rather freely floats atop the tongue 36 and is held in place through its engagement with the lace 23. Alternatively, the anti-abrasion member 224 is integrally formed with the tongue 36, such as by threading a first portion of the lace 23 through the tongue, and the second, crossing portion of lace 23 over the outside surface of the tongue.

Alternatively, one or more of the sections of lace 23 which extend between the flaps 32 and 34 may slideably extend through a tubular protective sleeve. Referring to FIG. 6, three crossover points are illustrated, each crossover point including a first and a second crossing segments of the lace 23. A tubular protective sleeve may be provided on each of the first segments or on both the first and second segments at each of the crossover points. Alternatively, the short tubular protective sheaths may be provided on one or both of the segments of lace 23 at the central crossover point which, in FIG. 6, is illustrated as carrying the anti-abrasion member 24. Optimizing the precise number and location of the protective tubular segments may be routinely accomplished, by those of skill in the art observing wear patterns of the lacing system in a particular shoe design.

The tubular protective element may comprise any of a variety of tubular structures. Lengths of polymeric or metal tubing may be utilized. However, such tubular supports generally have a fixed axial length. Since the distance between the opposing flaps 32 and 34 will vary depending upon the size of the wearer's foot, the protective tubular sleeves should not be of such a great length that will inhibit tightening of the lacing system. The tubular protective sheaths may also have a variable axial length, to accommodate tightening and loosening of the lacing system. This may be accomplished, for example, by providing a tubular protective sheath which includes a slightly stretched spring coil wall. During tightening of the system, when each of the opposing flaps 32 and 34 are brought towards each other, the axial length of the spring guide may be compressed to accommodate various sizes. A further alternative comprises a tubular bellows-like structure having alternating smaller-diameter and larger-diameter sections, that may also be axially compressed or stretched to accommodate varying foot sizes. A variety of specific accordion structures, having pleats or other folds, will be apparent to those of skill in the art in view of the disclosure herein. As a further alternative, a telescoping tubular sleeve may be utilized. In this embodiment, at least a first tubular sleeve having a first diameter is carried by the lace 23. At least a second tubular sleeve having a second, greater diameter is also carried by the lace 23. The first tubular sleeve is axially slideably advanceable within the second tubular sleeve. Two or three or four or more telescoping tubes may be provided, for allowing the axial adjustability described above.

Figure 7:
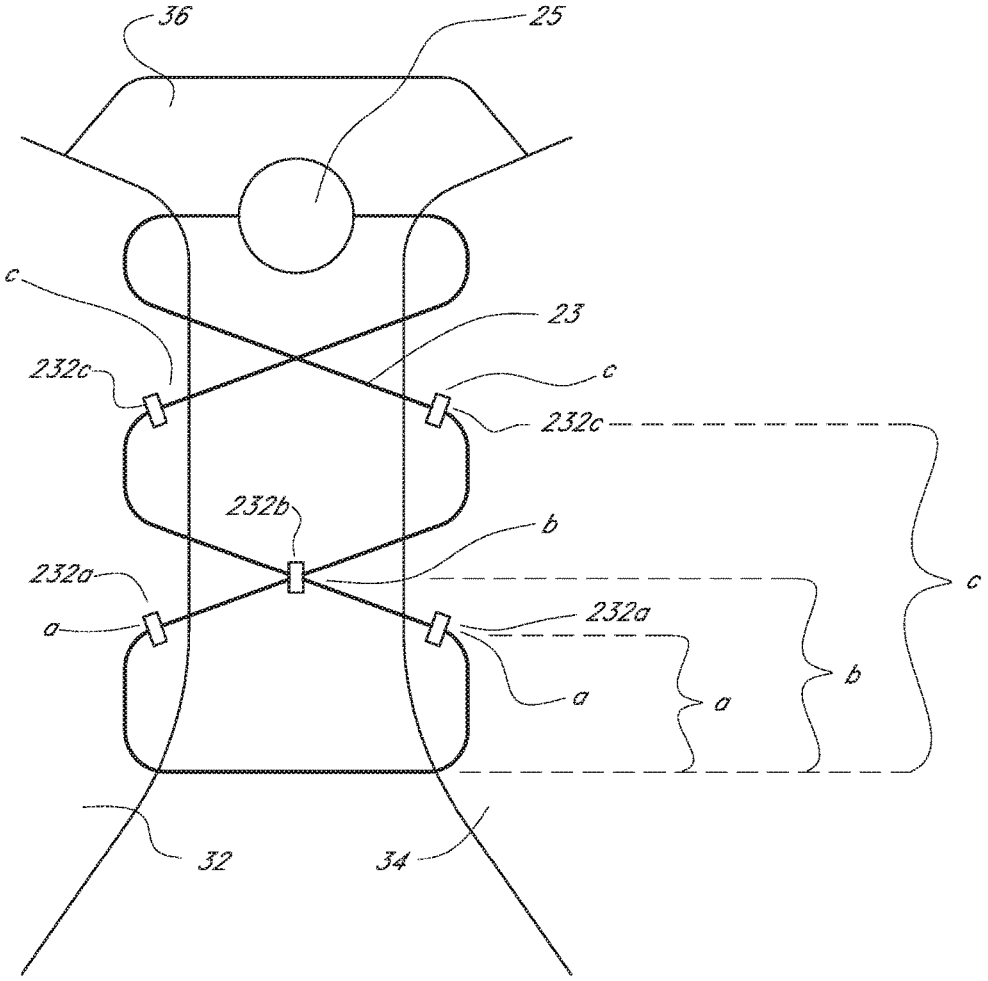
FIG. 7 is a schematic front view of the instep portion of the boot with a plurality of lace locking members disposed along the lace pathway.

FIG. 7 schematically illustrates a top view of the insole region of the boot 20. Locking members 232 may be disposed at any of a wide variety of locations along the lace pathway, such as locations "b", and "c" to create various lace locking zones. By alternately locking and unlocking the locking members 232 and varying the tension in the lace 23, a user may provide zones of varied tightness along the lace pathway.

Figure 8:
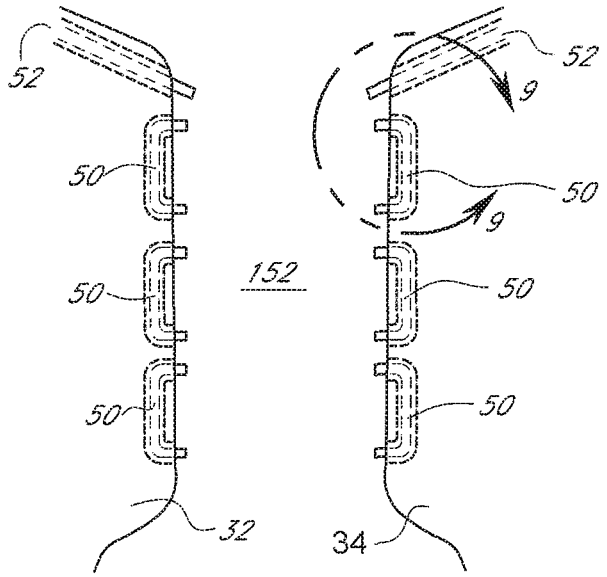
FIG. 8 is a front view of the instep portion of the boot.
Figure 9:
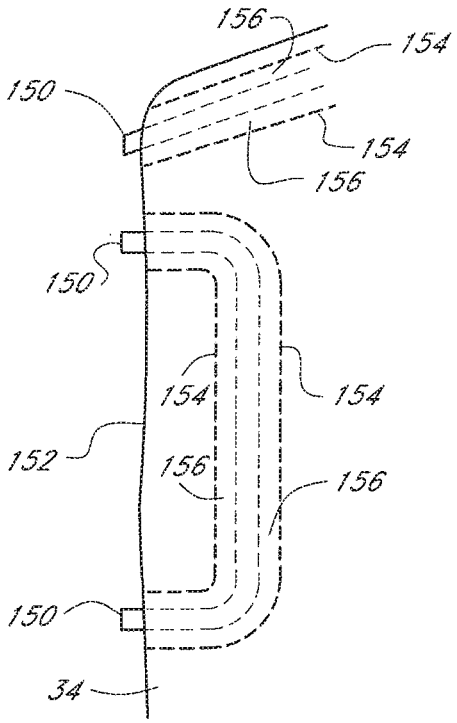
FIG. 9 is an enlarged view of the region within line 9 of FIG. 8.

FIG. 8 is a front view of the instep portion of the boot 20. In the embodiment shown in FIG. 8, the tubular guide members 50 and 52 are mounted directly within the flaps 32, 34, such as within or between single or multiple layers of material. Preferably, the tips 150 of each of the guide member 50, 52 protrude outwardly from an inner edge 152 of each of the flaps 32, 34. As best shown in FIG. 9, a set of stitches 154 surrounds each guide member 50 and 52. The stitches 154 are preferably positioned immediately adjacent the guide members 50, 52 to create a gap 156 therebetween.

For ease of illustration, the gap 156 is shown having a relatively large size with respect to the diameter of the guide members 50, 52. However, the distance between each guide member 50, 52 and the respective stitches 154 is preferably small.

Preferably, each set of stitches 154 forms a pattern that closely matches the shape of the respective guide members so that the guide members 50, 52 fit snug within the flaps 32, 34. The stitches 154 thereby inhibit deformation of the guide members 50, 52, particularly the internal radius thereof, when the lace is tightened. Advantageously, the stitches 154 also function as anchors that inhibit the guide members 50, 52 from moving or shifting relative to the flaps 32, 34 during tightening of the lace.

The gap 156 may be partially or entirely filled with a material, such as glue, that is configured to stabilize the position of the guide members 50, 52 relative to the flaps 32, 34. The material is selected to further inhibit the guide members 50, 52 from moving within the gap 156. The guide members may also be equipped with anchoring members, such as tabs of various shape, that are disposed at various locations thereon and that are configured to further inhibit the guide members 50, 52 from moving or deforming relative to the flap 32. The anchoring members may also comprise notches or grooves on the guide members 50, 52 that generate friction when the guide members 50, 52 begin to move and thereby inhibit further movement. The grooves may be formed using various methods, such as sanding, sandblasting, etching, etc. Axial movement of the guide tubes 50 or 52 may also be limited through the use of any of a variety of guide tube stops (not shown). The guide tube stop includes a tubular body having an opening which provides access to a central lumen extending therethrough. The stop may also be provided with one or more fastening tabs for sewing or gluing to the shoe, as has been discussed. Tabs, once stitched or otherwise secured into place, resist axial movement of the device along its longitudinal pathway.

Figure 10:
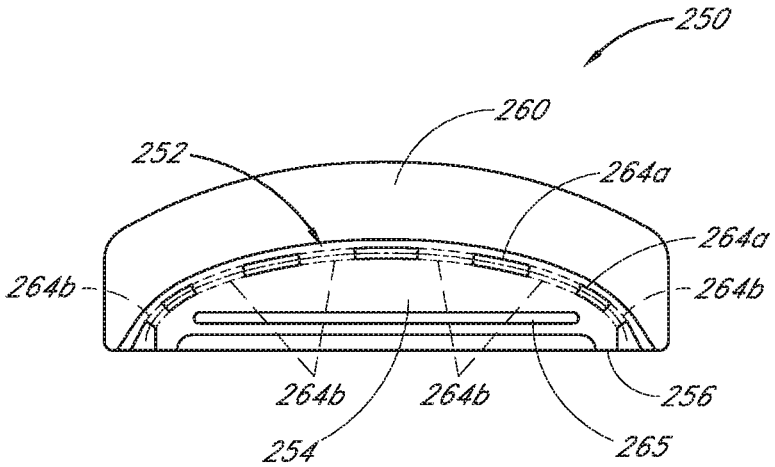
FIG. 10 is a top plan view of an alternative embodiment of a lace guide.
Figure 11:
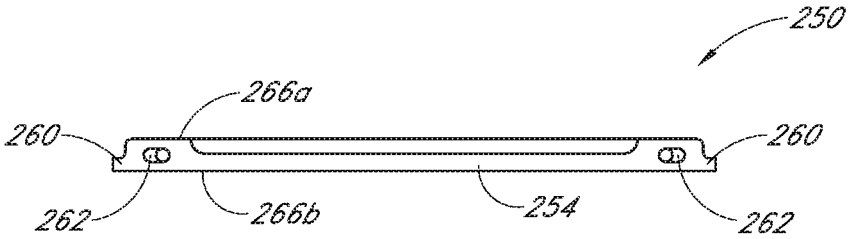
FIG. 11 is a side view of the lace guide of FIG. 10.

With reference to FIGS. 10 and 11, an alternative guide member 250 comprises a thin, single-piece structure having an internal lumen 252 for passage of the lace 23 therethrough. The guide member 250 includes a main portion 254 that defines a substantially straight inner edge 256 of the guide member. A flange portion 260 extends peripherally around one side of the main portion 254. The flange portion 260 comprises a region of reduced thickness with respect to the main portion 254. An elongate slot 265 comprised of a second region of reduced thickness is located on the upper surface 266*a* of the guide member 250.

A pair of lace exit holes 262 extend through a side surface of the lace guide member 250 and communicate with the lumen 252. The lace exit holes 262 may have an oblong shape to allow the lace 23 to exit therefrom at a variety of exit angles.

With reference to FIGS. 10 and 11, a series of upper and lower channels 264*a*, 264*b*, respectively, extend through upper and lower surfaces 266*a*, 266*b*, respectively, of the lace guide member 250. The channels 264 are arranged to extend along the pathway of the lumen 252 and communicate therewith. The location of each of the upper channels 264*a* preferably successively alternates with the location of each of the lower channels 264*b* along the lumen pathway so that the upper channels 264*a* are offset with respect to the lower channels 264*b*.

Figure 12:
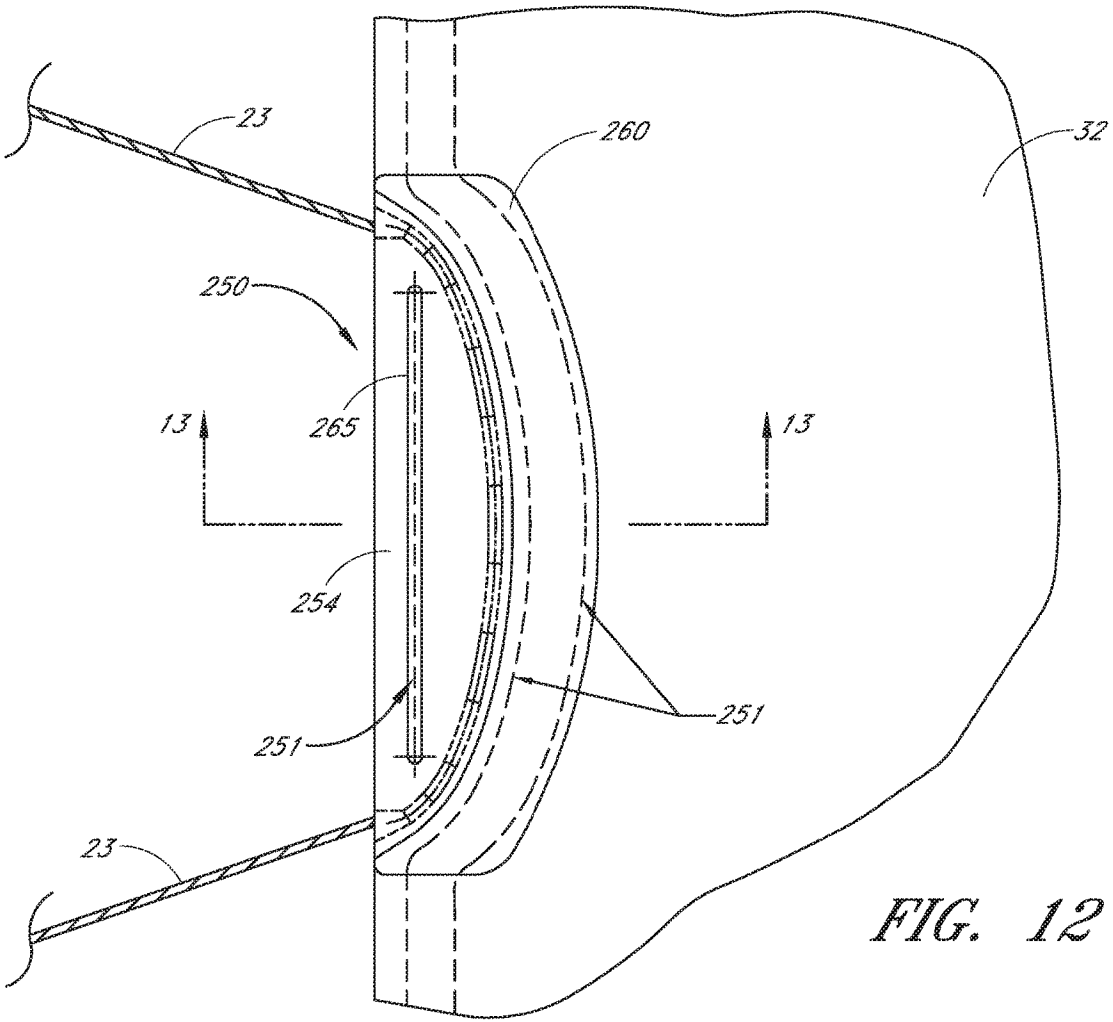
FIG. 12 is a top view of the lace guide of FIG. 10 mounted in a boot flap.
Figure 13:
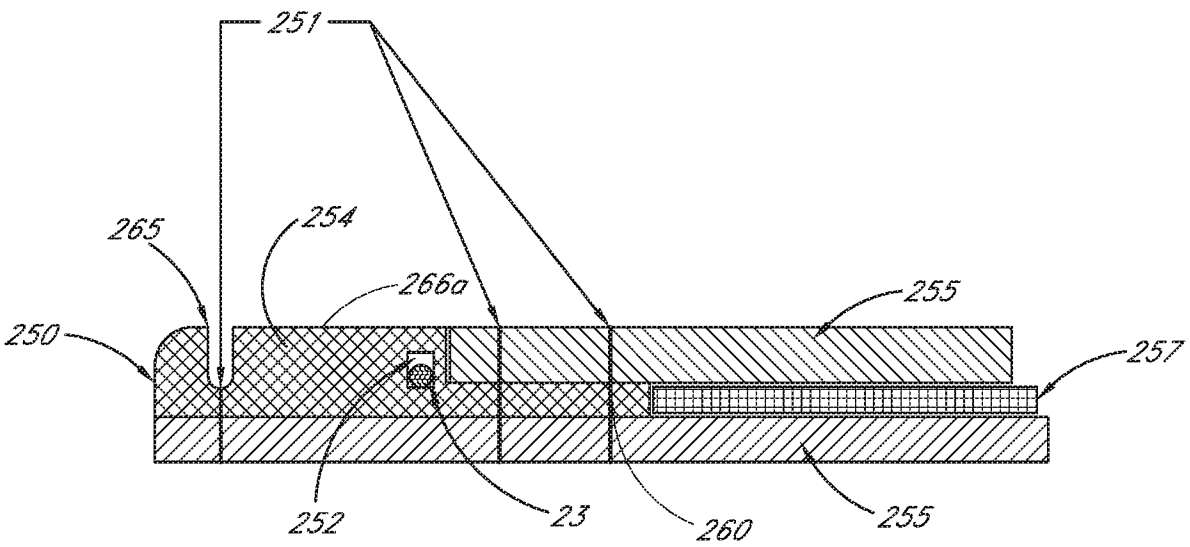
FIG. 13 is a cross-sectional view of the lace guide and boot flap along line 13-13 of FIG. 12.

With respect to FIGS. 12 and 13, the lace guide member 250 is mounted to the flaps 32, 34 by inserting the flange region 260 directly within the flaps 32, 34, such as within or between single or multiple layers 255 (FIG. 13) of material. The layers 255 may be filled with a filler material 257 to maintain a constant thickness in the flaps 32, 34.

The lace guide member 250 may be secured to the flaps 32, 34, for example, by stitching a thread through the flap 32, 34 and through the lace guide member 250 to form a stitch pattern 251. The thread is preferably stitched through the reduced thickness regions of the flange portion 260 and the elongate slot 265. Preferably, the flaps 32, 34 are cut so that the main portion 254 of the guide member 250 is exposed on the flap 32, 34 when the lace guide member 250 is mounted thereon.

With respect to FIG. 13, the upper surface 266*a* of the main portion of the guide member 250 is preferably maintained flush with the upper surface of the flaps 32, 34 to maintain a smooth and continuous appearance and to eliminate discontinuities on the flaps 32, 34. Advantageously, because the flange region 260 has a reduced thickness, the lace guide member 250 is configured to provide very little increase in the thickness of the flaps 32, 34, and preferably no increase in the thickness of the flaps. The lace guide member 250 therefore does not create any lumps in the flaps 32, 34 when the guide member 250 is mounted therein.

As mentioned, a series of upper and lower offset channels 264*a,b* extend through the lace guide member 250 and communicate with the lumen 252. The offset arrangement of the channels advantageously facilitates manufacturing of the guide members 250 as a single structure, such as by using shut-offs in an injection mold process.

The shape of the lumen may be approximately defined by an ellipse. In one embodiment, the ellipse has a major axis of about 0.970 inches and a minor axis of about 0.351 inches.

Figure 14:
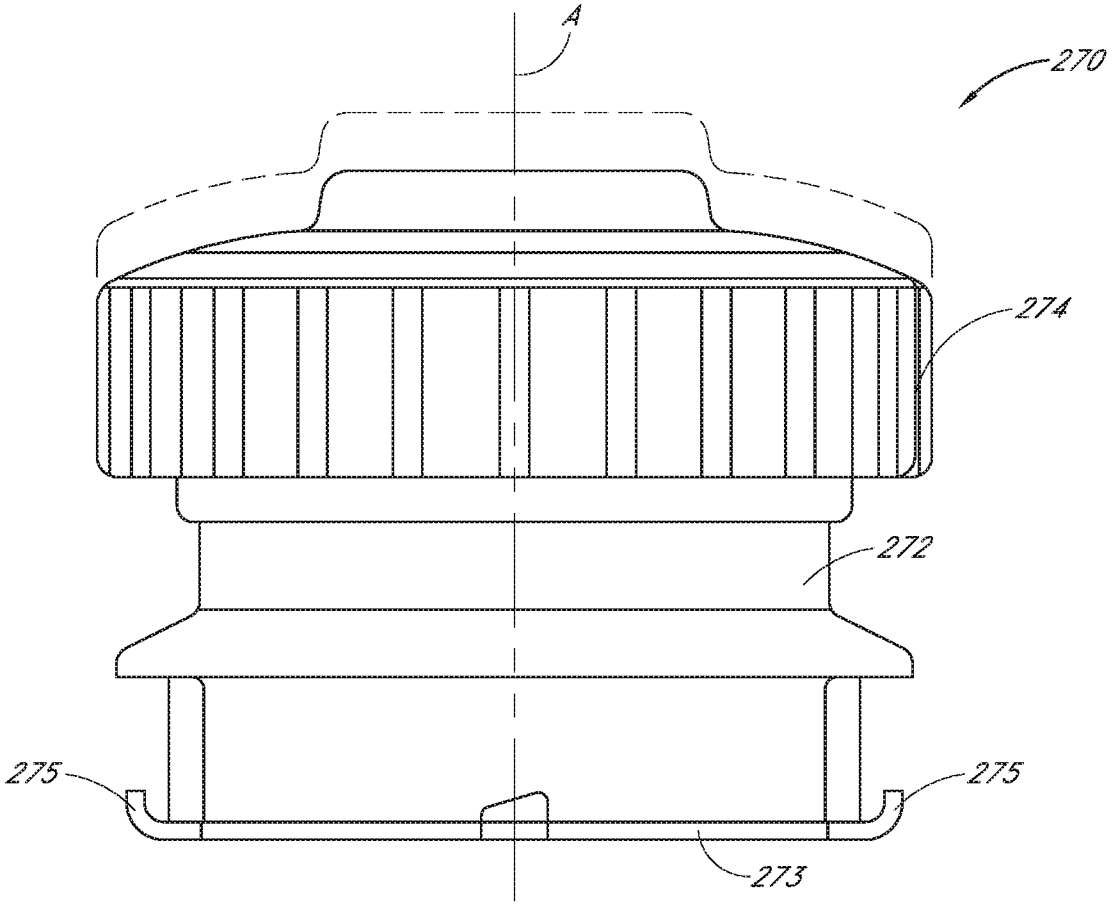
FIG. 14 is a side view of a second embodiment of the tightening mechanism.

FIG. 14 is a side view of an alternative tightening mechanism 270. The tightening mechanism 270 includes an outer housing 272 having a control mechanism, such as a rotatable knob 274, mechanically coupled thereto. The rotatable knob 274 is slideably movable along an axis A between two positions with respect to the outer housing 272. In a first, or engaged, position, the knob 274 is mechanically engaged with an internal gear mechanism located within the outer housing 272. In a second, or disengaged, position (shown in phantom) the knob is disposed upwardly with respect to the first position and is mechanically disengaged from the gear mechanism. The tightening mechanism 270 may be removably mounted to the front, back, top or sides of the boot.

The closure system includes a rotatable spool for receiving a lace. The spool is rotatable in a first direction to take up lace and a second direction to release lace. A knob is connected to the spool such that the spool can be rotated in the first direction to take up lace only in response to rotation of the knob. A releasable lock is provided for preventing rotation of the spool in the second direction. One convenient lock mechanism is released by pulling the knob axially away from the boot, thereby enabling the spool to rotate in the second direction to unwind lace. However, the spool rotates in the second direction only in response to traction on the lace. The spool is not rotatable in the second direction in response to rotation of the knob. This prevents tangling of the lace in or around the spool, which could occur if reverse rotation on the knob could cause the lace to loosen in the absence of a commensurate traction on the lace.

In the foregoing embodiments, the wearer must pull a sufficient length of cable from the spool to enable the wearer's foot to enter or exit the footwear. The resulting slack cable requires a number of turns of the reel to wind in before the boot begins to tighten. An optional feature in accordance with the present invention is the provision of a spring drive or bias within the spool that automatically winds in the slack cable, similar to the mechanism in a self biased automatically winding tape measure. The spring bias in the spool is generally not sufficiently strong to tighten the boot but is sufficient to wind in the slack. The wearer would then engage the knob and manually tighten the system to the desired tension.

The self winding spring may also be utilized to limit the amount of cable which can be accepted by the spool. This may be accomplished by calibrating the length of the spring so that following engagement of the knob and tightening of the boot, the knob can only be rotated a preset additional number of turns before the spring bottoms out and the knob is no longer able to be turned. This limits how much lace cable could be wound onto the spool. Without a limit such as this, if a cable is used which is too long, the wearer may accidentally wind in the lace cable until it jams tightly against the reel housing and cannot be pulled back out.

FIGS. 21-27 illustrate one embodiment of a lace winder 600 including a spring configured to automatically eliminate loose slack in the laces 23 by maintaining the laces 23 under tension. In the illustrated embodiments, the winder 600 generally comprises a spool 610 rotatably positioned within a housing member 620 and rotationally biased in a winding direction. The spool 610 is also generally coupled to a knob 622 for manually tightening the laces 23. Many features of the winder 600 of FIGS. 21-27 are substantially similar to the tightening mechanism 270 discussed above with reference to FIG. 14. However, in alternative embodiments, features of the spring-biased winder 600 can be applied to many other tightening mechanisms as desired.

Figure 21:
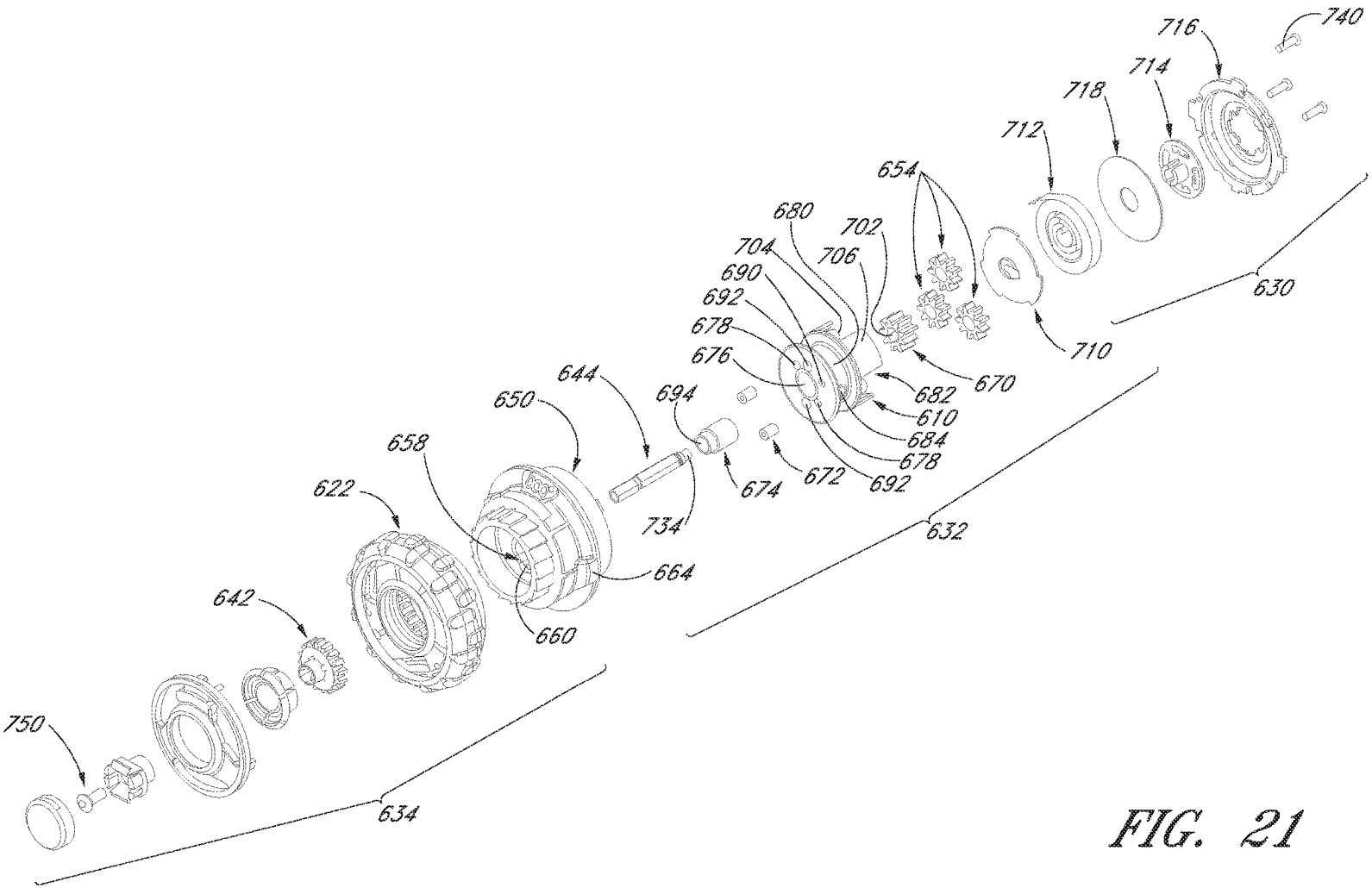
FIG. 21 is an exploded perspective view of an embodiment of a self-winding tightening mechanism.

FIG. 21 illustrates an exploded view of one embodiment of a lace winder 600. The embodiment of FIG. 21 illustrates a spring assembly 630, a spool assembly 632 and a knob assembly 634. The spool assembly 632 and the spring assembly 630 are generally configured to be assembled to one another and placed within a housing 640. The knob assembly 634 can then be assembled with the housing 640 to provide a self-winding lacing device 600.

The knob assembly 634 generally comprises a knob 622 and a drive gear 642 configured to rotationally couple the knob 622 to a drive shaft 644 which extends through substantially the entire winder 600. In alternative embodiments, the knob assembly 634 can include any of the other devices described above, or any other suitable one-way rotating device.

Figure 22:
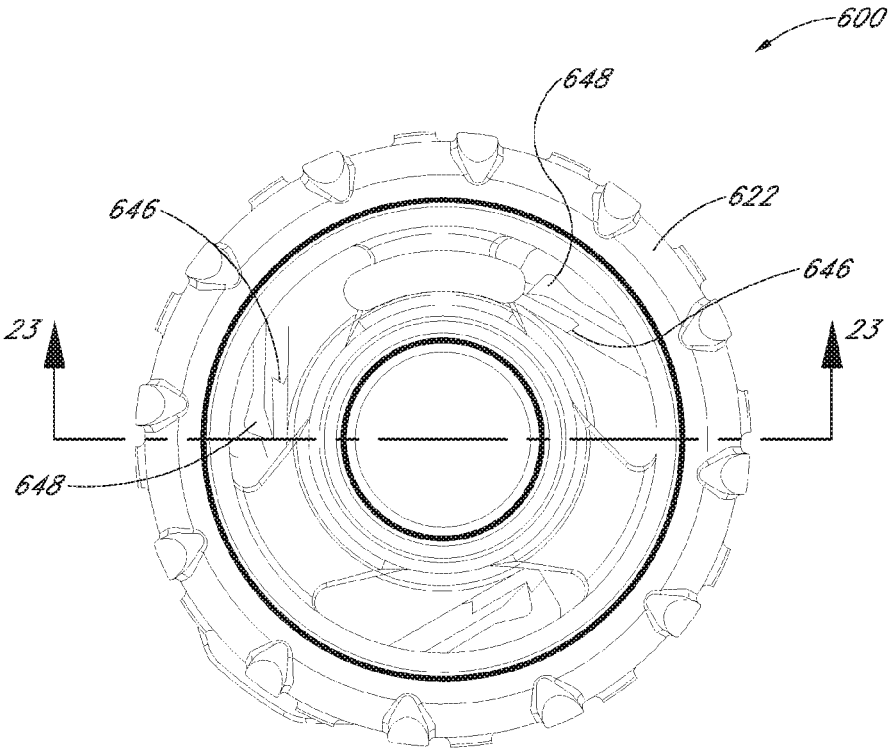
FIG. 22 is a top plan view of the mechanism of FIG. 21.

With reference to FIGS. 23-26, in some embodiments, the housing 640 generally comprises an upper section with a plurality of ratchet teeth 646 configured to engage pawls 648 in to the knob 622 (see FIG. 22). The housing 640 also includes a spool cavity 650 sized and configured to receive the spool assembly 632 and spring assembly 630 therein. A lower portion of the spool cavity 650 generally comprises a plurality of teeth forming a ring gear 652 configured to engage planetary gears 654 of the spool assembly 632.

A transverse surface 656 generally separates the upper portion of the housing 640 from the spool cavity 650. A central aperture 658 in the transverse surface allows the drive shaft 644 to extend from the knob 622, through the housing 640 and through the spool assembly 632. In some embodiments, set-screw apertures 660 and/or a winding pin aperture 662 can also extend through the housing 640 as will be further described below. The housing 640 also typically includes a pair of lace entry holes 664 through which laces can extend.

As discussed above, a gear train can be provided between the knob 622 and the spool 610 in order to allow a user to apply an torsional force to a spool 610 that is greater than the force applied to the knob. In the embodiment of FIGS. 21-25, such a gear train is provided in the form of an epicyclic gear set including a sun gear 670 and a plurality of planetary gears 654 attached to the spool 610, and a ring gear 650 on an internal surface of the housing 640. The illustrated epicyclic gear train will cause a clockwise rotation of the drive shaft 644 relative to the housing 640 to result in a clockwise rotation of the spool 610 relative to the housing 640, but at a much slower rate, and with a much increased torque. This provides a user with a substantial mechanical advantage in tightening footwear laces using the illustrated device. In the illustrated embodiment, the epicyclic gear train provides a gear ratio of 1:4. In alternative embodiments, other ratios can also be used as desired. For example, gear ratios of anywhere from 1:1 to 1:5 or more could be used in connection with a footwear lace tightening mechanism.

Figure 23:
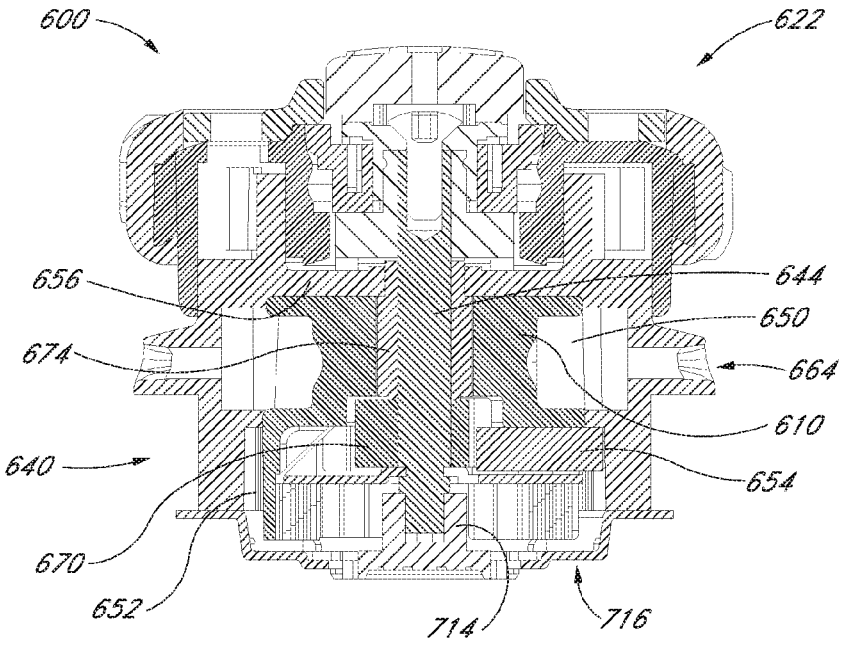
FIG. 23 is a section view of the mechanism of FIG. 22, taken through line A-A.
Figure 24:
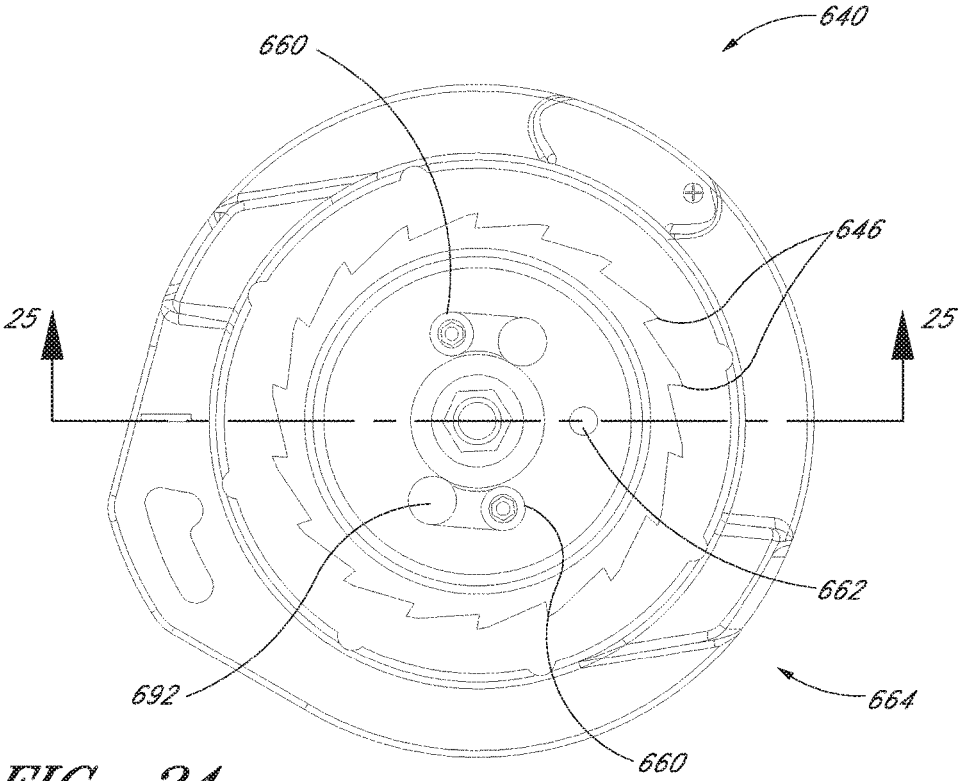
FIG. 24 is a top plan view of one embodiment of a portion of a self-winding tightening mechanism.
Figure 25:
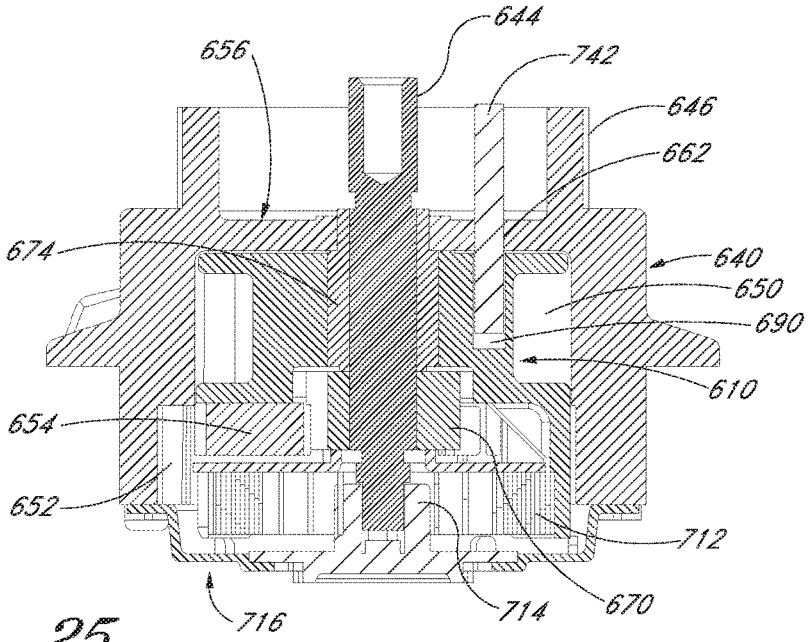
FIG. 25 is a section view of the mechanism of FIG. 24, taken through line B-B.
Figure 26:
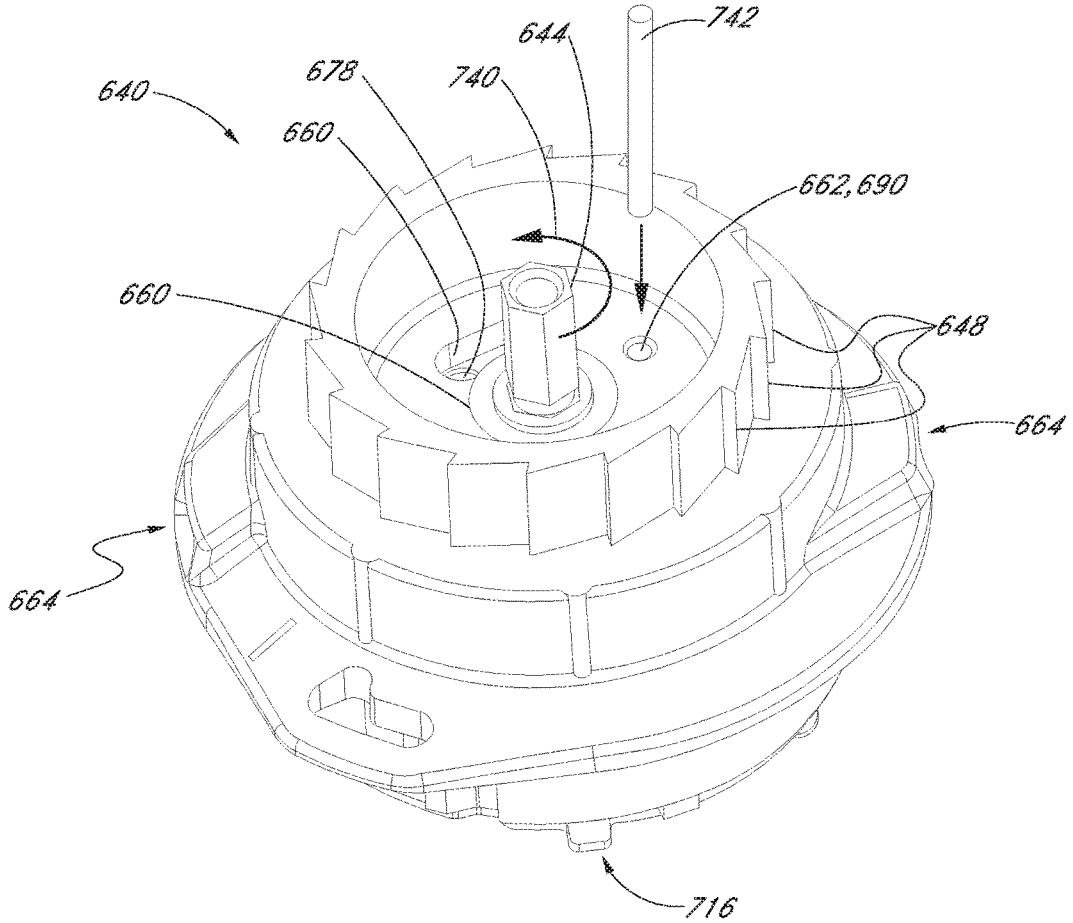
FIG. 26 is a perspective view of one embodiment of a portion of a self-winding tightening mechanism.

With reference to FIGS. 21, 23 and 25, embodiments of a spool assembly 632 will now be described. The spool assembly 632 generally comprises a spool body 610, a drive shaft 644, a sun gear 670, a plurality of planetary gears 654, a pair of set screws 672 and a bushing 674. The spool body 610 generally comprises a central aperture 676, a pair of set screw holes 678, a winding section 680 and a transmission section 682. The winding section 680 comprises a pair of lace receiving holes 684 for receiving lace ends which can be secured to the spool using set screws 672 or other means as described in previous embodiments. The lace receiving holes 684 are generally configured to be alignable with the lace entry holes 664 of the housing 640. In some embodiments, the spool body 610 also comprises a winding pin hole 690 configured to receive a winding pin for use in assembling the winder 600 as will be further described below. In some embodiments, the spool 610 can also include sight holes 692 to allow a user to visually verify that a lace 23 has been inserted a sufficient distance into the spool 610 without the need for markings on the lace 23.

The bushing 674 comprises an outer diameter that is slightly smaller than the inner diameter of the spool central aperture 676. The bushing 674 also comprises an inner aperture 694 configured to engage the drive shaft 644 such that the bushing 674 remains rotationally stationary relative to the drive shaft throughout operation of the device. In the illustrated embodiment, the drive shaft 644 comprises an hexagonal shape, and the bushing 674 comprises a corresponding hexagonal shape. In the illustrated embodiment, the sun gear 670 also comprises an hexagonal aperture 702 configured to rotationally couple the sun gear 670 to the drive shaft 644. Alternatively or in addition, the sun gear 670 and/or the bushing 674 can be secured to the drive shaft 644 by a press fit, keys, set screws, adhesives, or other suitable means. In other embodiments, the drive shaft 644, bushing 674 and/or sun gear 670 can comprise other cross-sectional shapes for rotationally coupling the elements.

In an assembled condition, the bushing 674 is positioned within the spool aperture 676, the drive shaft 644 extends through the central aperture 694 of the bushing 674 and through the sun gear 670. In some embodiments, the planetary gears 654 can be secured to axles 704 rigidly mounted to the transmission section 682 of the spool 610. The planetary gears 654, when assembled on the spool 610, generally extend radially outwards from the perimeter of the spool 610 such that they may engage the ring gear 652 in the housing 640. In some embodiments, the spool transmission section 682 comprises walls 706 with apertures located to allow the planetary gears 654 to extend therethrough. If desired, a plate 710 can be positioned between the planetary gears 654 and the spring assembly 630 in order to prevent interference between the moving parts.

The spring assembly 630 generally comprises a coil spring 712, a spring boss 714, and a backing plate 716. In some embodiments, a washer/plate 718 can also be provided within the spring assembly 630 between the coil spring 718 and the spring boss 714 in order to prevent the spring 712 from undesirably hanging up on any protrusions of the spring boss 714.

Figure 27:
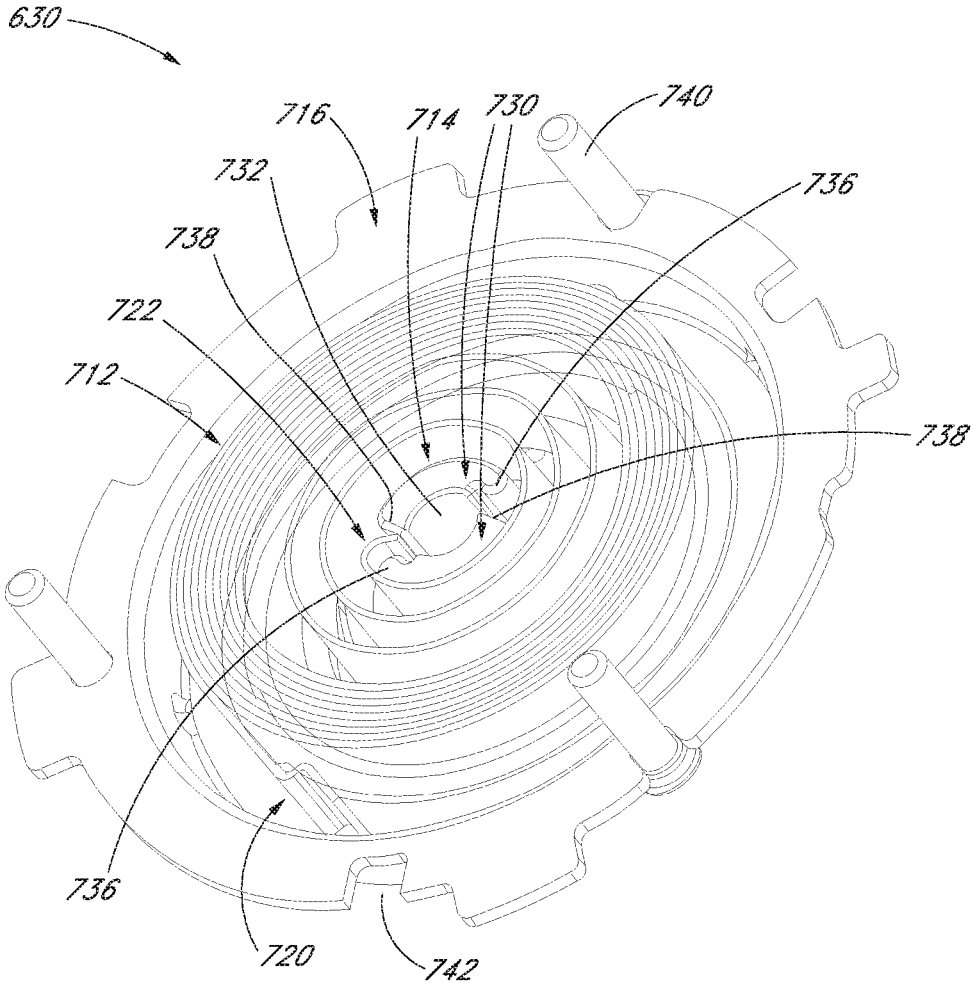
FIG. 27 is a perspective view of an embodiment of a spring assembly for use in some embodiments of a self-winding tightening mechanism.

With particular reference to FIG. 27, in some embodiments, the spring boss 714 is rigidly joined to the backplate 716 and the torsional spring 712 is configured to engage the spring boss 714 in at least one rotational direction. The coil spring 712 generally comprises an outer end 720 located at a periphery of the spring 712, and an inner end 722 at a central portion of the spring 712. The outer end 720 is generally configured to engage a portion of the spool 610. In the illustrated embodiment, the outer end 720 comprises a necked-down portion to engage an aperture in a portion of the spool 610. In alternative embodiments, the outer end 720 of the spring 712 can be secured to the spool by welds, mechanical fasteners, adhesives or any other desired method. The inner end 722 of the spring 712 comprises a hooked portion configured to engage the spring boss 714.

The spring boss 714 comprises a pair of posts 730 extending upwards from the backplate 716. The posts 730 are generally crescent shaped and configured to engage the hooked interior end 722 of the spring 712 in only one rotational direction. Each post 730 comprises a curved end 736 configured to receive the hooked spring end 722 as the spring rotates counter-clockwise relative to the backplate 716. Each post 730 also comprises a flat end 738 configured to deflect the hooked spring end 722 as the spring 712 rotates clockwise relative to the backplate 716. In the illustrated embodiment, the posts 714 and spring 712 are oriented such that a clockwise rotation of the spring 712 relative to the spring boss 714 and backplate 716 will allow the spring to "skip" from one post 714 to the other without resisting such rotation. On the other hand, a counter-clockwise rotation of the spring 712 will cause the hooked end 722 to engage one of the posts 714, thereby holding the interior end 722 of the spring stationary relative to the outer portions of the spring 712. Continued rotation of the outer portions of the spring will deflect the spring, thereby biasing it in the clockwise winding direction.

The space 732 between the posts 730 of the spring boss 714 is generally sized and configured to receive the distal end of the drive shaft, which in some embodiments as shown in FIG. 21, can comprises a circular end 734 configured to freely rotate in the spring boss space 732. In the embodiment illustrated in FIG. 21, the spring boss 714 and the backplate 716 are shown as separately manufactured elements which are later assembled. In alternative embodiments, the backplate 716 and spring boss 714 can be integrally formed as a unitary structure and/or as portions of another structure.

Embodiments of methods for assembling a self-coiling lace winder 600 will now be described with reference to FIGS. 21-26. In one embodiment, the sun and planetary gears 670, 654 are assembled onto the transmission portion 682 of the spool 610, and the bushing 674 and drive shaft 644 are inserted through the aperture 676 in the spool. The spring assembly 630 is assembled by attaching the spring boss 714 to the back plate 716 by any suitable method and placing the spring 712 on the spring boss 714. The spool assembly 632 can then be joined to the spring assembly 630 by attaching the outer end 720 of the spring 712 to the spool 610. In some embodiments, the spring 712 may need to be pre-wound tightly in order to fit within the spool walls 706. The spool assembly 632 and the spring assembly 630 can then be placed within the housing member 640. In some embodiments, the backplate 716 is secured to the housing member 640 by screws 740 or other suitable fasteners such as rivets, welds, adhesives, etc. In some embodiments, the backplate 716 can include notches 742 configured to cooperate with extensions or recesses in the housing member 640 in order to prevent the entirety of the torsional spring load from bearing against the screws 740.

In some embodiments, once the spool assembly 632 and the spring assembly 630 are assembled and placed in the housing 640, the spring 712 can be tensioned prior to attaching the laces. In one embodiment, with reference to FIG. 26, the spring 712 is tensioned by holding the housing 640 stationary and rotating the drive shaft 644 in an unwinding direction 740, thereby increasing the deflection in the spring 712 and correspondingly increasing a biasing force of the spring. Once a desired degree of deflection/spring bias is reached, a winding pin 742 can be inserted through the winding pin aperture 662 in the housing 640 and the winding pin hole 690 in the spool 610.

In one embodiment, the winding pin hole 690 in the spool is aligned relative to the winding pin aperture 662 in the housing such that the set screw holes 678 and the lacing sight holes 692 in the spool 610 will be aligned with corresponding apertures 660 in the housing 640 when the winding pin 742 is inserted (also see FIG. 25). The spool 610 and housing 640 are also preferably configured such that the lace receiving holes 684 of the spool 610 are aligned with the lace entry holes 664 of the housing 640 when the winding pin hole 690 and aperture 662 are aligned. In alternative embodiments, the winding pin hole 690 and aperture 662 can be omitted, and the spool can be held in place relative to the housing by some other means, such as by placing a winding pin 742 can be inserted through a set screw hole and aperture or a sight hole/aperture.

Once the spring 712 has been tensioned and a winding pin 742 has been inserted, the laces 23 can be installed in the spool using any suitable means provided. In the embodiment illustrated in the embodiments of FIGS. 21-26, the spool 610 is configured to secure the laces 23 therein with set screws 672. The laces can be inserted through the lace entry holes 664 in the housing 640 and through the lace receiving holes 684 in the spool 610 until a user sees the end of the lace in the appropriate sight hole 692. Once the user visually verifies that the lace is inserted a sufficient distance, the set screws 672 can be tightened, thereby securing the laces in the spool.

Once the laces 23 are secured, the winding pin 742 can be removed, thereby allowing the spring to wind up any slack in the laces. The knob 622 can then be attached to the housing 640, such as by securing a screw 750 to the drive shaft 644. A user can then tighten the laces 23 using the knob 622 as desired.

In alternative embodiments, it may be desirable to pre-tension the spring 712 after installing the laces 23 in the spool 610. For example, if an end user desires to change the laces in his/her footwear, the old laces 23 can be removed by removing the knob 622, loosening the set screws 672 and pulling out the laces 23. New laces can then be inserted through the lace entry holes 684 and secured to the spool with the set screws 672, and re-install the knob 622 as described above. In order to tension the spring 712, a user can then simply wind the lace by rotating the knob 622 in the winding direction until the laces are fully tightened (typically without a foot in the footwear). The spring will not resist such forward winding, since the spring boss 714 will allow the spring 712 to freely rotate in the forward direction as described above. In one preferred embodiment, the user tightens the laces as much as possible without a foot in the footwear. Once the laces are fully tightened, the knob can be released, such as by pulling outwards on the knob as described above, and the laces can be pulled out. As the spool rotates in an unwinding direction, the hooked inner end 722 of the spring 712 engages the spring boss 714, and the spring deflects, thereby again biasing the spool 610 in a winding direction.

In an alternative embodiment, a lace winder can be particularly useful for lightweight running shoes which do not require the laces to be very tight. Some existing lightweight running shoes employ elastic laces, however such systems are difficult, if not impossible, to lock once a desired lace tension is achieved. Thus, an embodiment of a lightweight spring-biased automatically winding lacing device can be provided by eliminating the knob assembly 634, gears 654, 670 and other components associated with the manual tightening mechanism. In such an embodiment, the spool 610 can be greatly simplified by eliminating the transmission section 682, the housing 640 can be substantially reduced in size and complexity by eliminating the ring gear section 652 and the ratchet teeth 646. A simplified spool can then be directly connected to a spring assembly 630, and a simple locking mechanism can be provided to prevent unwinding of the laces during walking or running.

Therefore, a right reel and a left reel can be configured for opposite directional rotation to allow a user to more naturally grip and manipulate the reel. It is currently believed that an overhand motion, e.g. a clockwise rotation with a person's right hand, is a more natural motion and can provide a greater torque to tighten the reel. Therefore, by configuring a right and left reel for opposite rotation, each reel is configured to be tightened with an overhand motion by tightening the right reel with the right hand, and tightening the left reel with the left hand.

Alternatively, the guide members 490 may comprise a lace guide defining an open channel having, for example, a semicircular, "C" shaped, or "U" shaped cross section. The guide member 490 is preferably mounted on the boot or shoe such that the channel opening faces away from the midline of the boot, so that a lace under tension will be retained therein. One or more retention strips, stitches or flaps may be provided for "closing" the channel opening to prevent the lace from escaping when tension on the lace is released. The axial length of the channel can be preformed in a generally U configuration. Moreover, practically any axial configuration of the guide member 490 is possible, and is mainly dictated by fashion, and only partly by function.

Several guide members 490 may be molded as a single piece, such as several lace guides 491 molded to a common backing support strip which can be adhered or stitched to the shoe. Thus, a right lace guide member and a left lace guide member can be secured to opposing portions of the top or sides of the shoe to provide a right set of guide channels 492 and a left set of guide channels 492. When referring to "right" and "left" guide members, this should not be construed as suggesting a mounting location of the retainer strips. For example, the guide members 490 can be located on a single side of the shoe, such as in a shoe having a vamp that extends generally from one side of the shoe, across the midline of the foot, and is secured by laces on the opposing side of the shoe. In this type of shoe, the guide members 490 are actually disposed vertically with respect to one another, and hence, a left and right guide member merely refers to the fact that the guide members 490 have openings that face one another, as illustrated in FIG. 16.

Figure 15:
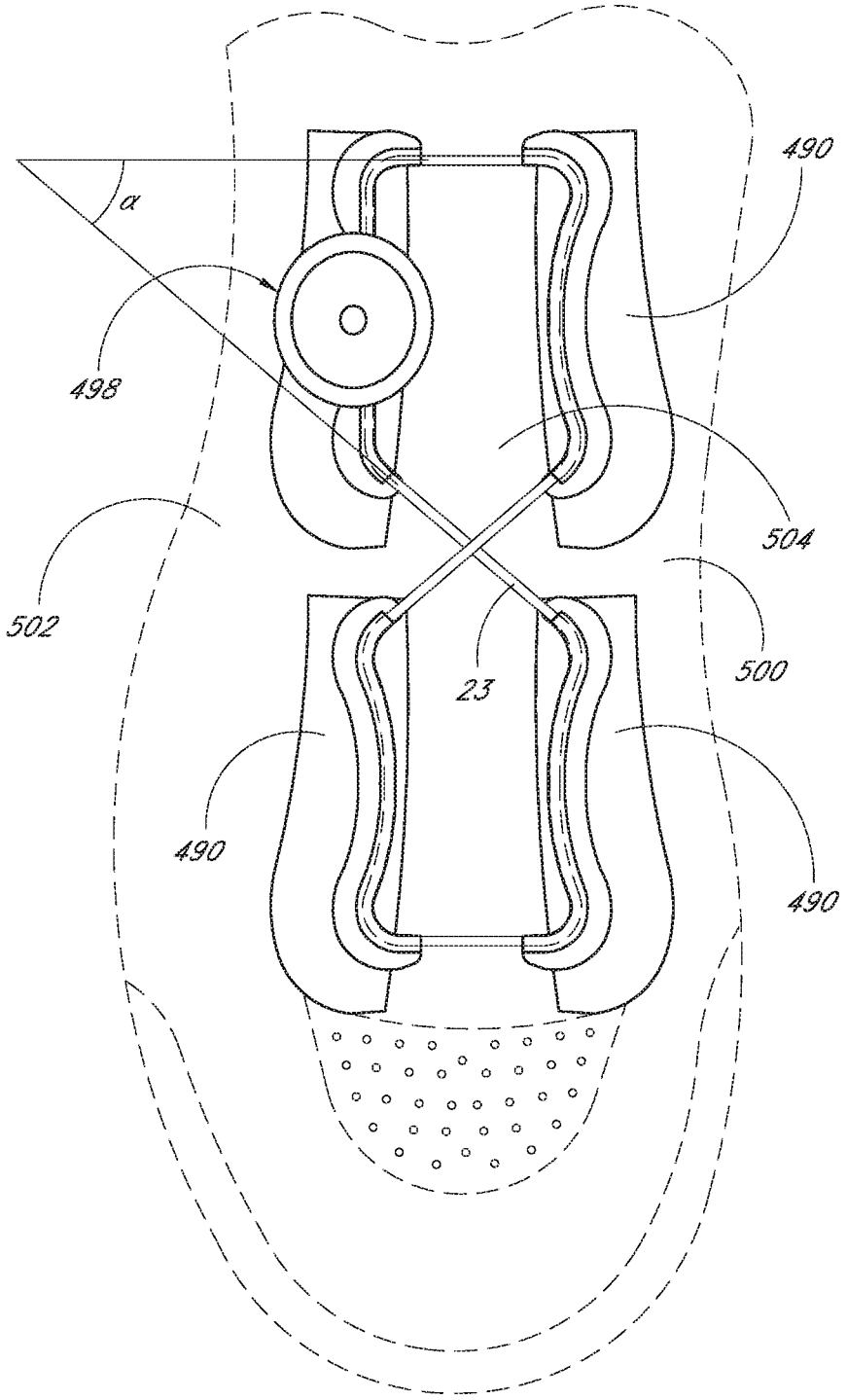
FIG. 15 is a top plan view showing one embodiment of the footwear lacing system of the present invention attached to a shoe that is shown in phantom.
Figure 16:
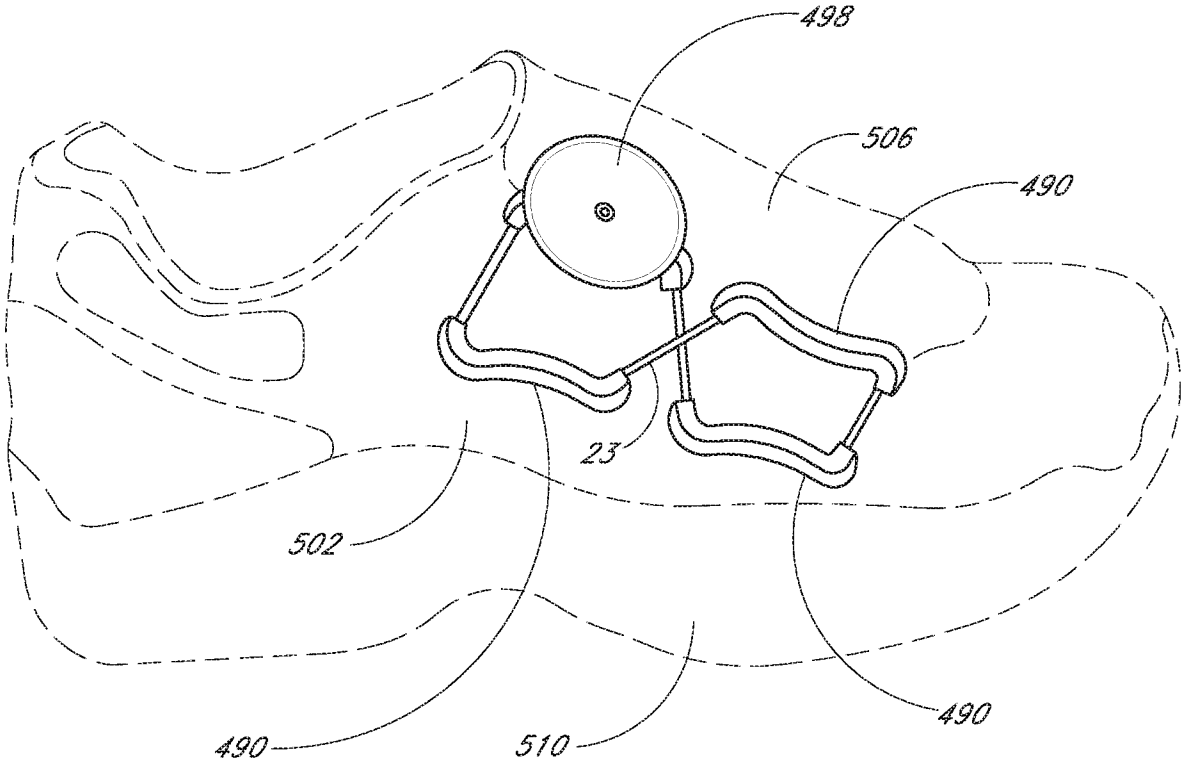
FIG. 16 is a side elevational view of a shoe having another embodiment of the footwear lacing system of the present invention attached thereto.

FIGS. 15 and 16 illustrate exemplary embodiments and mounting configurations of the present footwear-lacing system. For example, a plurality of guide members 490 can be located in lieu of traditional shoe eyelet strips, as described above. Typically, the guide members 490 are installed as opposing pairs, with the guide members formed integrally with the reel 498 typically comprising one of the guide members. The term "reel" will be used hereinafter to refer to the various embodiments including the complete structure of the outer housing and its internal components, unless otherwise specified. Thus, in some embodiments, there are 2, 4, 6, or 8 or more cooperating guide members 490 installed to define a lace path. Moreover, a non-paired guide member 490 can be installed, such as toward the toe of the shoe and positioned transverse to the midline and having its lace openings directed toward the heel of the shoe. This configuration, in addition to applying tightening forces between the lateral and medial sides of the shoe, would also apply a lace tension force along the midline of the shoe. Of course, other numbers and arrangements of guide members can be provided and this application and its claims should not be limited to only configurations utilizing opposing or even paired guide members.

FIG. 15 shows an embodiment in which the reel 498 is located on the lateral quarter panel of the shoe. Of course, the reel 498 can be located practically anywhere on the shoe and only some of the preferred locations are described herein. Moreover, the illustrated reel can be any reel embodiment suitable for practicing the present invention, and should not be limited to one particular embodiment. The illustrated embodiment provides three guide members 490 spaced along the gap between the medial quarter panel 500 and lateral quarter panels 502 of the shoe and thus creates a lace path that zigzags across the tongue 504. While the reel 498 is illustrated as being disposed on the lateral quarter 502 panel near the ankle, it may also be disposed on the medial quarter panel 500 of the shoe. In some embodiments, the reel 498 is disposed on the same quarter panel of each shoe, for example, the reel can be mounted on the lateral quarter panel 502 of each shoe, or in alternative embodiments, the reel can be disposed on the lateral quarter panel 502 of one shoe, and on the medial quarter panel 500 of the other shoe.

Notably, this particular embodiment has a lace path that forms an acute angle $\alpha$ as it enters the outer housing. As discussed above, a lace guide member can be integrally formed into the outer housing to direct the lace to approach and interact with the reel from substantially diametrical directions. Thus, the summation of tension forces applied to the reel are substantially cancelled.

Figure 17:
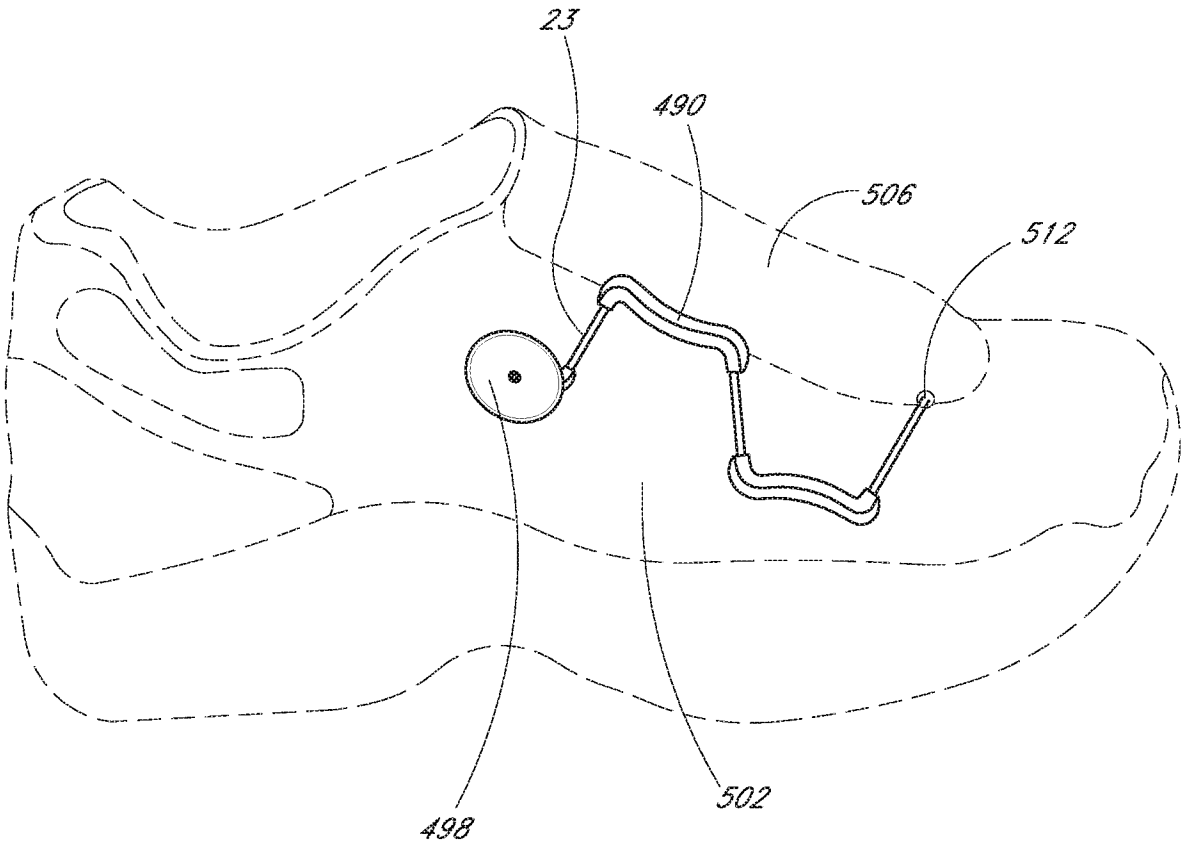
FIG. 17 is a side elevational view of a shoe having yet another embodiment of the footwear lacing system of the present invention attached thereto.

FIG. 17 shows an alternative embodiment of a shoe incorporating a vamp closure structure. In this particular embodiment, the reel 498 can be disposed on the vamp 506, as illustrated, or can be disposed on the lateral quarter panel, or even in the heel, as disclosed above. Similar to FIG. 15, the reel illustrated in this FIG. 16 should not be limited to one specific embodiment, but should be understood to be any suitable embodiment of a reel for use with the disclosed invention. In the illustrated embodiment, three lace guides 490 are affixed to the shoe; two on the lateral quarter panel 502, and one on the vamp 506 cooperating with the guide members integrally formed with the reel 498 to define a lace path between the lateral quarter panel 502 and the vamp 506.

Those of ordinary skill will appreciate that the guide members can be spaced appropriately to result in various tightening strategies.

For example, the opposing guide members 490 can be spaced a greater distance apart to allow a greater range of tightening. More specifically, by further separating the opposing guide members 490, there is a greater distance that can be used to effectuate tightening before the guide members 490 bottom out. This embodiment offers the additional advantage of extending the lace 23 over a substantially planar portion of the shoe, rather than across a portion of the shoe having a convex curvature thereto.

FIG. 17 illustrates an alternative arrangement of a shoe incorporating a vamp closing structure and having a reel and a non-looping lace. In this particular embodiment, an open ended lace can be attached directly to a portion of the shoe. As illustrated, a reel 498 is mounted on the lateral quarter panel 502 of the shoe. The shoe has one or more lace guides 490 strategically positioned thereon. As illustrated, one lace guide 490 is mounted on the vamp 506 while a second lace guide 498 is mounted on the lateral quarter panel 502. A lace has one end connected to a spool within the reel 498 and extends from the reel 498, through the lace guides 490 and is attached directly to the shoe by any suitable connection 512. One suitable location for attaching the lace is on the vamp toward the toe for those embodiments in which the reel 498 is mounted on the lateral quarter panel 502.

The connection 512 may be a permanent connection or may be releasable to allow the lace to be removed and replaced as necessary. The connection is preferably a suitable releasable mechanical connection, such as a clip, clamp, or screw, for example. Other types of mechanical connections, adhesive bonding, or chemical bonding may also be used to attach a lace end to the shoe.

While the illustrated embodiment shows the reel 498 attached to the lateral quarter panel 502, it should be apparent that the reel 498 could readily be attached to the vamp 506 and still provide the beneficial features disclosed herein. Additionally, the lace could optionally be attached to the shoe on the lateral quarter panel 502 rather than the vamp 506. The reel 498 and lace could be attached to a common portion of the shoe, or may be attached to different portions of the shoe, as illustrated. In any case, as the lace is tightened around the spool, the lace tension draws the guide members toward each other and tightens the footwear around a wearer's foot.

A shoe is typically curved across the midline to accommodate the dorsal anatomy of a human foot. Therefore, in an embodiment in which the laces zigzag across the midline of the shoe, the further the lace guides 490 are spaced, the closer the laces 23 are to the sole 510 of the shoe. Consequently, as the laces 23 tighten, a straight line between the lace guides 490 is obstructed by the midline of the shoe, which can result in a substantial pressure to the tongue of the shoe and further result in discomfort to the wearer and increased chaffing and wearing of the tongue. Therefore, by locating the laces 23 across a substantially flat surface on either the lateral or medial portion of the shoe, as illustrated, the laces 23 can be increasingly tightened without imparting pressure to other portions of the shoe.

It is contemplated that some embodiments of the lacing system 22 discussed herein will be incorporated into athletic footwear and other sports gear that is prone to impact. Such examples include bicycle shoes, ski or snowboard boots, and protective athletic equipment, among others. Accordingly, it is preferable to protect the reel from inadvertent releasing of the spool and lace by impact with external objects.

Figure 18:
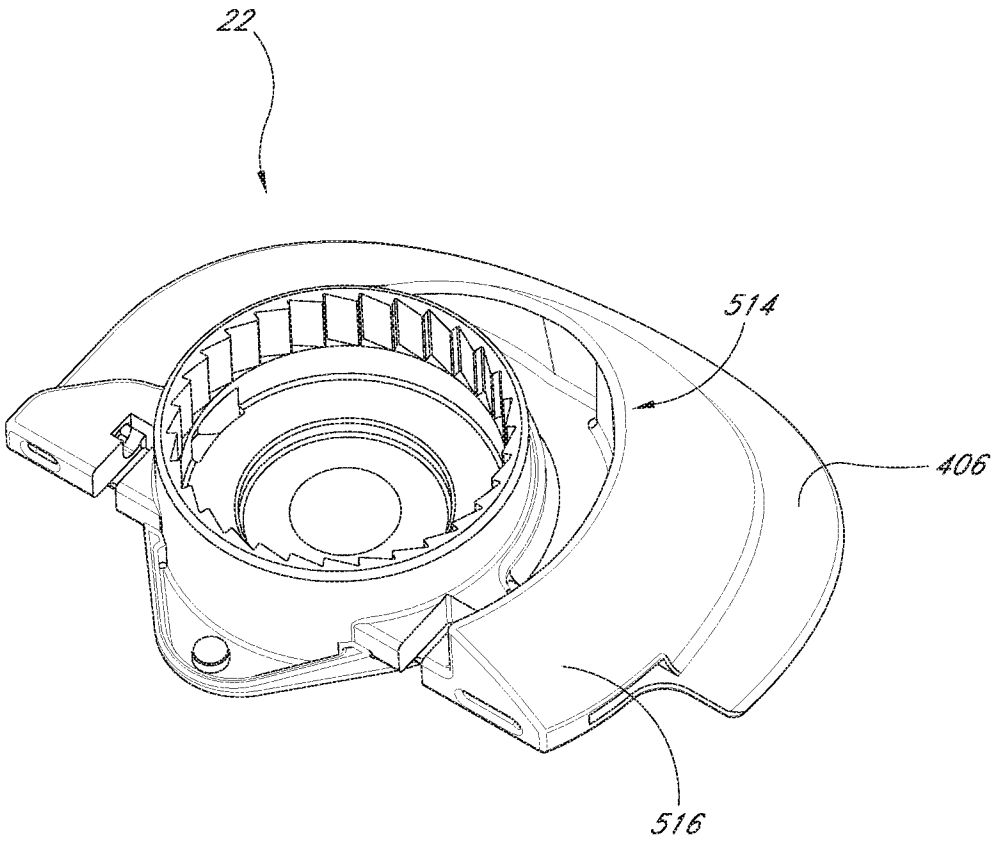
FIG. 18 is a perspective view of an embodiment of a lacing system having a protective element.
Figure 19:
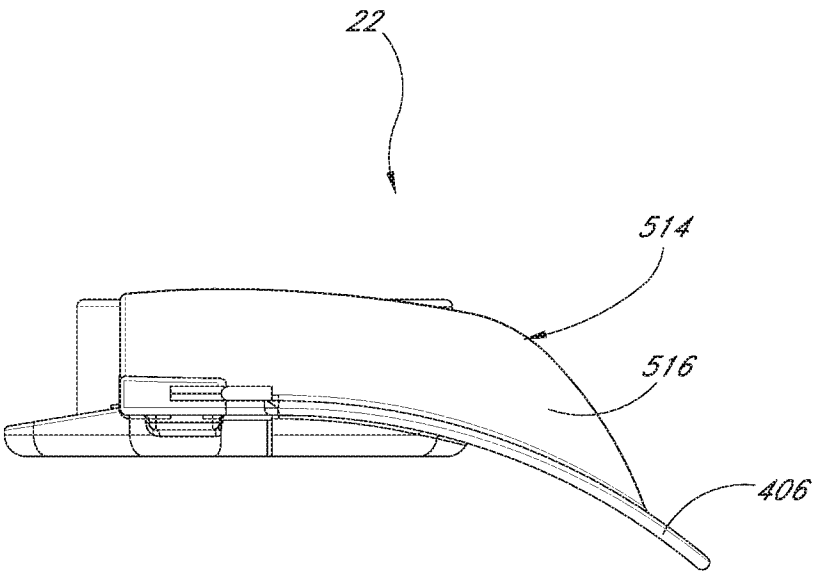
FIG. 19 is a side elevational view of the lacing system of FIG. 18 showing the protective element.

FIGS. 18 and 19 illustrate a lacing system 22 further having a protective element to protect the reel from impact from external objects. In one embodiment, the protective element is a shield 514 comprised of one or more raised ridges 516 or ramps configured to extend away from the mounting flange 406 a distance sufficiently high to protect the otherwise exposed reel. In the illustrated embodiment, the shield 514 is configured to slope toward the reel thus presenting an oblique surface to any objects it may contact to deflect the objects away from the reel. The shield 514 is positioned around the reel circumferentially and slopes radially toward the reel and may encircle the reel, or may be positioned around half the reel, a quarter of the reel, or any suitable portion or portions of the reel.

The shield 514 may be integrally formed with the mounting flange 406, such as during molding, or may be formed as a separate piece and subsequently attached to the lacing system 22 such as by adhesives or other suitable bonding techniques. It is preferable that the shield 514 is formed of a material exhibiting a sufficient hardness to withstand repeated impacts without plastically deforming or showing undue signs of wear.

Figure 20:
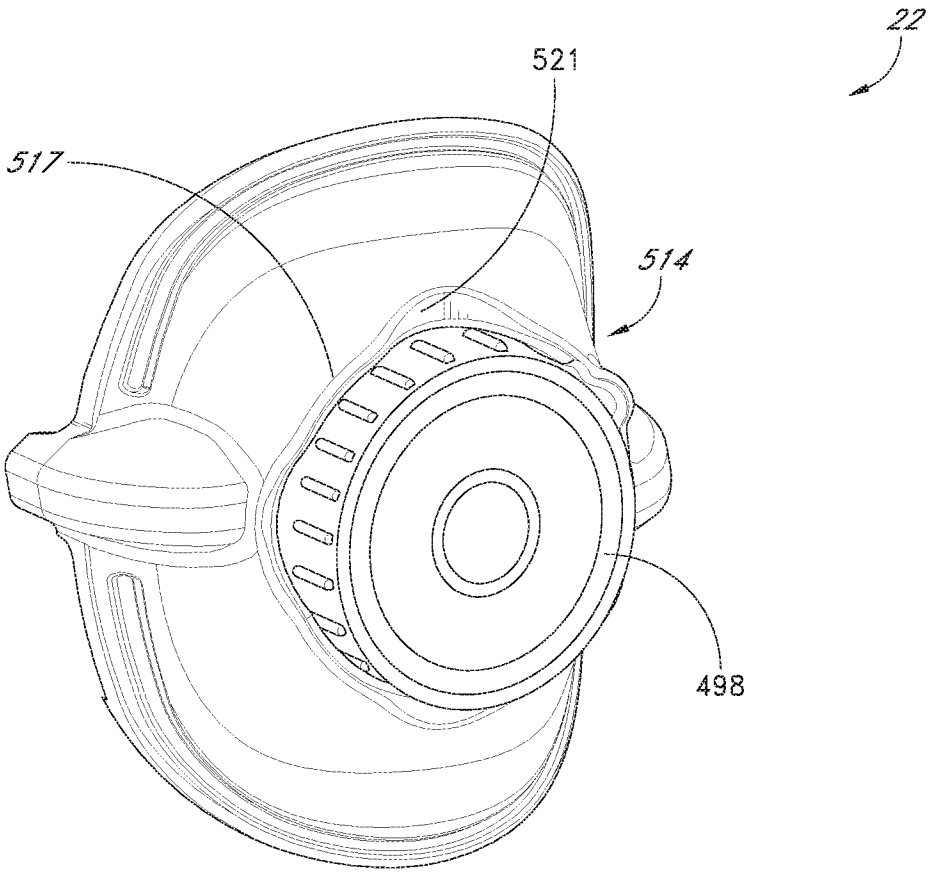
FIG. 20 illustrates a perspective view of an embodiment of a lacing system having an alternative protective element.

Another embodiment of a protective element is shown in FIG. 20. In this embodiment, a shield 514 is in the form of a raised lip 517 that encircles a portion of the circumference of the knob (not shown). The lip 517 can be of sufficient height to exceed the top of the knob, or can extend to just below the height of the knob to allow a user to still grasp the knob above the lip 517, or the lip 517 can be formed with varying heights. The lip 517 is preferably designed to withstand impact from various objects to thereby protect the knob from being inadvertently rotated and/or displaced axially.

The lip 517 can be integrally molded with the mounting flange, or can be a separate piece. In addition, the lip 517 can take on various shapes and dimensions to satisfy aesthetic tastes while still providing the protective function it has been designed for. For example, it can be formed with various draft angles, heights, bottom fillets, of varying materials and the like. In the illustrated embodiment, the lip 517 extends substantially around the entire circumference of the knob 498, except at holds 521 where the lip 517 recedes sufficiently to allow a user to grasp a large portion of the knob's height to be able to displace the knob axially by lifting it away from the housing. The illustrated embodiment additionally shows that the lip 517 extends outward to protect a substantial portion of the knob's height. While the lip 517 is illustrated as extending around a particular portion of the knob's circumference, it can of course extend around more or less of the knob's circumference. Certain preferred embodiments integrate a continuous shield 514 extending around between a quarter and a half of the knob circumference, while other embodiments incorporate a shield 514 comprising one or more discrete portions that combine to cover any appropriate range about the circumference of the knob. Of course, other protective elements or shields 514 could be incorporated to protect the reel, such as a protective covering or cap to cover the reel, a cage structure that fits over the reel, and the like.

Figure 28:
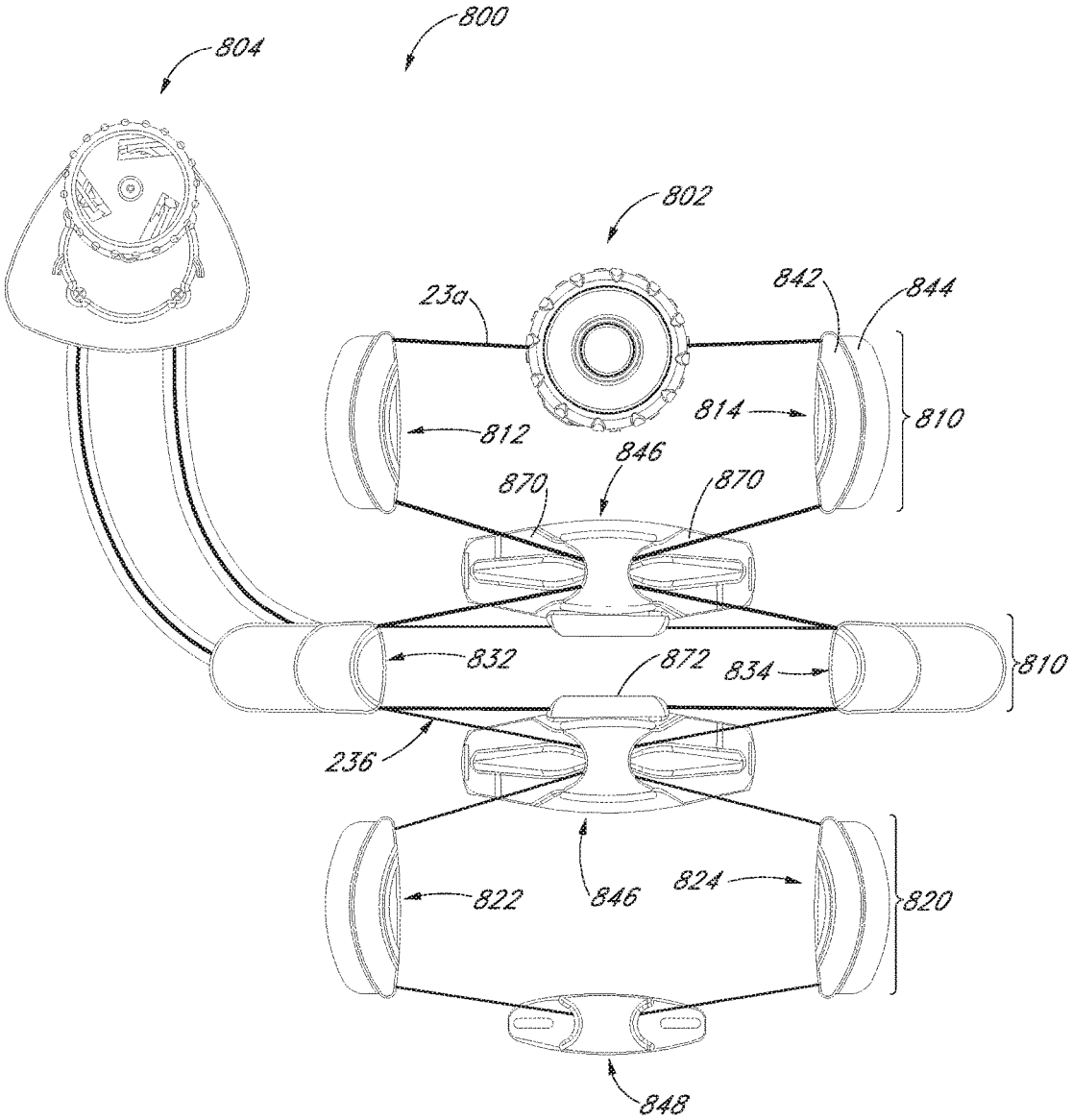
FIG. 28 is a schematic plan view illustration of one embodiment of a multi-zone lacing system.
Figure 30A:
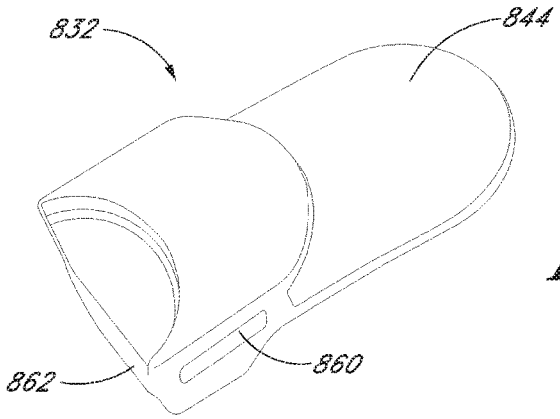
FIG. 30A-D are perspective, end elevation, top plan and side elevation views of one embodiment of a double-deck pass-through lace guide for use in embodiments of a multi-zone lacing system.
Figure 30B:
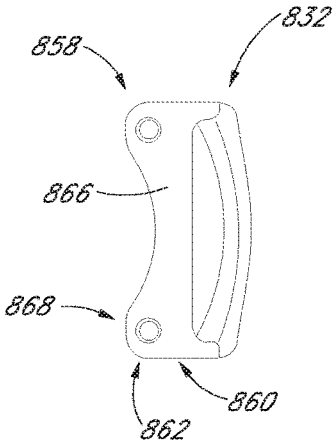
Figure 30C:
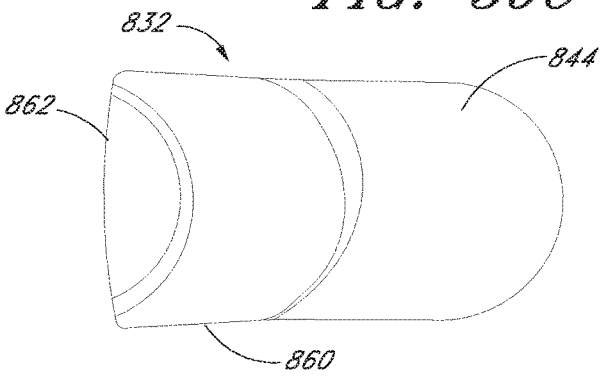
Figure 30D:
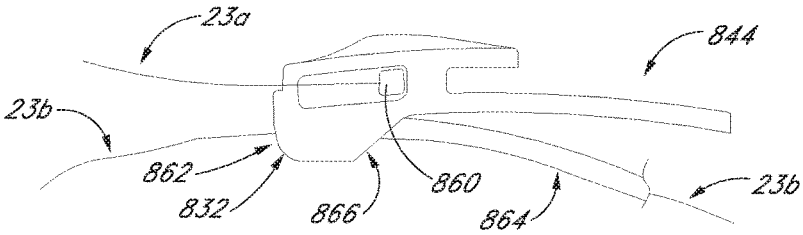

FIGS. 28-30D illustrate an embodiment of an alternative lacing arrangement which is generally configured to provide a plurality of lace tightening zones for an item of footwear. Such a multi-zone lacing system can provide substantial benefits by allowing a user to independently tighten various different sections of a footwear item to various different tensions. For example, in many cases, it may be desirable to tighten a toe portion more than an upper portion. In other cases, a user may desire the opposite, a tight upper and a looser toe section. However, in either case, users typically want a strong heel-hold-down force at an ankle portion of the footwear. Thus, in addition to providing multiple independent lacing zones, the systems illustrated in FIGS. 28-30 are also advantageously arranged to hold the ankle section of a footwear item under the tension of the tighter of the two laces.

FIG. 28 is a schematic illustration of one embodiment of multi-zone lacing system 800. The system of FIG. 28 includes first 802 and second 804 lace tightening mechanisms arranged to tighten first 23*a* and second 23*b* laces. In some embodiments, the first tightening mechanism 802 may be located on a tongue, while the second 804 may be located on a side of a boot. Alternatively, both of the tightening mechanisms 802, 804 can be provided on a tongue or on a side of the footwear. In alternative embodiments, the mechanisms can be otherwise located on a footwear item. In further alternative embodiments, a multi-zone lacing system can be provided with a single lace tightening device comprising a plurality of individually operable spools. Such individually operable spools can be operated by a single knob and a selector mechanism, or each spool can include its own knob.

One embodiment of multi-zone lacing system 800 is preferably a dual loop tightening system in which a first tightening loop has a first lace 23*a* having a first length and a second tightening loop has a second lace 23*b* having a second length. In some embodiments, first lace 23*a* and second lace 23*b* have equal lengths. In other embodiments, the length of second lace 23*b* is preferably in the range of from about 100% to about 150% of the length of first lace 23*a*. In some embodiments, the length of second lace 23*b* is preferably at least 110% of the length of first lace 23*a*. In still other embodiments, the length of second lace 23*b* is preferably at least 125% of the length of first lace 23*a*. In alternative embodiments, the lengths of first 23*a* and second 23*b* laces are reversed. First loop preferably has a lock 802 such as a reel located on a tongue of the footwear and second loop has a lock 804 such as a reel on the side or rear of the footwear. Alternatively, locks 802, 804 may be located elsewhere on the footwear, including both located on a tongue or both on the sides or rear of the footwear.

The multi-zone lacing system 800 schematically shown in FIG. 28 is a triple-zone lacing system. Each zone is generally defined by a pair of lateral lace guides which will be drawn towards one another generally along a line between their centers. Thus, the first lacing zone 810 is defined by the first lace 23*a* extending between first 812 and second 814 lace guides. A second lacing zone 820 is defined by the second lace 23*b* extending between third 822 and fourth 824 lace guides, and a third lacing zone 830 is defined by the region between the fifth 832 and sixth 834 lace guides, through which both the first and second laces 23*a*, 23*b* extend. In alternative embodiments, multi-zone lacing systems can be provided with only two zones, or with four or more zones, and each zone can comprise any number of overlapping laces as desired.

In the embodiment of FIG. 28, the third lacing zone 830 in which the laces overlap provides the unique advantage of automatically tightening the third zone 830 according to the tighter of the two laces 23*a*, 23*b*. In one embodiment, the third lacing zone 830 coincides with an ankle portion of a footwear item. In this embodiment, the third lacing zone advantageously lies along an ankle plane which can extends through a pivot axis of a wearer's ankle at an angle of anywhere from zero to 90 degrees relative to a horizontal plane. In some embodiments, the third zone lies in a plane at between about 30 and about 75 degrees relative to a horizontal plane. In one embodiment, the ankle plane lies at an angle of about 45° above a horizontal plane. In alternative embodiments, the third lacing zone 830 lies along a plane passing through a rear-most point of a wearer's heel and the ankle pivot axis. By locating the third lacing zone along the ankle plane, a wearer's heel can be held tightly in the footwear regardless of which lace is tighter.

As shown in FIG. 28, the multizone lacing system 800 employs a plurality of lace guides of various types. For example, an upper section of the first lace 23*a* and a lower section of the second lace 23*b* are shown extending through first 812, and second 814, third 822 and fourth curved lace guides 824 respectively. Each of the curved lace guides 812, 814, 822, 824 comprises a guide section 842 for substantially frictionless engagement with the laces 23 and an attachment section 844 for securing the lace guide to respective flaps of a footwear item. In some embodiments, the curved lace guides 812, 814, 822, 824 can be similar to the guides 250 described above with reference to FIGS. 10-13.

Central abrasion preventing guides 846, 848 can also be provided between lateral pairs of lace guides to prevent the laces from abrading one another and to keep the laces from tangling with one another. In alternative embodiments, any of the lace guides in the multi-zone lacing system of FIG. 28 can be replaced by any other suitable lace guides as described elsewhere herein. The lace guides can be injection molded or otherwise formed from any suitable material, such as nylon, PVC or PET. As discussed elsewhere herein, lace guides are generally configured to draw opposite flaps of a footwear item towards one another in order to tighten the footwear. This is generally accomplished by providing a guide with a minimum of friction or abrasion-causing surfaces.

In the illustrated embodiment, the third lacing zone advantageously employs a pair of "double-decker" lace guides 832, 834 configured to guide both the first lace and the second lace along an overlapping path while holding the laces 23*a*, 23*b* apart in order to prevent their abrading one another. The lower section of the first lace 23*a*, and a portion of the second lace 23*b* are shown extending through a double-decker lace guide 834 and a double-decker pass-through lace guide 832. FIGS. 29A-29D illustrate an embodiment of a double-decker lace guide for use in embodiments of a multi-zone lacing system. The double-decker lace guide 834 generally comprises an upper lace guiding section 850 for guiding the first lace 23*a*, a lower lace guiding section 852 for guiding the second lace 23*b*, and an attachment section 844 for securing the guide to the footwear. In the illustrated embodiment, each of the upper and lower guide sections 850, 852 comprise arcuate surfaces configured to guide the laces 23 in a substantially frictionless manner. Each of the arcuate sections can be similar to the guides described above with reference to FIGS. 10-13.

FIGS. 30A-30D illustrate one embodiment of a double-decker pass-through lace guide 832. The pass-through guide 832 comprises an upper arcuate section 860 configured to guide the first lace 23*a*, and a lower pass-through section 862. The upper guide section 860 is preferably separated from the lower pass-through section in order to prevent the first 23*a* and second 23*b* laces from abrading one another. The lower pass-through section 862 is generally configured to receive a section of axially-incompressible tubing 864 which abuts a transverse surface 866 of the guide 832. The transverse surface 866 also includes holes 868 sized to allow the lace 23*b* to pass therethrough, while retaining the tubing on one side of the surface 866. The tubing 864 can be any suitable type, such as a bicycle cable sheath or other material as described elsewhere herein. The incompressible tubing sections 864 are provided over the sections of the second lace 23*b* between the lower section 862 of the double-decker pass-through guide 832 and the lace tightening mechanism 804. This prevents the guide 832 from being drawn towards the tightening mechanism 804 as the lace is tightened, and insures that the tightening force is only applied to drawing the flaps of the footwear towards one another. In an alternative embodiment, the tubing sections 864 can be eliminated by incorporating the tightening mechanism into a lace guide in the position of the pass-through guide 832.

In some embodiments, the attachment sections 844 of each of the double-decker lace guide 834, and the double-decker pass-through lace guide 832 can be secured to a strap (not shown) which can extend to a position adjacent the heel of a footwear item, thereby providing additional heal hold-down ability.

The abrasion preventing guides 846 in the illustrated multi-zone lacing system generally include three conduits for supporting the laces 23*a*, 23*b*. As shown, each abrasion preventing guide 846 comprises two crossing diagonal conduits 870 and one linear conduit 872 to support the first and second laces 23*a*, 23*b* in a substantially frictionless and non-interfering manner. In alternative embodiments, the functions of the abrasion preventing guides 846 can be divided among a plurality of separate guides as desired. In further alternative embodiments, any or all of the conduits can be replaced by loops of fabric or other material or straps attached to the footwear or other lace guides. In some embodiments, the double-decker lace guide 834 and the double-decker pass-through lace guide 832 can be attached to one another by a flexible strap with passages through portions of the strap for receiving the first and second laces. Such a strap can be configured to distribute a compressive force throughout the ankle region of the footwear. In some embodiments, such a strap can be made of neoprene or other durable elastic material.

Each of the lace guides is generally configured to be secured to an item of footwear by any suitable means. For example, the lace guides may be secured to a footwear item by stitches, adhesives, rivets, threaded or other mechanical fasteners, or the lace guides can be integrally formed with portions of a footwear item.

Figure 36:
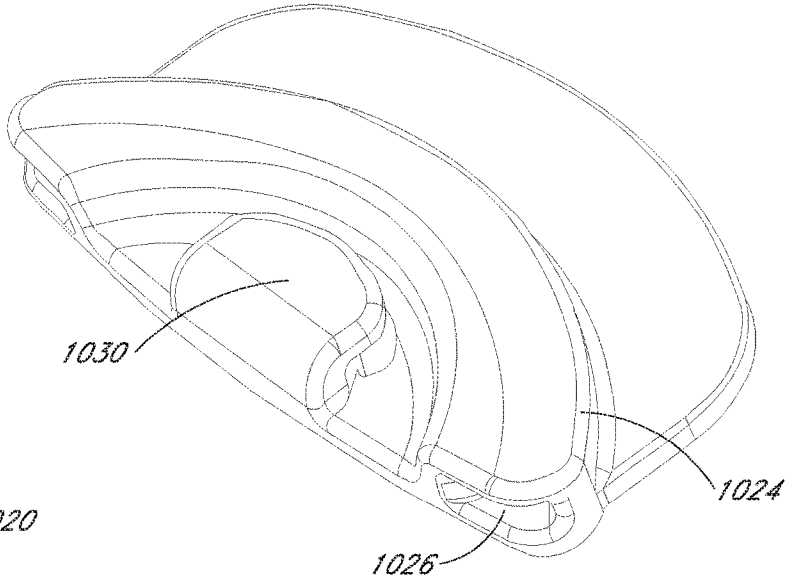
FIG. 36 is a perspective view of a lace guide comprising a hook for use in some embodiments of a lacing system.
Figure 37C:
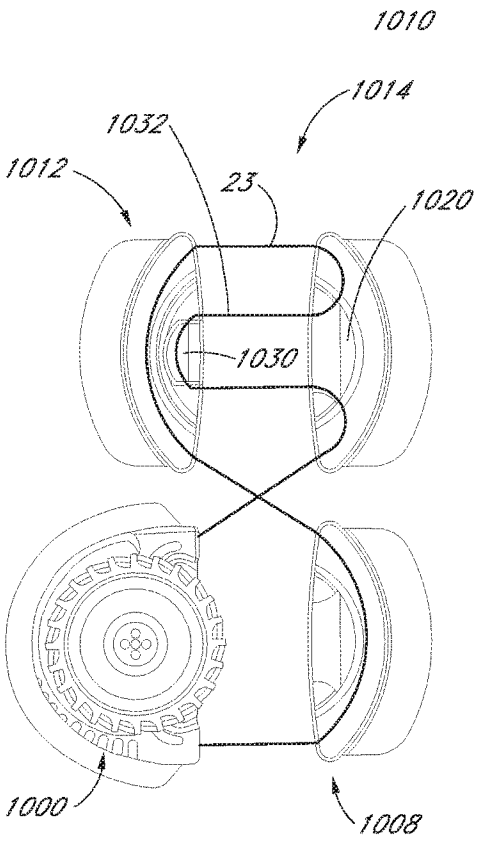
FIGS. 37A-C are schematic illustrations of embodiments of a lacing system configured to double-up laces in desired sections.

FIGS. 35-37C, illustrate still another embodiment of a differential lacing system for tightening a first region of a footwear item differently than a second region. The system of FIGS. 37A-C is generally a lace doubling system in which a lace can be passed through a pair of lace guides a second time by pulling the lace through a slot in a first guide and hooking the lace over a hook extending from a portion of a second guide. A third lace guide 1008 of any suitable type can also be provided opposite the tightening mechanism 1000.

Figure 37B:
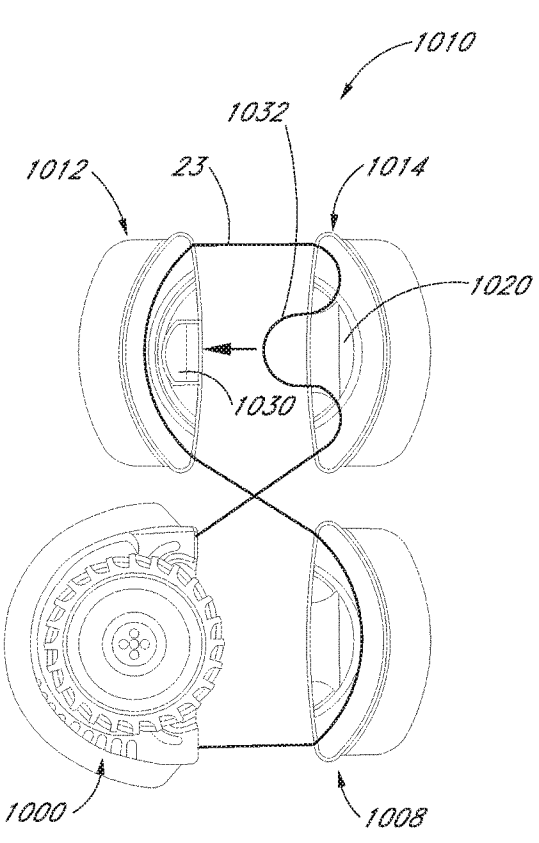
Figure 37A:
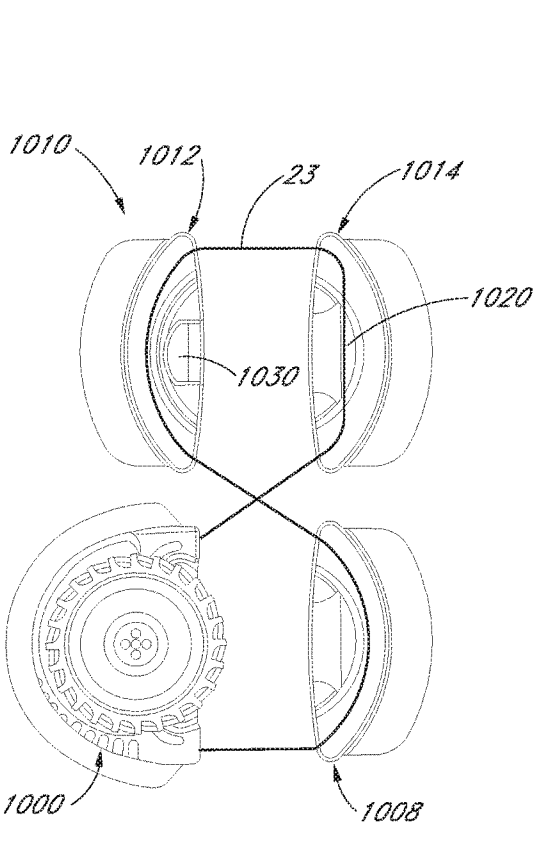

FIG. 37A illustrates a lacing system comprising a lace tightening device 1000 and a lace 23 extending thorough a plurality of lace guides including a pair of doubling lace guides 1010. In some embodiments, doubling lace guides 1010 can be provided in order to double a number of times a lace 23 passes through a single lace guide. As shown in FIG. 37C, a lace 23 can be passed through a given pair of lace guides 1010 twice, thereby providing an additional tightening force between those two guides. In some embodiments, each pair of doubling lace guides 1010 comprises a hook lace guide 1012 and a slotted lace guide 1014.

Figure 35:
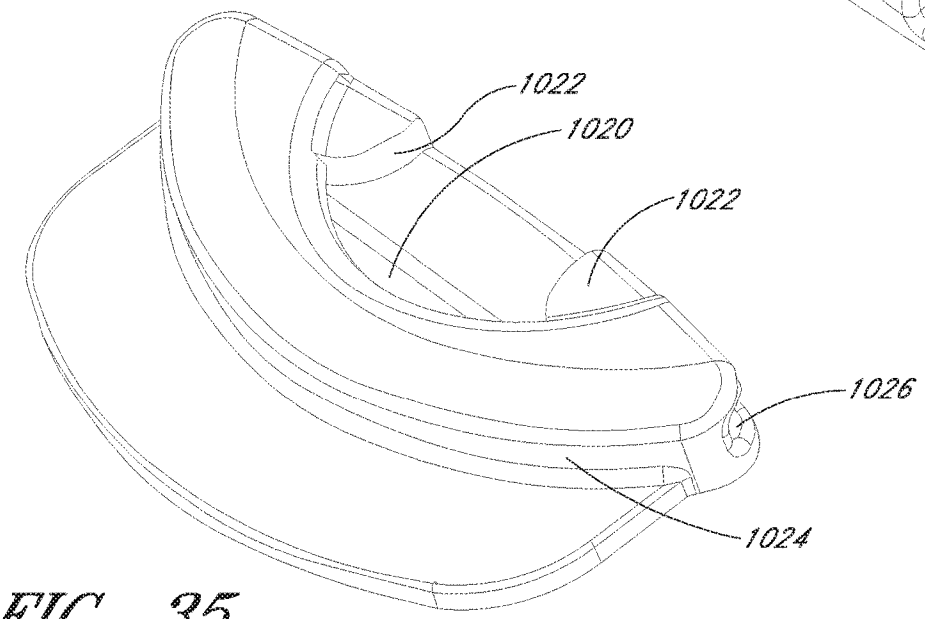
FIG. 35 is a perspective view of a lace guide comprising a slot for use in some embodiments of a lacing system.

FIG. 35 illustrates one embodiment of a lace guide 1014 comprising a curved slot 1020. The slot 1020 is generally sized and configured to allow a user to grasp a portion of the lace 23 which extends across the slot 1020. At either side of the slot 1020, the lace guide 1014 comprises shoulders 1022 configured to substantially frictionlessly support the lace 23 in the guide 1014. As with other embodiments of lace guides described herein, the lace guide 1014 can also comprise a cover 1024 configured to enclose a conduit 1026 through which the lace 23 passes.

FIG. 36 illustrates one embodiment of a lace guide 1012 comprising a hook 1030. The hook 1030 generally extends from an inner portion of the lace guide 1012 and is open so as to allow a lace to be looped over the hook 1030. In some embodiments, the hook 1030 has a width that is approximately equal to the slot 1020 of the slotted lace guide 1014. In some embodiments, the hook 1030 can be molded integrally with the lace guide 1012, while in alternative embodiments, the hook 1030 can be separately formed and subsequently attached to the guide 1012. In some embodiments, the hook 1030 is configured to allow the lace to slide thereon with minimal friction and minimal abrasion on the laces.

As with the other lace guides described herein, the slotted 1014 and hooked 1012 lace guides can be made of any suitable material, and can be attached to a footwear item in any desired manner. Similarly, many embodiments of lace tightening mechanisms are described herein which can be used with the doubling lace guide system of FIGS. 35-37C. A doubling lace guide system can also be used in connection with any other lacing system described herein or elsewhere.

In some embodiments, a plurality of pairs of doubling lace guides can be provided on a footwear item so as to provide a user with the option of doubling up laces in a number of sections of the footwear. In other embodiments, the tightening mechanism 1000 can include a hook extending from a portion thereof in order to provide further versatility.

FIGS. 37A-37C illustrate one embodiment of a sequence for doubling up a lace with a pair of doubling lace guides 1010. In a first position, as shown in FIG. 37A, the lace 23 lies across the curved slot 1020. A user can grasp the lace 23 with a finger or small tool, such as a key. A loop 1032 of the lace 23 can then be pulled through the slot towards the hooked lace guide 1012 as shown in FIG. 37B. The loop 1032 can then be placed over the hook 1030 as shown in FIG. 37C, so as to double the number of times the lace passes through the lace guides 1010.

As discussed above, the lace 23 is preferably a highly lubricious cable or fiber having a low modulus of elasticity and a high tensile strength. While any suitable lace may be used, certain preferred embodiments utilize a lace formed from extended chain, high modulus polyethylene fibers. One example of a suitable lace material is sold under the trade name SPECTRA™, manufactured by Honeywell of Morris Township, N.J. The extended chain, high modulus polyethylene fibers advantageously have a high strength to weight ratio, are cut resistant, and have very low elasticity. One preferred lace made of this material is tightly woven. The tight weave provides added stiffness to the completed lace. The additional stiffness provided by the weave offers enhanced pushability, such that the lace is easily threaded through the lace guides, and into the reel and spool.

The lace made of high modulus polyethylene fibers is additionally preferred for its strength to diameter ratio. A small lace diameter allows for a small reel. In some embodiments, the lace has a diameter within the range of from about 0.010" to about 0.050", or preferably from about 0.020" to about 0.030", and in one embodiment, has a diameter of 0.025". Of course, other types of laces, including those formed of textile, polymeric, or metallic materials, may be suitable for use with the present footwear lacing system as will be appreciated by those of skill in the art in light of the disclosure herein.

Another preferred lace is formed of a high modulus polyethylene fiber, nylon or other synthetic material and has a rectangular cross-section. This cross-sectional shape can be formed by weaving the lace material as a flat ribbon, a tube, or other suitable configuration. In any case the lace will substantially flatten and present a larger surface area than a cable or other similar lace and will thereby reduce wear and abrasion against the lace guides and other footwear hardware. In addition, there is a sufficient amount of cross-sectional material to provide an adequate tension strength, while still allowing the lace to maintain a sufficiently thin profile to be efficiently wound around a spool. The thin profile of the lace advantageously allows the spool to remain small while still providing the capacity to receive a sufficient length of lace. Of course, the laces disclosed herein are only exemplary of any of a wide number of different types and configurations of laces that are suitable to be used with the lacing system described herein.

Figure 38B:
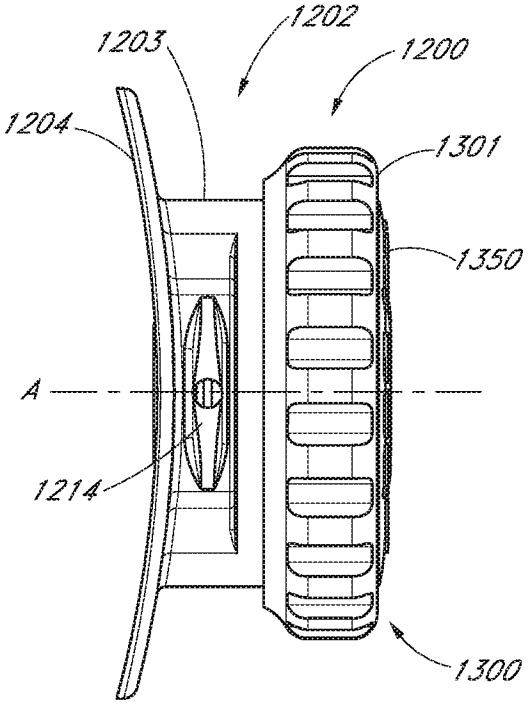
FIGS. 38A and 38B are side elevation views of one embodiment of a component of a lacing system.
Figure 38A:
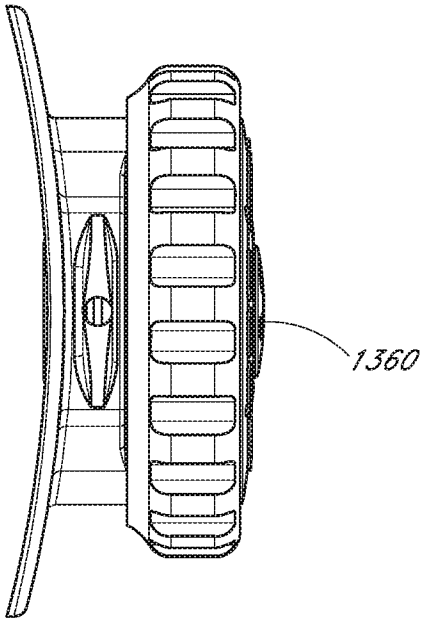

With reference to FIGS. 38A through 51, additional embodiments of a lacing system 22 are shown. FIGS. 38A and 38B are side views of an alternative tightening mechanism 1200. The tightening mechanism 1200 includes a base member 1202 including an outer housing 1203 and a mounting flange 1204 disposed near the bottom of outer housing 1203. In alternative embodiments, the flange 1204 is disposed a distance from the bottom of outer housing 1203. Mounting flange 1204 may be mounted to the outside structure of an article of footwear, or may be mounted underneath some or all of the outer structure of the footwear, to which the tightening mechanism 1200 is attached. Base member 1202 is preferably molded out of any suitable material, as discussed above, but in one embodiment, is formed of nylon. As in other embodiments, any suitable manufacturing process that produces mating parts fitting within the design tolerances is suitable for the manufacture of base 1202 and the other components disclosed herein. Tightening mechanism 1200 further includes a control mechanism, such as a rotatable knob assembly 1300, mechanically coupled thereto. Rotatable knob assembly 1300 is slideably movable along an axis A between two positions with respect to the outer housing 1203.

In a first, also referred to herein as a coupled or an engaged position (shown in FIG. 38A), knob 1300 is mechanically engaged with an internal gear mechanism located within outer housing 1203, as described more fully below. In a second, also referred to herein as an uncoupled or a disengaged position (shown in FIG. 38B), knob 1300 is disposed upwardly with respect to the first position and is mechanically disengaged from the gear mechanism. Disengagement of knob 1300 from the internal gear mechanism is preferably accomplished by pulling the control mechanism outward, away from mounting flange 1204, along axis A. Alternatively, the components may be disengaged using a button or release, or a combination of a button and rotation of knob 1300, or variations thereof, as will be appreciated by those of skill in the art and as herein described above.

Figure 39:
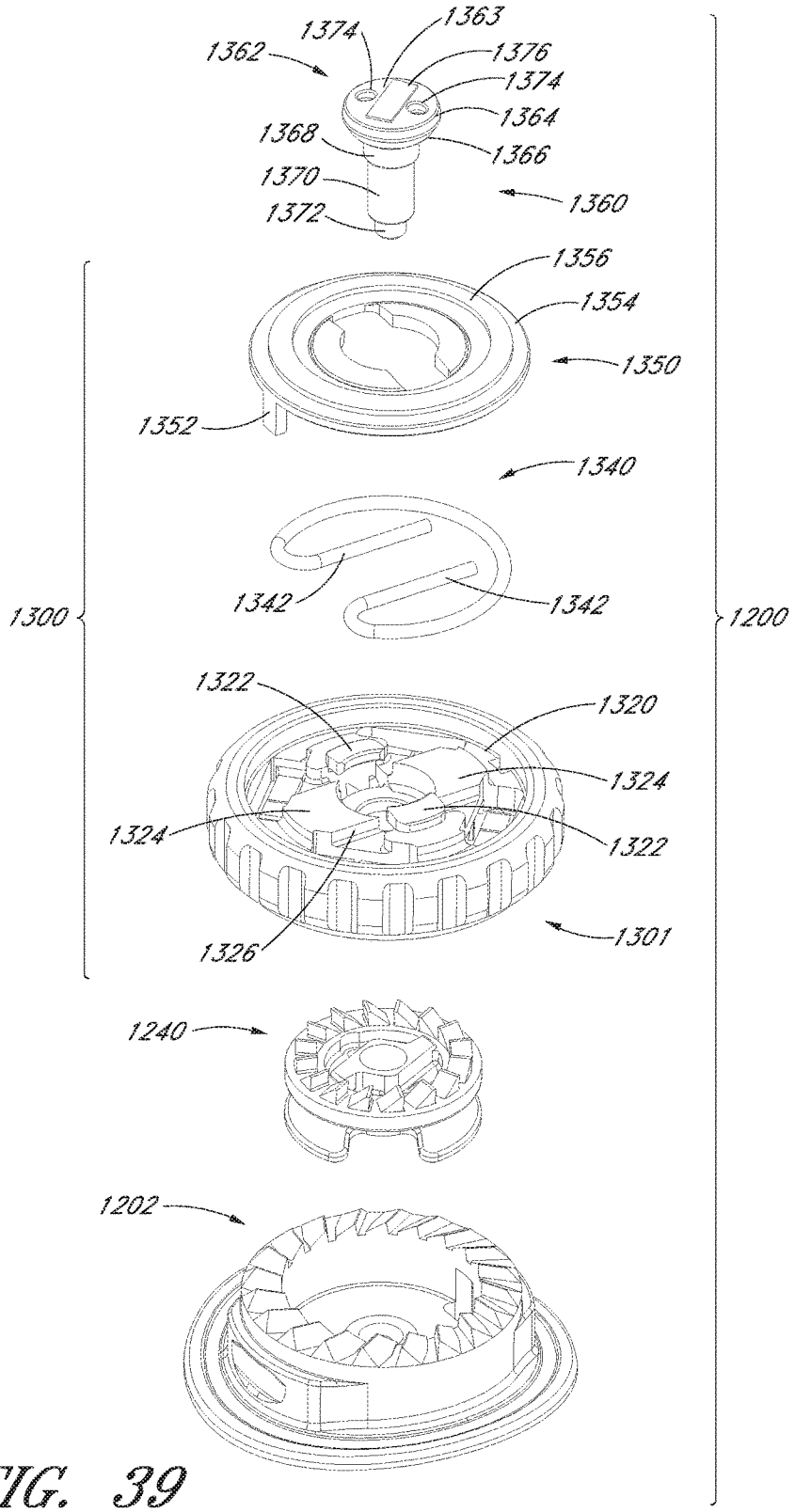
FIG. 39 is an exploded top perspective view of one embodiment of a tightening mechanism.

FIG. 39 illustrates a top perspective exploded view of one embodiment of a tightening mechanism 1200. The embodiment of FIG. 39 illustrates a base unit 1202, a spool 1240, and a knob assembly 1300. Spool 1240 is generally configured to be placed within a housing 1203. Knob assembly 1300 can then be assembled with housing 1203 and spool 1240 to provide tightening mechanism 1200. Tightening mechanism 1200 may also be referred to herein as a lacing device, a lace lock, or more simply as a lock.

Figure 40A:
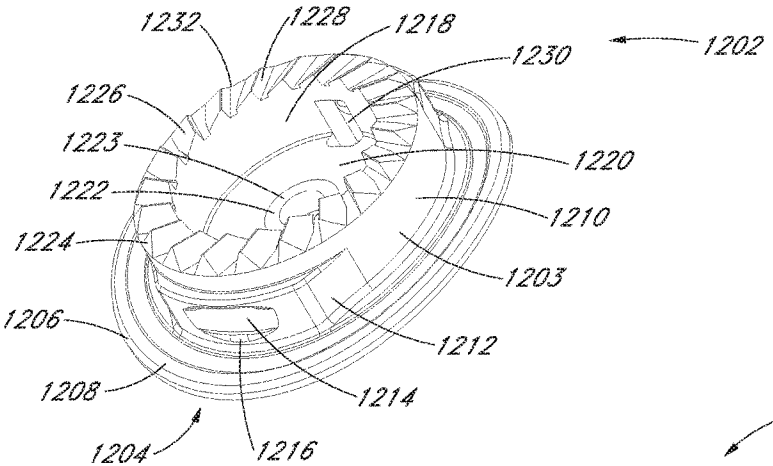
FIGS. 40A through 40C are various views of one component of a tightening mechanism.
Figure 40B:
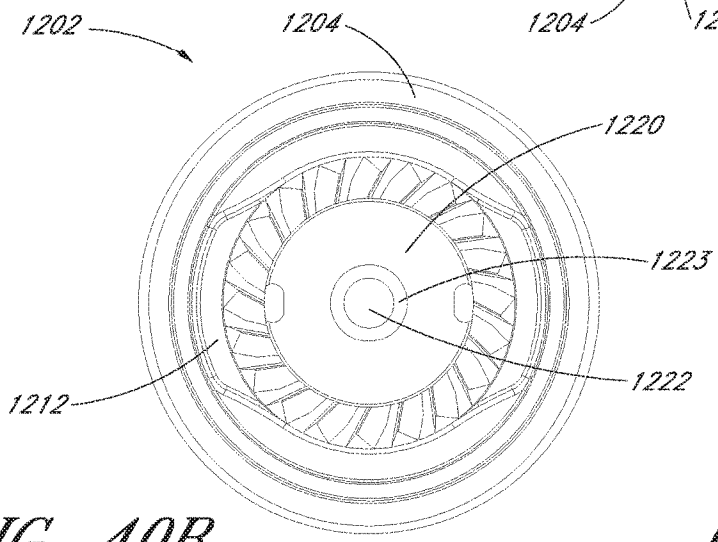
Figure 40C:
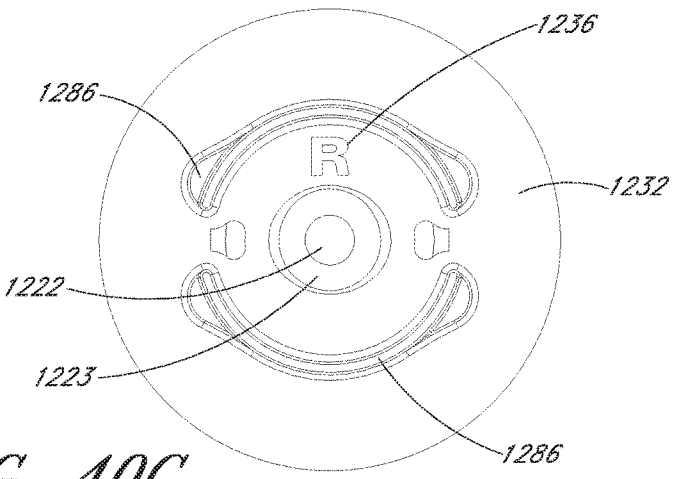

FIGS. 40A through 40C illustrate one embodiment of base member 1202. Base 1202 includes an outer housing 1203 and a mounting flange 1204. Preferably, flange 1204 extends circumferentially around housing 1203. In alternative embodiments, flange 1204 extends only partially around the circumference of housing 1203 and may comprise one or more distinct portions. Though flange 1204 is shown with a circular or ovular shape, it may also be rectangular, square, or any of a number of other regular or irregular shapes. Flange 1204 preferably includes a trough 1208 extending substantially the length of the outer circumference of flange 1204. The central portion of trough 1208 is preferably thinner than the rest of flange 1204, thereby facilitating attachment of base 1202 to the footwear by stitching. Though stitching is preferred, as discussed above, base 1202 may be securely attached by any suitable method, such as for example, by adhesives, rivets, threaded fasteners, and the like, or any combinations thereof. For example, adhesive may be applied to a lower surface 1232 of base member 1202. Alternatively, mounting flange 1204 may be removeably attached to the footwear, such as by a releasable mechanical bonding structure in the form of cooperating hook and loop structures. Flange 1204 is preferably contoured to curve with the portion of the footwear to which it is attached. One such contour is illustrated in FIGS. 38A and 38B and in FIGS. 45A and 45B. In some embodiments, the contour is flat. Flange 1204 is also preferably resilient enough to at least partially flex in response to forces which cause the structure of the footwear to which it is mounted to flex.

Outer housing 1203 of base member 1202 is generally a hollow cylinder having a substantially vertical wall 1210. Housing wall 1210 may include a minimal taper outward toward flange 1204 from the upper most surface 1332 of housing 1203 the base of housing 1203. Housing 1203 preferably includes sloped teeth 1224 formed onto its upper most surface 1332 such as those found on a ratchet, as has been described herein above. These base member teeth 1224 may be formed during the molding process, or may be cut into the housing after the molding process, and each defines a sloped portion 1226 and a substantially vertical portion 1228. In one embodiment, vertical portion 1228 may include a back cut vertical portion 1228 in which it is less than vertical, as described below.

In one embodiment, the sloped portion 1226 of each tooth 1224 allows relative clockwise rotation of a cooperating control member, e.g. knob assembly 1300, while inhibiting relative counterclockwise rotation of the control member. Of course, the teeth direction could be reversed as desired. The number and spacing of teeth 1224 controls the fineness of adjustment possible, and the specific number and spacing can be designed to suit the intended purpose by one of skill in the art in light of this disclosure. However, in many applications, it is desirable to have a fine adjustment of the lace tension, and the inventors have found that approximately 20 to 40 teeth are sufficient to provide an adequately fine adjustment of the lace tension.

Figure 41:
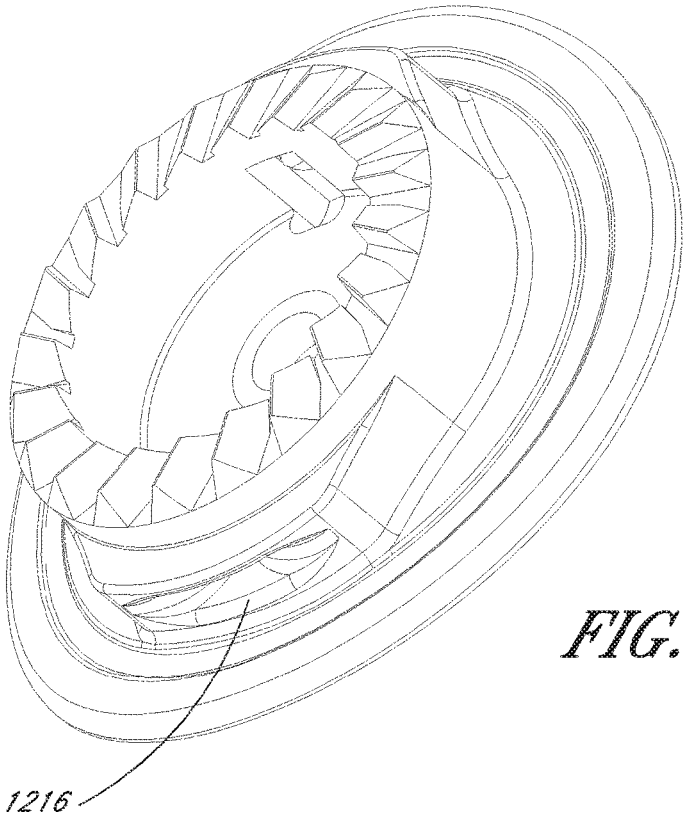
FIG. 41 is a top perspective view of one component of a tightening mechanism.

Base member 1202 additionally contains a pair of lace entry holes 1214 for allowing each end of a lace to enter therein and pass through internal lace openings 1230. Lace entry holes 1214 and internal lace openings 1230 preferably define elongated lace pathways that correspond to the annular groove of spool 1240. Preferably, lace entry holes 1214 are disposed on vertical wall 1210 of housing 1203 directly opposed from each other. As discussed above, base member 1202 lace entry holes 1214 may be made more robust by the addition of higher durometer materials either as inserts or coatings to reduce the wear caused by the laces abrading against the base member 1202 entry holes 1214. Additionally, the site of the entry hole can be rounded or chamfered to provide a larger area of contact with the lace to further reduce the pressure abrasion effects of the lace rubbing on the base unit. In the illustrated embodiment, base member 1202 includes lace opening extensions 1212 including rounded entry hole edges 1216 to provide additional strength to the housing 1203 in the area of the lace entry holes 1214. FIG. 41 shows a modified entry hole edge 1216. As discussed above, a lace guide may be formed integrally with the base member 1202 and can be configured depending upon the specific application of the lacing system 22. An embodiment with an integrated lace guide is shown attached to footwear in FIG. 47B.

It is preferable that the inner bottom surface 1220 of the base member 1202 is highly lubricious to allow mating components an efficient sliding engagement therewith. Accordingly, in one embodiment, a washer or bushing (not shown) is disposed within the cylindrical housing portion 1203 of the base member 1202, and may be formed of any suitable lubricious polymer, such as PTFE, for example, or may be formed of a lubricious metal. Alternatively, the inner bottom surface 1220 of the base member 1202 may be coated with any of a number of coatings (not shown) designed to reduce its coefficient of friction and thereby allow any components sharing surface contact therewith to easily slide. One advantage of the illustrated embodiment is the reduction in separate movable components required to manufacture tightening mechanism 1200. Fewer parts reduces the cost of manufacture and preferably results in lighter weight mechanisms. Overall, tightening mechanism 1200 is small and compact with few moving parts. Light weight and fewer moving parts also reduce the frictional forces generated on the components within lacing device 1200 during use.

An inner surface 1218 of housing 1203 is preferably substantially smooth to facilitate winding of the lace about the spool residing within housing 1203 during operation. When spool 1240 is inserted into housing 1203, inner surface 1218 cooperates with annular groove 1256 to hold the wound lace. Preferably, the material selected for inner surface 1218 is adapted to reduce the friction imparted upon the lace if the lace rubs against the surface when the lace is wound into or released from housing 1203. FIG. 40B shows a top view of base member 1202. Base 1202 preferably includes a central axial opening 1222. In a preferred embodiment, opening 1222 is adapted to receive a threaded insert 1223. Insert 1223 is preferably metallic or some other material offering suitable strength to securely retain axial pin 1360 (e.g., FIG. 39).

FIG. 40C illustrates grooves 1286 which are preferably included in base member 1202. Grooves 1286 further reduce the material utilized in the illustrated embodiment, thereby reducing the weight of the completed tightening mechanism 1200 and providing for improved molding by providing substantially similar wall thicknesses throughout base member 1202. Also shown is part indicia 1236. Indicia 1236 may be used to indicate the "handedness" of a particular part. In some applications, namely on a pair of footwear having a united adapted for use with a right foot and another unit adapted for use with a left foot, it may be desirable to have lacing devices 1200 attached to the shoes operate in different directions. Indicia 1236 help coordinate the proper components for each lacing device 1200. Indicia 1236 may be used on some or all of the components described herein. Indicia 1236 may be formed during the molding process or may be painted onto the component parts.

With additional reference to FIG. 39, as well as to FIGS. 42A through 42E, a spool 1240 is provided and configured to reside within housing 1203 of base member 1202. Spool 1240 is preferably molded out of any suitable material, as discussed above, but in one preferred embodiment, is formed of nylon and may include a metal insert, preferably along the central axis. In alternative embodiments, spool 1240 is cast or molded from any suitable polymer or formed of metal such as aluminum. Spool 1240 preferably includes an upper flange 1253, a lower flange 1242, and a substantially cylindrical wall 1252 therebetween. A central axial opening 1286 extends through spool 1240 and includes inner side walls 1288. A bottom surface 1254 of upper flange 1253 cooperates with the outer surface of cylindrical wall 1252 and an upper surface 1244 of lower flange 1242 to form annular groove 1256. Annular groove 1256 is advantageously adapted to receive the spooled lace as it is wound around spool 1240.

In one preferred embodiment, bottom surface 1254 of upper flange 1253 and upper surface 1244 of lower flange 1242 are both angled relative to the horizontal axis of spool 1240. As shown in FIG. 42B, the distance between the surfaces adjacent cylindrical wall 1252 is smaller than the distance between the surfaces when measured from the outer diameter of the flanges. As lace 23 is wound around spool 1240, the effective diameter of the combined lace and spool increases. Advantageously, as tension is placed on lace 23, the coiled lace 23 will fan out, minimizing the effective diameter of the spool plus wound lace. The smaller the effective diameter, the greater the torque placed on lace 23 when knob 1300 is rotated. In alternative embodiments, spool 1240 includes one or more additional flanges to define additional annular grooves.

Preferably, the periphery of an upper surface 1260 of upper flange 1253 is configured to include sloped teeth 1262. Sloped teeth 1262 may be formed during the molding process, if spool 1240 is molded, or may be subsequently cut therein, and each defines a sloped portion 1264 and a substantially vertical portion 1266 as measured from upper surface 1260. Vertical portion 1266 is preferably back cut such that it is slightly less than vertical, preferably in the range of zero (0) and twenty (20) degrees less than ninety (90) degrees. More preferably, it is angled between one (1) and five (5) degrees less than vertical. Most preferably, it is angled about three (3) degrees less than vertical. In one embodiment, vertical portion 1266 of each tooth 1262 cooperates with teeth formed on a control member, e.g. knob teeth 1308, causing relative counter-clockwise rotation of spool 1240 upon counter-clockwise rotation of the cooperating control member, thereby winding the lace about the cylindrical wall 1252 of spool 1240. Of course, the teeth direction could be reversed as desired. The slight angle less than vertical, or back cut, is preferable as it increases the strength of the mating relationship between spool teeth 1262 and the control member. As lace tension increases, spool 1240 and knob 1300 may tend to disengage. Back cutting the vertical portion of the teeth helps prevent unintended disengagement.

Advantageously, spool 1240 is dimensioned to reduce the overall size of tightening mechanism 1200. Adjustments may be made with the ratio of the diameter of cylindrical wall 1252 of spool 1240 and the diameter of control knob 1300 to affect the torque that may be generated within tightening mechanism 1200 during winding. As lace 23 is wound about spool 1240, its effective diameter will increase and the torque generated by rotating knob 1300 will decrease. Preferably, torque will be maximized while maintaining the compact size of the lace lock 1200. For purposes of non-circular cross-sections, the diameter as used herein refers to the diameter of the best fit circle which encloses the cross-section in a plane transverse to the axis of rotation.

In many embodiments of the present invention, the knob 1300 will have an outside diameter of at least about 0.5 inches, often at least about 0.75 inches, and, in one embodiment, at least about 1.0 inches. The outside diameter of the knob 1300 will generally be less than about 2 inches, and preferably less than about 1.5 inches.

The cylindrical wall 1252 defines the base of the spool, and has a diameter of generally less than about 0.75 inches, often no more than about 0.5 inches, and, in one embodiment, the diameter of the cylindrical wall 1252 is approximately 0.25 inches.

The depth of the annular groove 1256 is generally less than a ½ inch, often less than ⅜ of an inch, and, in certain embodiments, is no more than about a ¼ inch. In one embodiment, the depth is approximately 3/16 of an inch. The width of the annular groove 1256 at about the opening thereof is generally no greater than about 0.25 inches, and, in one embodiment, is no more than about 0.13 inches.

The knob 1300 generally has a diameter of at least about 300%, and preferably at least about 400% of the diameter of the cylindrical wall 1252.

The lace for cooperating with the forgoing cylindrical wall 1252 is generally small enough in diameter that the annular groove 1256 can hold at least about 14 inches, preferably at least about 18 inches, in certain embodiments at least about 22 inches, and, in one embodiment, approximately 24 inches or more of length, excluding attachment ends of the lace. At the fully wound end of the winding cycle, the outside diameter of the cylindrical stack of wound lace is less than 100% of the diameter of the knob 1300, and, preferably, is less than about 75% of the diameter of the knob 1300. In one embodiment, the outer diameter of the fully wound up lace is less than about 65% of the diameter of the knob 1300.

By maintaining the maximum effective spool diameter less than about 75% of the diameter of the knob 1300 even when the spool is at its fully wound maximum, maintains sufficient leverage so that gearing or other leverage enhancing structures are not necessary. As used herein, the term effective spool diameter refers to the outside diameter of the windings of lace around the cylindrical wall 1252, which, as will be understood by those of skill in the art, increases as additional lace is wound around the cylindrical wall 1252.

In one embodiment, approximately 24 inches of lace will be received by 15 revolutions about the cylindrical wall 1252. Generally, at least about 10 revolutions, often at least about 12 revolutions, and, preferably, at least about 15 revolutions of the lace around the cylindrical wall 1252 will still result in an effective spool diameter of no greater than about 65% or about 75% of the diameter of the knob 1301.

In general, laces having an outside diameter of less than about 0.060 inches, and often less than about 0.045 inches will be used. In certain preferred embodiments, lace diameters of less than about 0.035 will be used.

Side edge 1258 of upper flange 1253 and side edge 1248 of lower flange 1242 are adapted to slidingly engage the inner wall surface 1218 of the housing 1203 of the base member 1202. Sliding engagement with the inner wall surface 1218 helps stabilize spool 1240 inside housing 1203. Similarly, inner side walls 1288 of axial opening 1286 of spool 1240 slidingly engage the axial body 1370 of axial pin 1360 to stabilize spool 1240 during use of lacing device 1200. Lower surface 1246 of lower flange 1242 may be configured for efficient sliding engagement with inner bottom surface 1220 of base member 1202. In FIG. 42C, lower surface 1246 is shown substantially flat. In alternative embodiments, lower surface 1246 may be provided with a lip (not shown) that offers a small surface area that contacts bottom surface 1220 of base member 1202.

Figure 42A:
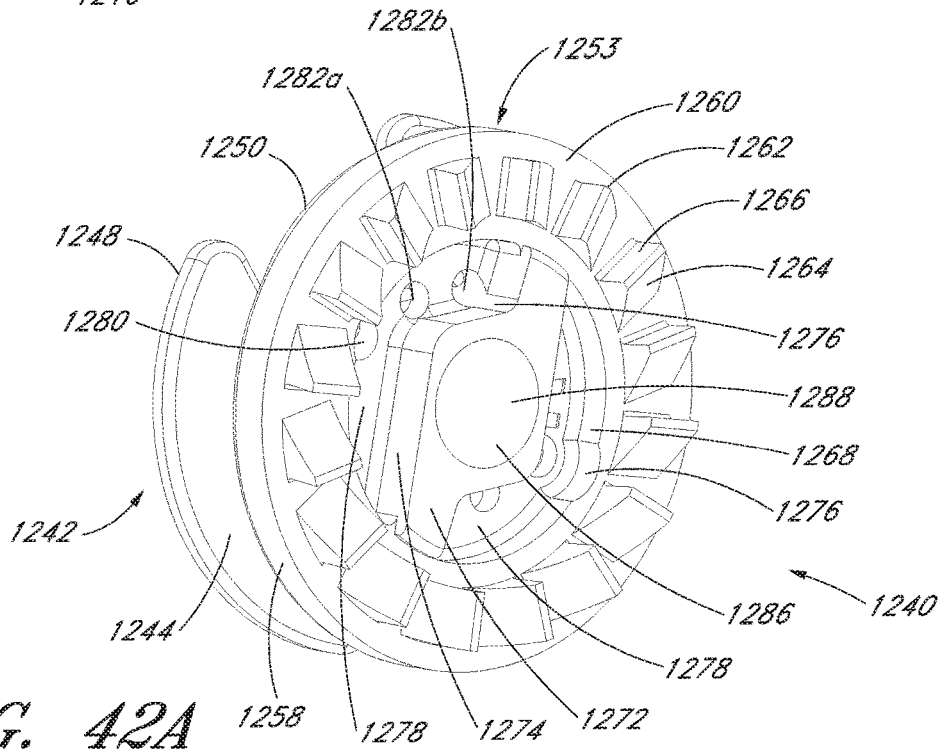
FIGS. 42A through 42E are various views of one component of a tightening mechanism.
Figure 42D:
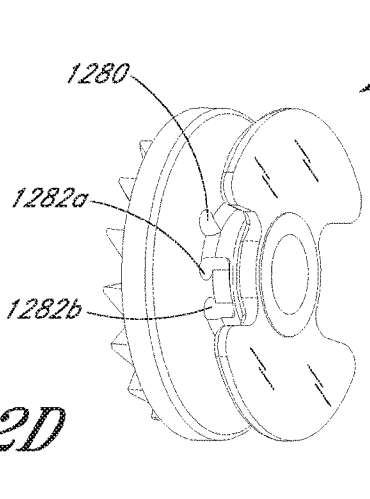
Figure 42B:
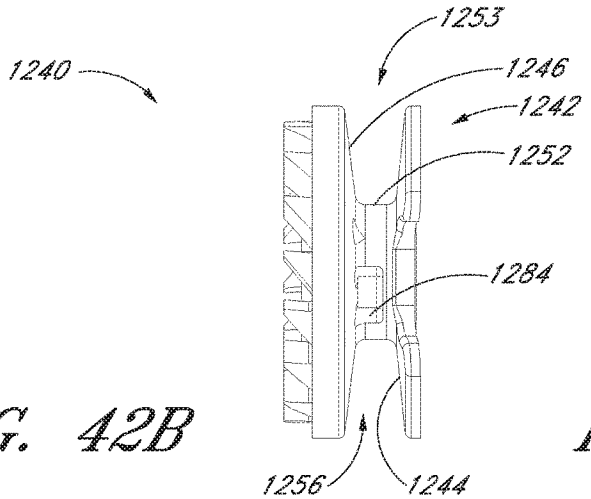

As illustrated in FIGS. 42A through 42B, lower flange 1242 of spool 1240 preferably includes lace gaps 1250. Lace gaps 1250 facilitate attachment of the lace to the spool as described below. Lace gaps 1250 also facilitate insertion of spool 1240 within housing 1203 after lace 23 has been attached to spool 1240. Preferably, the edges of lace gaps 1250 are rounded. Rounded edges reduce the potential for the lace to catch on the gaps which could potentially adversely kink the lace. Advantageously, the edges of all the components that directly contact the lace are preferably rounded. This is especially advantageous where the lace slides against these edges.

As described in detail above, spool 1240 may include one or more annular grooves 1256 that are configured to receive lace 23. Preferably, the ends of lace 23 are connected to spool 1240, either fixedly or removeably, in any one of a number of suitable attachment methods, including using set screws, crimps, or adhesives. In a preferred embodiment shown in FIG. 42E, lace 23 is removeably secured to spool 1240. Upper flange 1253 of spool 1240 preferably includes two sets of three retaining holes (see FIG. 42A) adapted to receive lace 23. An inner side wall 1268 of upper flange 1253 cooperates with side walls 1274 of a central divider 1272 to define knot cavities 1278. In a preferred embodiment, side walls 1268 and 1274 include one or more lace indents 1276 to facilitate insertion of lace 23 into the retaining holes. In alternative embodiments, lace indents 1276 are not included.

Figure 42E:
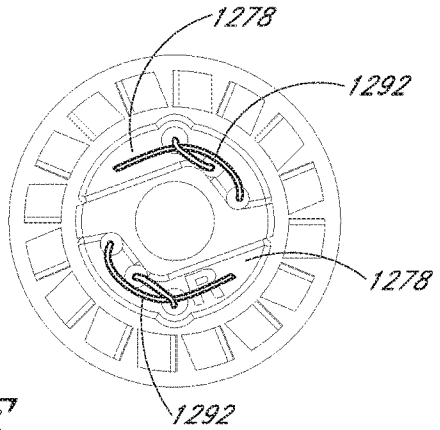
Figure 42C:
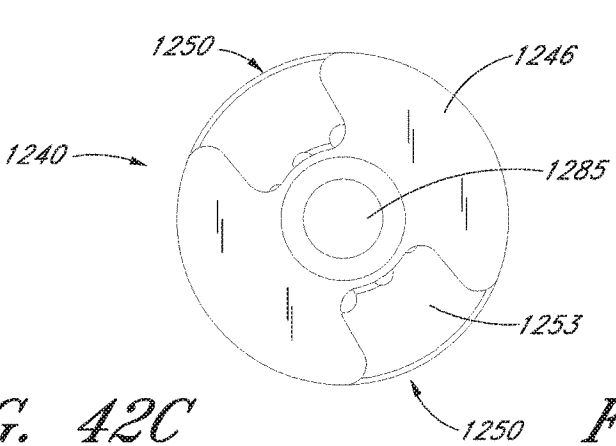

Lace 23 is preferably secured to spool 1240 by threading lace 23 through one of the lace holes 1214 in base member 1202. Lace 23 exits internal lace opening 1230 of housing 1203 and is directed toward spool 1240. Lace 23 is then passed through lace gap 1250 and upwards through entrance hole 1280 in upper flange 1253. Next, lace 23 is passed downward through loop hole 1282*a* and back upwards through loop hole 1282*b*. A portion of lace 23 therefore forms a loop disposed above upper flange 1253 and between entrance hole 1280 and loop hole 1282*a*. The end of lace 23 is passed through the loop and tension is placed on the portion of lace 23 extending downwards from entrance hole 1280 to tighten the resulting knot 1292. Preferably, knot 1292 is positioned such that it rests within knot cavity 1278 by passing the end of lace 23 through the loop from outside inwards, as shown in FIG. 42E. A second knot 1292 is similarly formed. Advantageously, wall 1252 of spool 1240 may also include lace groove 1284. Lace groove 1284 captures the portion of lace 23 that extends into annular groove 1256 after lace 23 is tied to spool 1240. By accommodating this portion of lace 23 within wall 1252, the winding of lace 23 around spool 1240 is cleaner and less compression and pressure is placed upon the portion of lace 23 extending into annular groove 1256. Lace groove 1284 further minimizes the diameter of spool 1240 to maximize the torque that may be placed on lace 23 as discussed above. In alternative embodiments, lace groove 1284 is not included.

Although the above method of securing lace 23 to spool 1240 is preferred, other means for attaching the lace are also envisioned by the inventors. The method for attaching lace 23 to spool 1240 as described above is advantageous as it allows for a simple, secure connection to spool 1240 without requiring additional connection components. This saves weight and decreases the assembly time required to manufacture footwear incorporating a tightening mechanism 1200 as described herein. Further, this type of connection allows for simplified and easy replacement of lace 23 when it has become worn.

Figure 43A:
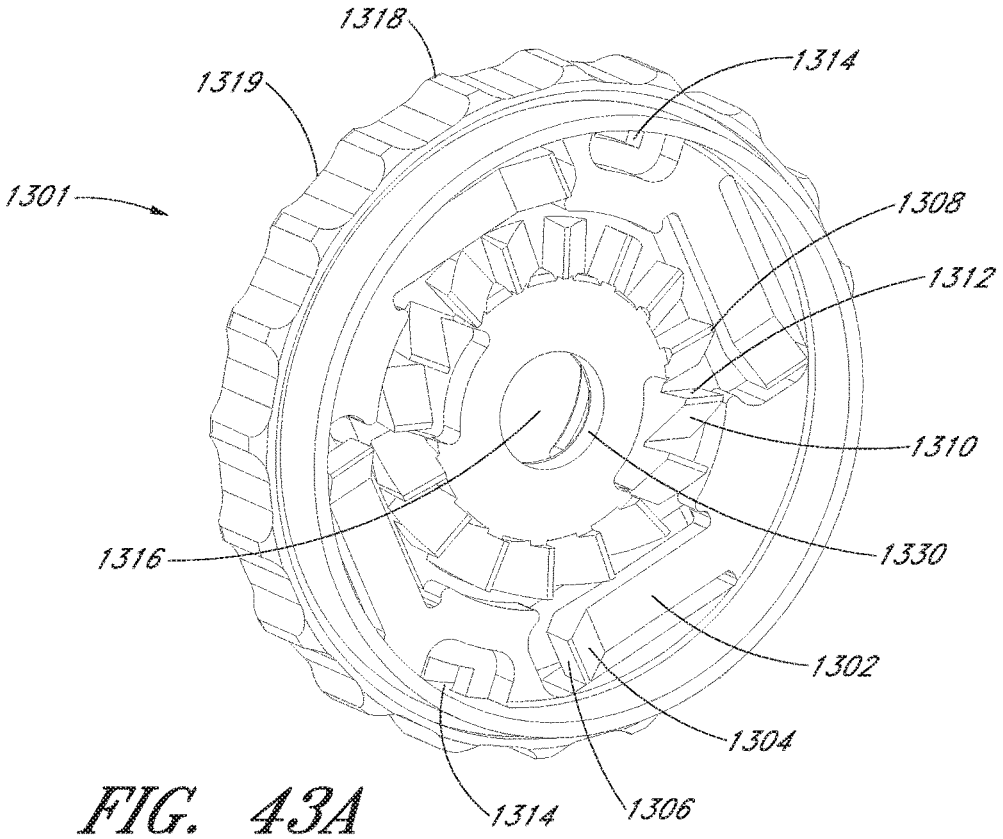
FIGS. 43A and 43B are various views of one component of a tightening mechanism.
Figure 43B:
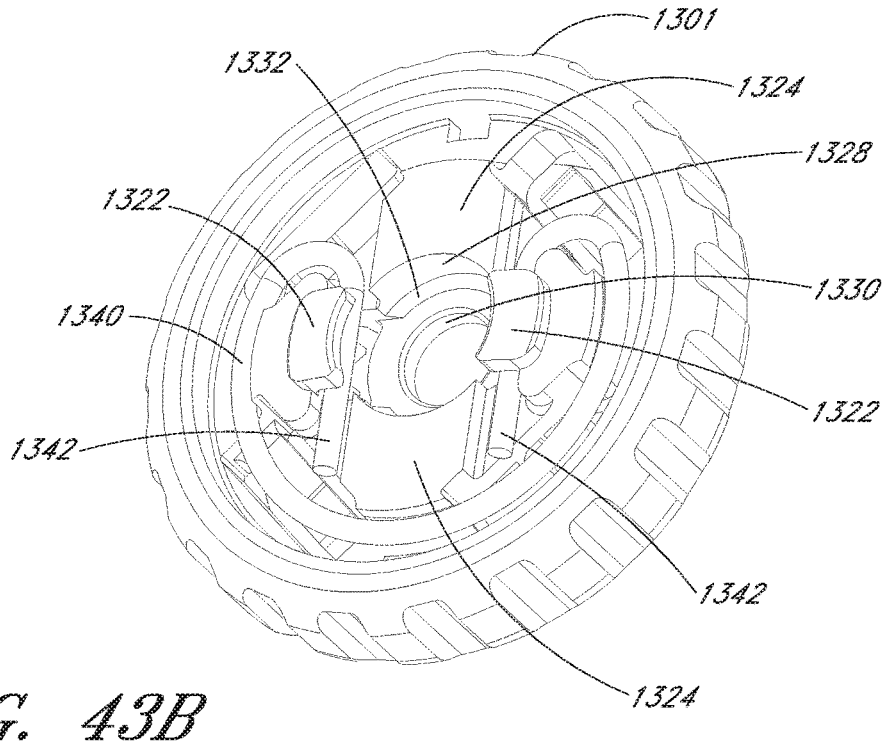

Referring now to FIGS. 39, 43A, and 43B, tightening mechanism 1200 is further provided with a control knob assembly 1300 which is configured to be incrementally rotated in a forward rotational direction, i.e., in a rotational direction that causes lace 23 to wind around spool 1240. Toward this end, control knob 1300 preferably includes a series of integrally-mounted pawls 1302 that engage the corresponding series of teeth 1224 on outer housing 1203 of base 1202. Pawls 1302 are preferably engaged with base teeth 1224 only when the control knob 1300 is in the coupled or engaged position, as shown in FIG. 38A. The tooth/pawl engagement inhibits knob 1300, and mechanically connected spool 1240, from being rotated in a backwards direction (i.e., in a rotational direction opposite the rotational direction that winds lace 23 around spool 1240) when knob 1300 is in the engaged position. This configuration prevents the user from inadvertently winding control knob 1300 backwards, which could cause lace 23 to kink or tangle in spool 1240. In alternative embodiments, pawls 1302 may be configured, for instance by modifying the sloped surface 1304 of pawls 1302, to allow incremental rotation of knob 1300 in the reverse direction. Such an embodiment is advantageous as it could allow for incremental decrease of the tension placed on the lace.

Knob assembly 1300 preferably includes a knob 1301, a spring member 1340, and a cap member 1350. As shown in FIG. 43A, the under side of knob 1301 further includes teeth 1308 for engagement with spool teeth 1262 of spool 1240. Knob teeth 1308 include sloping portions 1310 and vertical portions 1312. One or more cap engagement openings 1314 extend through knob 1301 to facilitate attachment of cap 1350 to knob 1301. Preferably, cap 1350 includes one or more downwardly extending engagement arms 1352 of (FIG. 39) which may cooperate with one or more engagement openings 1324. In a preferred embodiment, arms 1352 are heat staked in place. As will be appreciated by those of skill in the art, cap 1350 may be permanently or removably coupled to knob 1301 in any one of a number of ways. For example, in alternative embodiments, engagement arms 1352 may include prongs or protrusions at the ends thereof for removably securing cap 1350 to knob 1301. As shown in FIG. 39, an upper surface 1354 of cap 1350 may advantageously include advertising indicia 1356, which may be in the form of raised letters or symbols or, alternatively, be visually differentiated from the rest of upper surface 1354 with colors. As such, tightening mechanism may be used as an advertising tool. In other embodiments, upper surface 1354 does not include indicia 1356.

An outer engagement surface 1319 of knob 1301 is preferably formed with knurls 1318 or some other friction enhancing feature. In preferred embodiments, the outer engagement surface 1317 is made of a softer material that the rest of knob 1301 to increase the tactile feel of knob 1301 and to ease the manipulation of the lacing device 1200 to apply tension to lace 23.

Figure 45A:
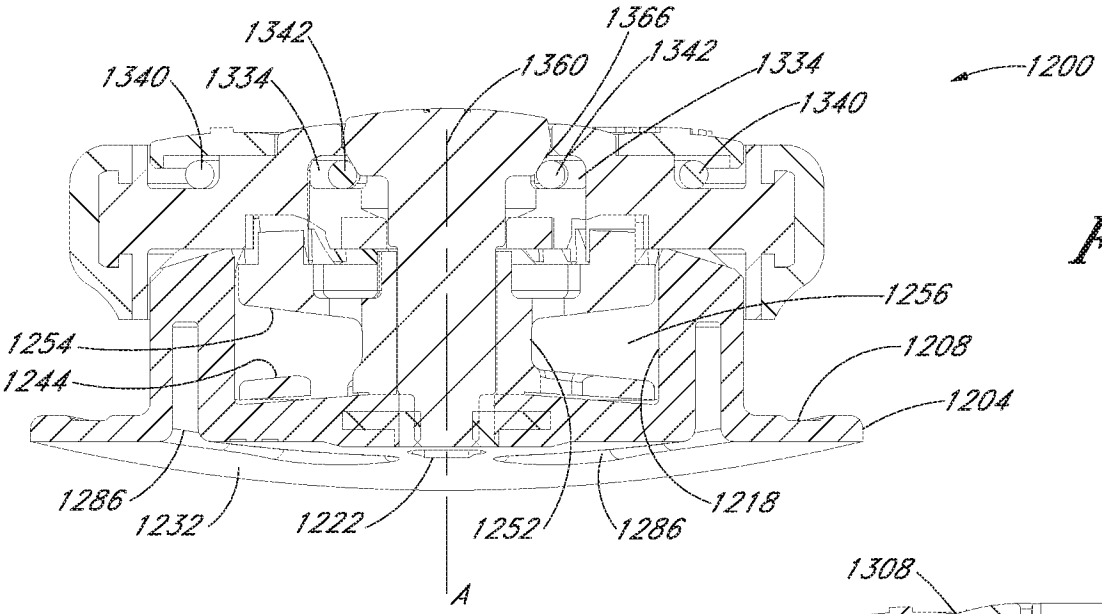
FIGS. 45A and 45B are cross sectional side views of one embodiment of a tightening mechanism.
Figure 45B:
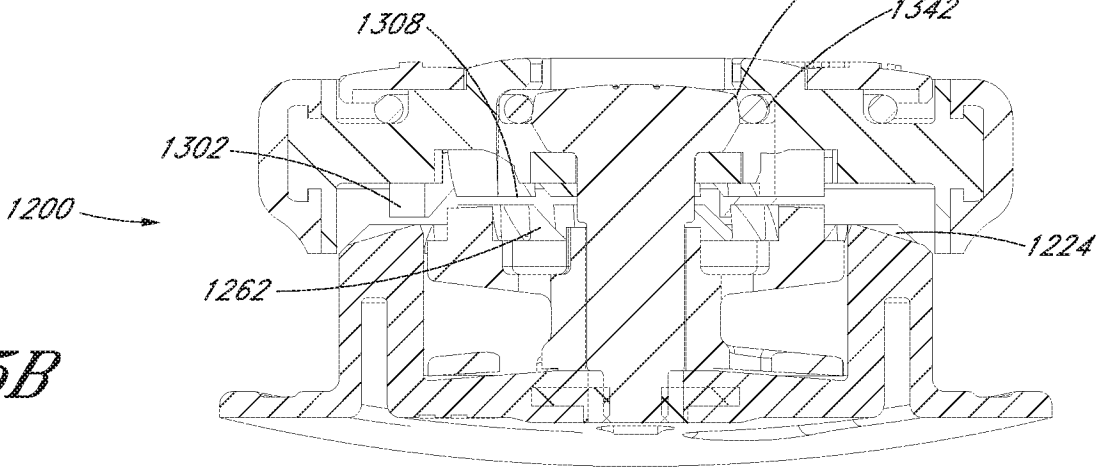
Figure 46:
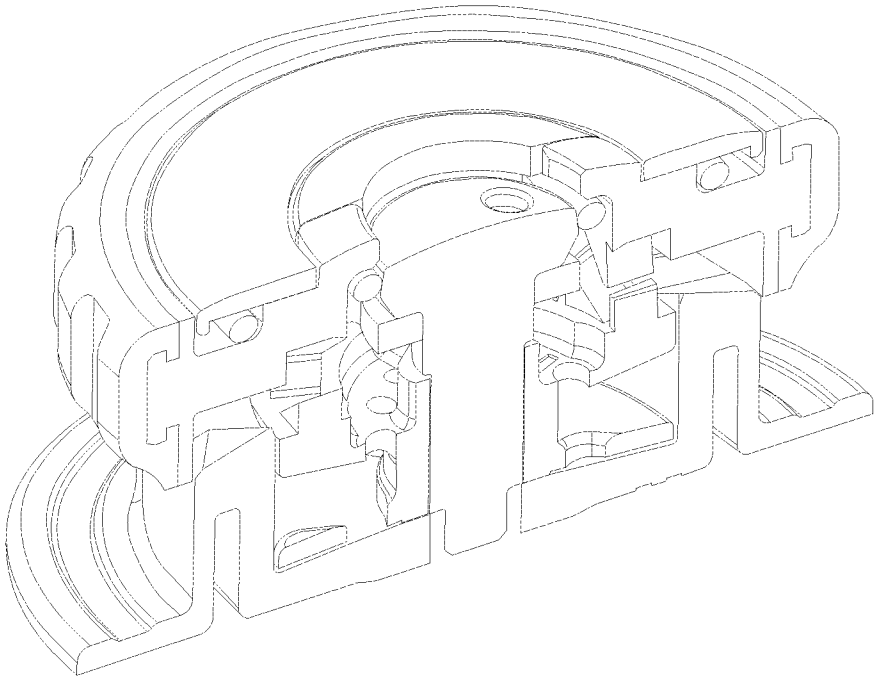
FIG. 46 is a cross sectional top perspective view of one embodiment of a tightening mechanism.

As shown in FIGS. 39 and 43B, an upper side of knob 1301 is configured to retain spring member 1340. Preferably, spring member 1340 is of a unitary construction and includes engagement arms 1342. In a preferred embodiment, engagement tabs 1322 of knob 1301 cooperate with outer side walls 1326 of central engagement projection 1324 to retain spring 1340. As shown in FIGS. 45A and 45B, engagement arms 1342 are preferably retained within knob 1300, but are secured such that they can move outwards in cavity 1334 when tightening mechanism 1200 is engaged or disengaged. FIG. 46 shows a top perspective cross sectional view of tightening mechanism 1200 in the disengaged position.

In a preferred embodiment, axial pin 1360 secures knob assembly 1300, spool 1240, and base member 1202. Axial pin 1360 is preferably made of a metallic or other material of sufficient strength to withstand the forces imparted on tightening mechanism 1200. Axial pin 1360 also preferably includes a multitude of regions with varying diameters, including a cap 1364 having an upper surface 1363, an upper side engagement surface 1364, a lower side engagement surface 1366, and a lower surface 1367. Upper side engagement surface 1364 preferably tapers outward from upper surface 1363 toward lower side engagement surface 1366. Lower side engagement surface 1366 preferably tapers inward from upper side engagement surface 1364 toward lower surface 1367. Preferably, the diameter of axial pin 1360 is largest along the circumference of the intersection of upper and lower side engagement surfaces 1364 and 1366. The diameter of upper surface 1363 is preferably greater than the diameter of lower surface 1367.

Upper surface 1363 of cap 1350 also preferably includes one or more engagement holes 1374 for rotating pin 1360 into threaded engagement with base member 1202. In other embodiments, a singe, centrally located engagement hole is used with a non-circular opening as will be understood by those of skill in the art. Upper surface 1363 may also include indicia 1376. In alternative embodiments, indicia 1376 is not included.

Disposed adjacent and just below cap 1362 is upper sleeve 1368. The diameter of upper sleeve 1368 is preferably smaller than the diameter of lower surface 1367. Pin body 1370 is preferably disposed adjacent and just below upper sleeve 1368. The diameter of pin body 1370 is preferably smaller than the diameter of upper sleeve 1360. Finally, threaded extension 1372 preferably extends downward from the lower surface of pin body 1370. Though extension 1372 is preferably threaded, other mating or engagement means may be used to couple pin 1360 to base 1202.

Axial pin 1360 includes multiple diameters to correspond to the varying internal diameters of the axial openings in knob 1300, spool 1240, and base member 1202, respectively. Corresponding diameters of these components helps stabilize the tightening mechanism 1200. Pin body 1370 is adapted to slidingly engage with inner side wall 1288 of seal opening 1286 of spool 1240. Upper sleeve 1368 is adapted to slidingly engage with inner wall 1330 of axial opening 1316 of knob 1301. Threaded extension 1372 couples with insert 1223 of base member 1202 to secure axial pin 1360 to base member 1202. As will be appreciated by those of skill in the art, axial pin 1360 may be permanently or removably attached to base member 1202. For example, an adhesive may be used, either alone or in combination with threads.

Figure 44A:
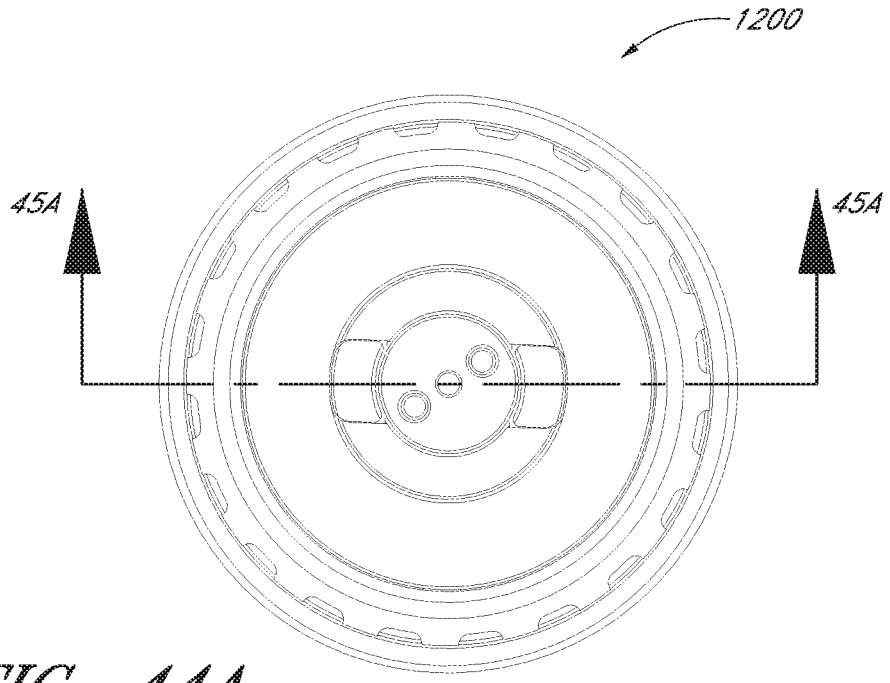
FIGS. 44A and 44B are top views of one embedment of a tightening mechanism, shown engaged in FIG. 44A and disengaged in FIG. 44B.
Figure 44B:
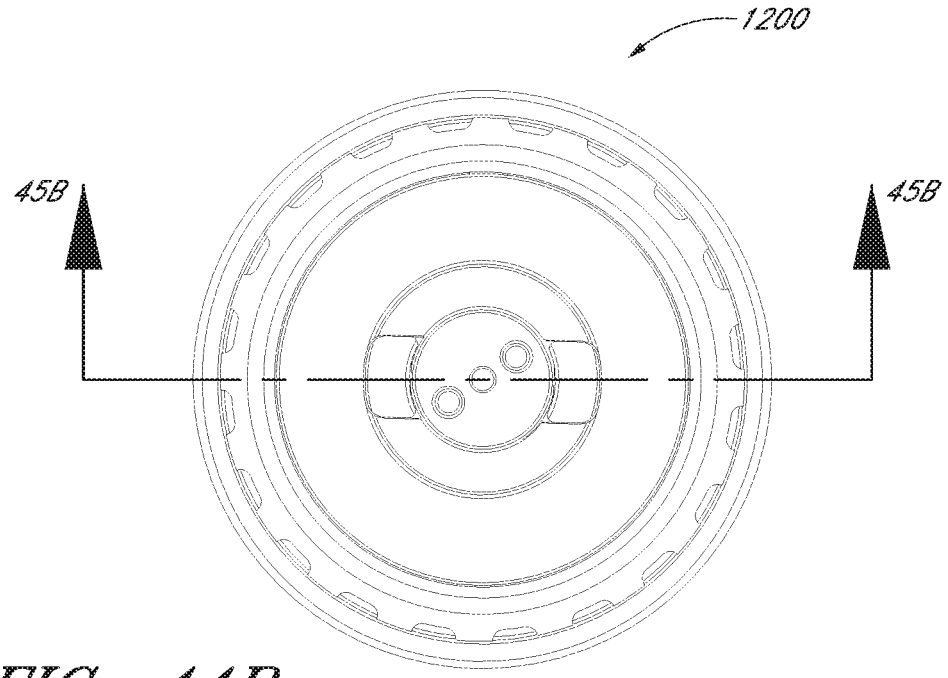

FIGS. 44A and 44B are top views tightening mechanism 1200 in engaged and disengaged positions, respectively. Referring now to FIGS. 45A and 45B, knob 1300 is illustrated to show its movability between the two positions, coupled or engaged (FIG. 45A) and uncoupled or disengaged (FIG. 45B). In the uncoupled position, lace 23 may be manually removed from spool 1240, by, for example, putting tension on lace 23 in a direction away from tightening mechanism 1200.

Advantageously, the diameter of upper sleeve 1368 of axial pin 1360 is larger than the inner diameter of axial opening 1286 of spool 1240. As such, upper sleeve 1368 of axial pin 1360 serves as an upper restraint for movement of spool 1240 along axis A, as can be seen in FIG. 45A. Movement along axis A is limited such that when knob 1300 is in the disengaged position, as shown in FIG. 45B, knob teeth 1308 disengage from spool teeth 1262, allowing free rotation of spool 1240 in the disengaged position. In this disengaged state, lace 23 is manually removed from spool 1240. In preferred embodiments, only a single control, e.g. knob 1300, is needed to actuate the tightening mechanism 1200. Push it in to tighten the lacing system 22 and pull it out to loosen the lacing system 22.

In a preferred embodiment, spring engagement arms 1342 engage upper side engagement surfaces 1364 of cap 1362 in the uncoupled position and engage lower side engagement surface 1366 in the coupled position. In the coupled position, arms 1342 engage lower side engagement surface 1366 to bias knob 1300 in the coupled position. In the uncoupled position, arms 1342 engage upper side engagement surface 1364 to bias knob 1300 in the uncoupled position. Although spring 1340 biases knob 1300 in the coupled and the uncoupled positions in this embodiment, other options are available as will be understood by one of skill in the art. For example, knob 1300 could be biased only in the engaged position, such that it can be pulled out to disengage spool 1240, however, as soon as it is released it slides back into the engaged position.

In a preferred embodiment, knob 1300 will be biased in each of the coupled and the uncoupled positions such that the user is required to either push the knob in or pull the knob out against the bias to engage or disengage, respectively, the tightening mechanism 1200. Advantageously, engaging and disengaging tightening mechanism 1200 is accompanied by a "click" or other sound to indicate that it has changed positions. Tightening mechanism 1200 may also include visual indicia that the mechanism is disengaged, such as a colored block that is exposed from under the knob when in the disengaged position. Audible and visual indications that the mechanism is engaged or disengaged contribute to the user friendliness of the lacing systems described herein.

Figure 47A:
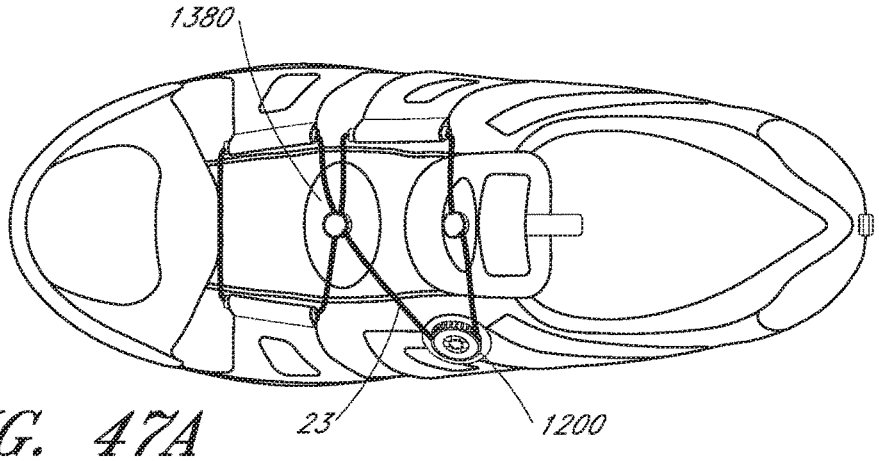
FIGS. 47A through 47C are various views of one embodiment of a lacing system mounted to an article of footwear.
Figure 47B:
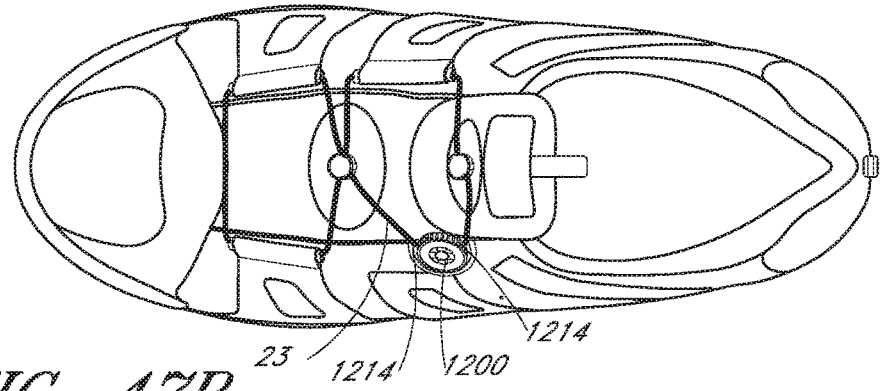
Figure 47C:
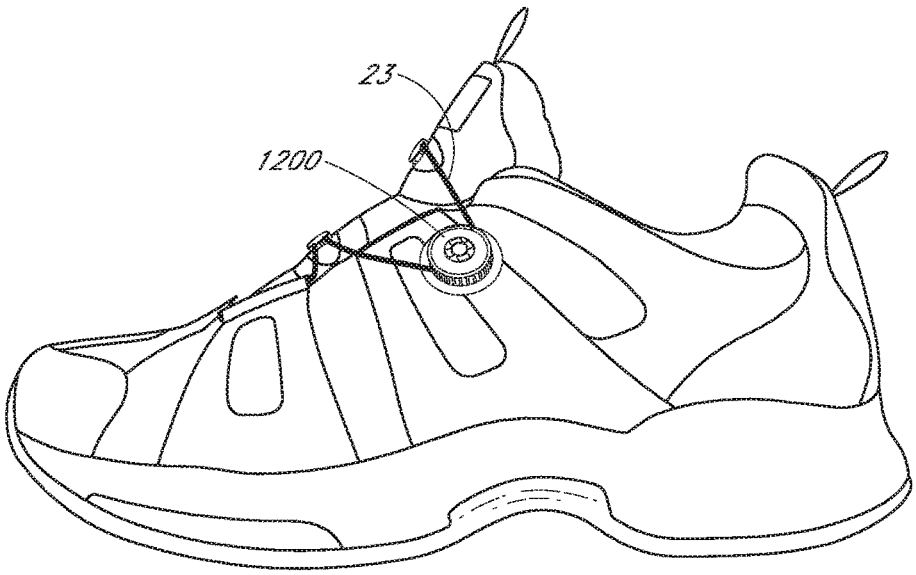

Tightening mechanism 1200 may be removably or securely mounted to a variety of locations on footwear, including the front, back, top, or sides. Base member 1202 illustrated in FIGS. 38A through 41 is preferably adapted to be attached to the side portion of a boot or shoe. FIGS. 47A through 47C show tightening mechanism 1200 securely stitched to the upper of a shoe near the eyestay of the shoe. Lace guides may be incorporated onto the base 1202 of the mechanism 1200, as shown in FIG. 47B, or they may be separate. In some embodiments, substantially all of tightening mechanism 1200 is secured within the footwear structure, leaving only knob 1300 and a small portion of housing 1203 exposed. In some such embodiments, lace holes 1214 are positions substantially along the axis of the eyestay to which the mechanism 1200 is attached (see FIG. 47B). When mechanism 1200 is attached in such a manner, it is preferable that flange 1204 extend in the direction opposite lace holes 1214, allowing mechanism 1200 to be positioned at or near the edge of the upper adjacent the tongue. Mechanism 1200 may also be positioned in other areas of the footwear including near the sole or toe portions. Lacing system 22 also includes tongue guides 1380 and lace guides 1392, as will be discussed in greater detail below.

Figure 48B:
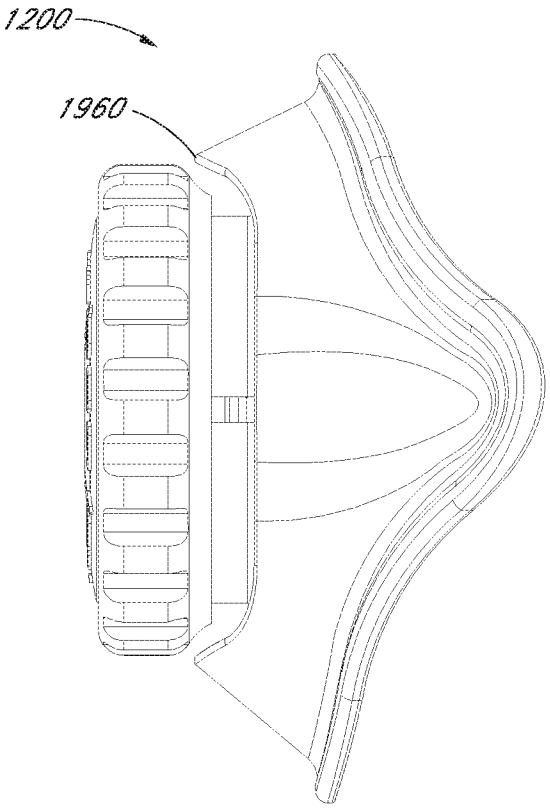
FIGS. 48A and 48B are side elevation views of one embodiment of a tightening mechanism.
Figure 49A:
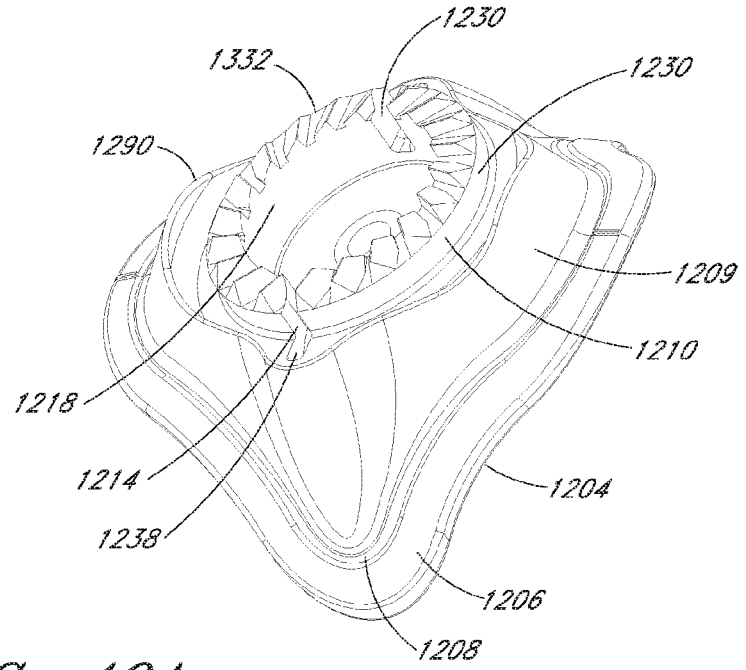
FIGS. 49A and 49B are front and back perspective views of one component of a tightening mechanism.
Figure 49B:
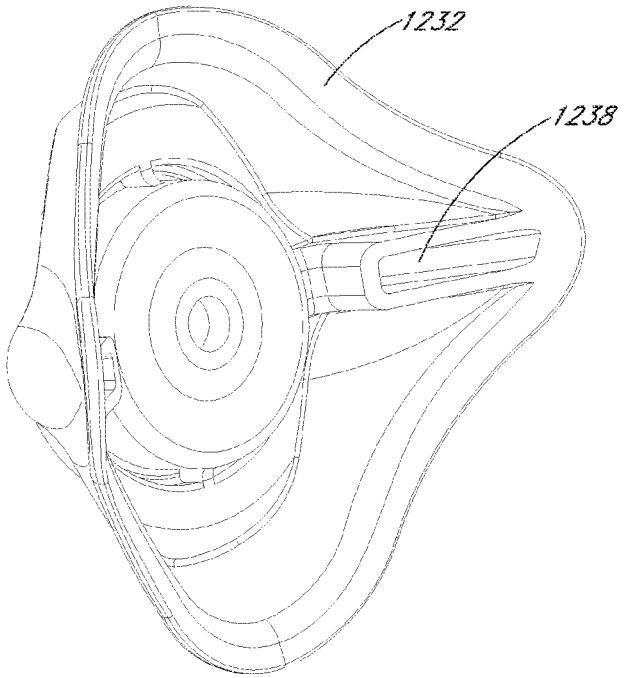

FIGS. 48B and 49B show an alternate preferred embodiment of tightening mechanism 1200 including a modified base member 1202. Base member 1202 is configured with a lower outer housing 1208 and an upper outer housing 1203. Lower outer housing 1208 slops outward from upper outer housing 1203 toward flange 1204. The upper most portion of lower outer housing 1208 preferably includes a protective lip 1290. In a preferred embodiment, protective lip 1290 extends partway up the outer engagement surface 1319 of knob assembly 1300 and only partway around the circumference of knob 1300. In alternative embodiments, the lip extends fully around the circumference of the knob. In still other embodiments, the lip extends only partway around the circumference of the knob, but extends upwards over substantially the entire width of the outer engagement surface 1319 of knob 1300.

Figure 48A:
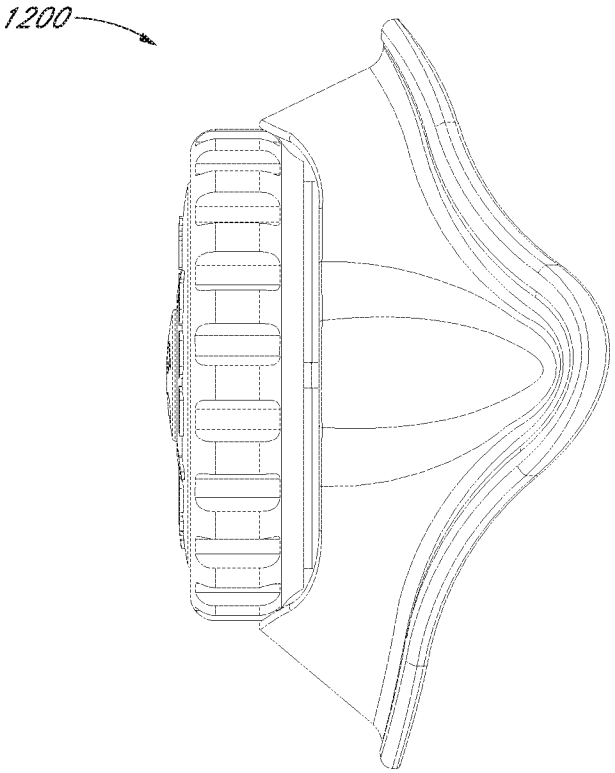

In the embodiment illustrated in FIGS. 48A and 48B, lower outer housing 1208 preferably includes lace pathways 1238 leading from rear surface 1232 of base member 1202 and ending at lace holes 1214. As shown in FIG. 48A, lace holes 1214 preferably extend through the upper surface 1332 of upper outer housing 1203. Flange 1204 and lower outer housing 1208 are shaped in a substantially curved manner to accommodate attachment surfaces with large inherent curvature, such as, for example on the rear portion of a boot or shoe.

Figure 50A:
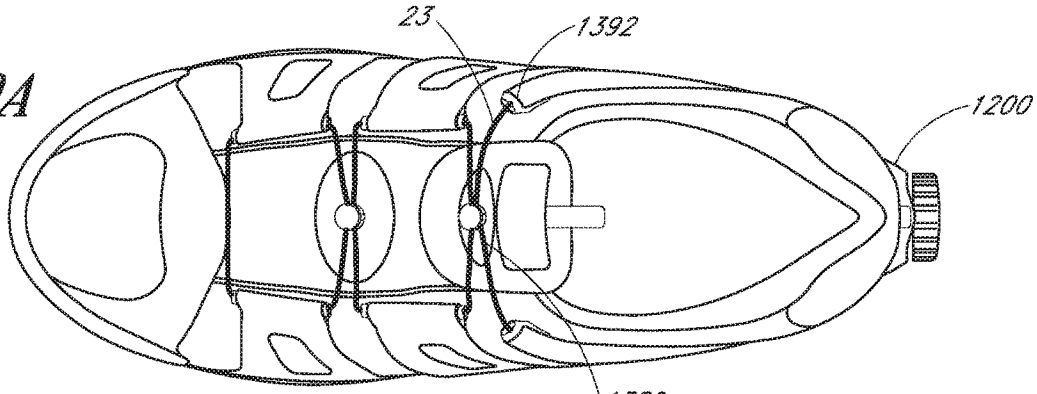
FIGS. 50A and 50B are various views of one embodiment of a lacing system mounted to an article of footwear.
Figure 50B:
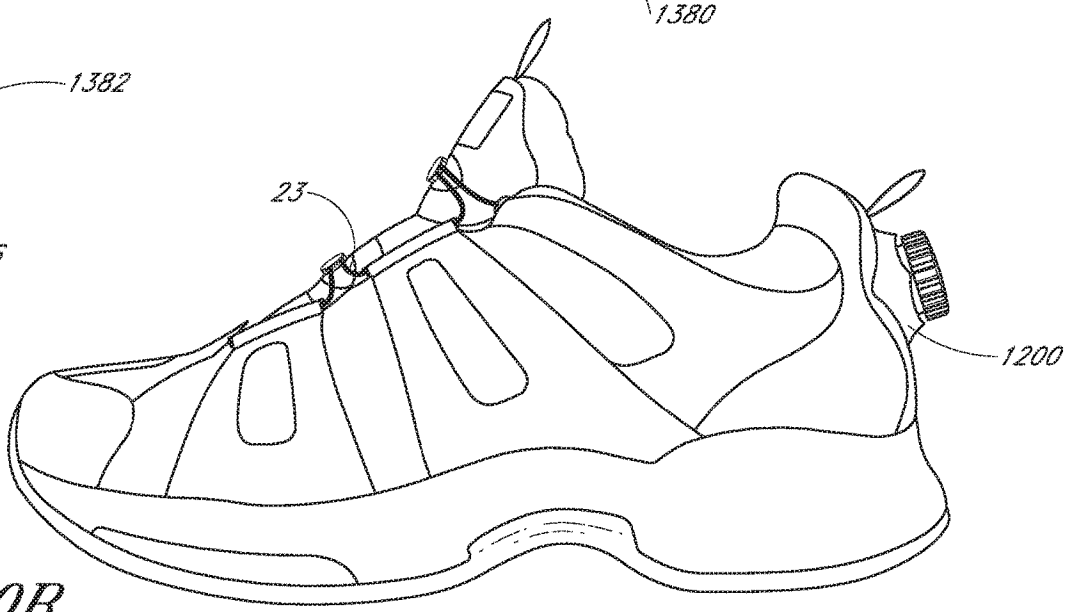

Base member 1202 illustrated in FIGS. 48A through 49B is preferably adapted to be attached to the rear portion of a boot or shoe. FIGS. 50A and 50B show tightening mechanism 1200 securely stitched to the rear portion of a shoe. Advantageously, after passing through the upper most tongue guide 1380, lace 23 enters lace guide 1392 and is directed around the ankle portion of the shoe toward tightening mechanism 1200. Lace guide 1392 is preferably made of a low sliding resistance polymer, such as Teflon or nylon, and preferably includes rounded edges. The upper most lace guides 1392 preferably have only one entrance point on each side of the shoe, the exit point being directly coupled to the lace pathway 1338 of rear mounted tightening mechanism 1200.

Figure 51:
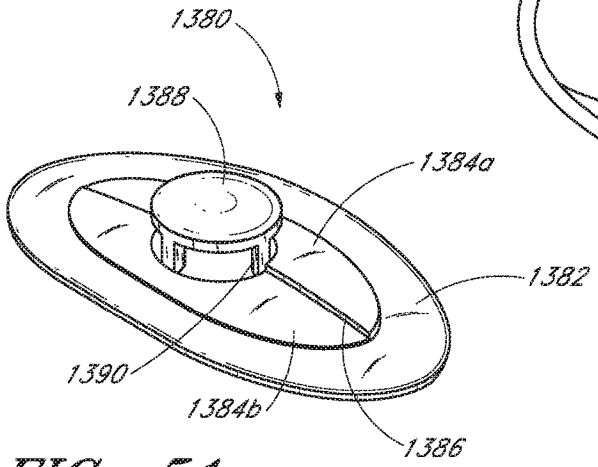
FIG. 51 is a top perspective view of a component of a lacing system.

Lacing system 22 preferably includes tongue guides 1380, shown in greater detail in FIG. 51. Tongue guide 1308 preferably includes mounting flange 1382, sliding surfaces 1384*a* and 1384*b* and central cap 1388. Central cap 1388 is preferably disposed in a raised manner above sliding surface 1384 by one or more support legs 1390. Sliding surfaces 1384*a* and 1384*b* are preferably disposed in different planes such that a generally vertical ledge 1386 is formed therebetween. The different planes of sliding surface 1384 helps reduce friction by limiting lace 23 from sliding against itself. Mounting flange 1382 may be sewn under one or more of the outer layers of shoe tongue or to the outer surface of the tongue. In alternative embodiments, tongue guide 1380 is attached to the tongue bye adhesive, rivets, etc., or combinations thereof, as will be understood by those of skill in the art. Support legs 1390 are preferably angled to accommodate the different ingress and egress directions of lace 23 as it enters the central cap portion 1388.

As with the other components of lacing systems described herein, the tightening mechanism 1200, the tongue guides, and the other lace guides described above in connection with tightening mechanism 1200 can be made of any suitable material, and can be attached to footwear in any suitable manner. The various component parts of the lacing system may be used in part or in whole with other components or systems described herein. As discussed above, lace 23 may be formed from any of a wide variety of polymeric or metal materials or combinations thereof, which exhibit sufficient axial strength and suppleness for the present application. In one preferred embodiments, lace 23 comprises a stranded cable, such as a 7 strand by 7 strand cable manufactured of stainless steel. In order to reduce friction between lace 23 and the guide members through which lace 23 slides, the outer surface of the lace 23 is preferably coated with a lubricous material, such as nylon or Teflon. The coating also binds the threads of the stranded cable to ease insertion of the lace into the lace guides of the system and attachment of the lace to the gear mechanism within lacing device 1200. In a preferred embodiment, the diameter of lace 23 is in the range of from about 0.024 inches to about 0.060 inches inclusive of the coating of lubricous material. More preferably, the diameter of lace 23 is in the range of from about 0.028 to about 0.035. In one embodiment, lace 23 is preferably approximately 0.032 inches in diameter. A lace 23 of at least five feet in length is suitable for most footwear sizes, although smaller or larger lengths could be used depending upon the lacing system design. For example, lacing systems for use with running shoes may preferably use lace 23 in the range from about 15 inches to about 30 inches.

Figure 52B:
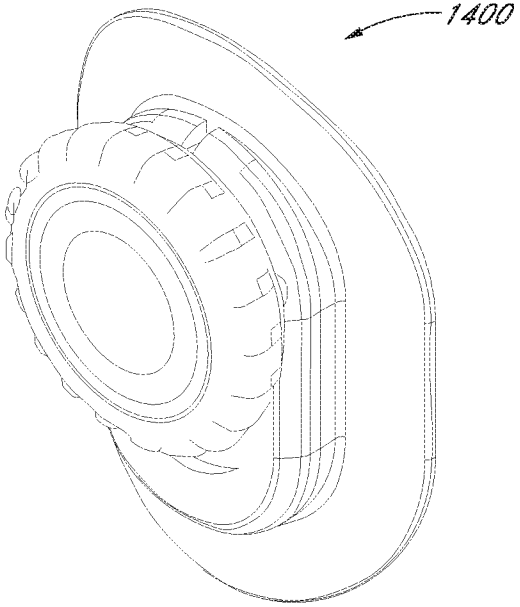
FIGS. 52A and 52B are front and perspective views, respectively, of one embodiment of a tightening mechanism.
Figure 52A:
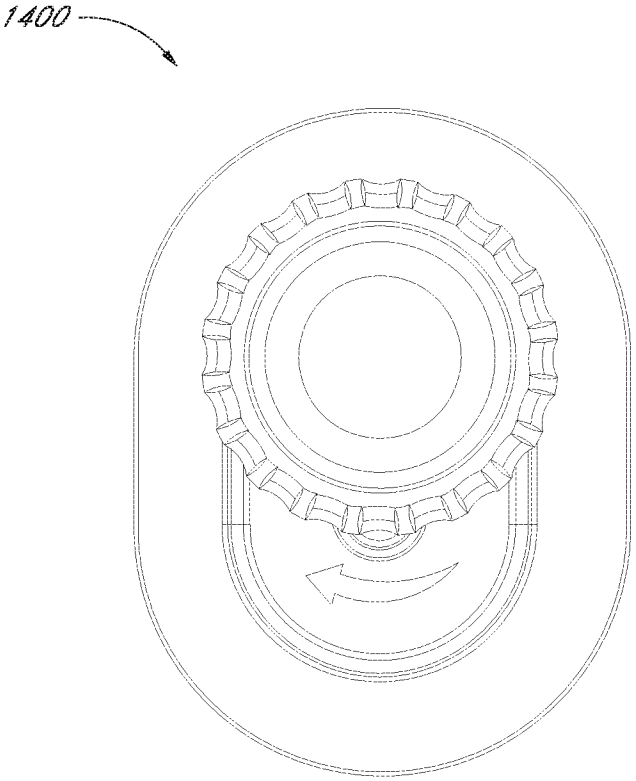

With reference to FIGS. 52A through 59B, additional embodiments of a lacing system 22 are shown. FIGS. 52A and 52B are top and perspective views, respectively, of an alternative tightening mechanism 1400. Tightening mechanism 1400 may also be referred to herein as a lacing device, a lace lock, or more simply as a lock. As with other embodiments presented herein, tightening mechanism 1400 may be may be configured for placement in any of a variety of positions on the footwear including in the ankle region (for example on snow board boots or hiking boots with ankle support), on the tongue (if the footwear includes a tongue), on the instep area of the footwear, or on the rear of the footwear. It is preferably molded out of any suitable material, as discussed above, but in one embodiment, comprises nylon, metal, and rubber. As in other embodiments, any suitable manufacturing process that produces mating parts fitting within the design tolerances is suitable for the manufacture of tightening mechanism 1400 and its components.

Figure 53:
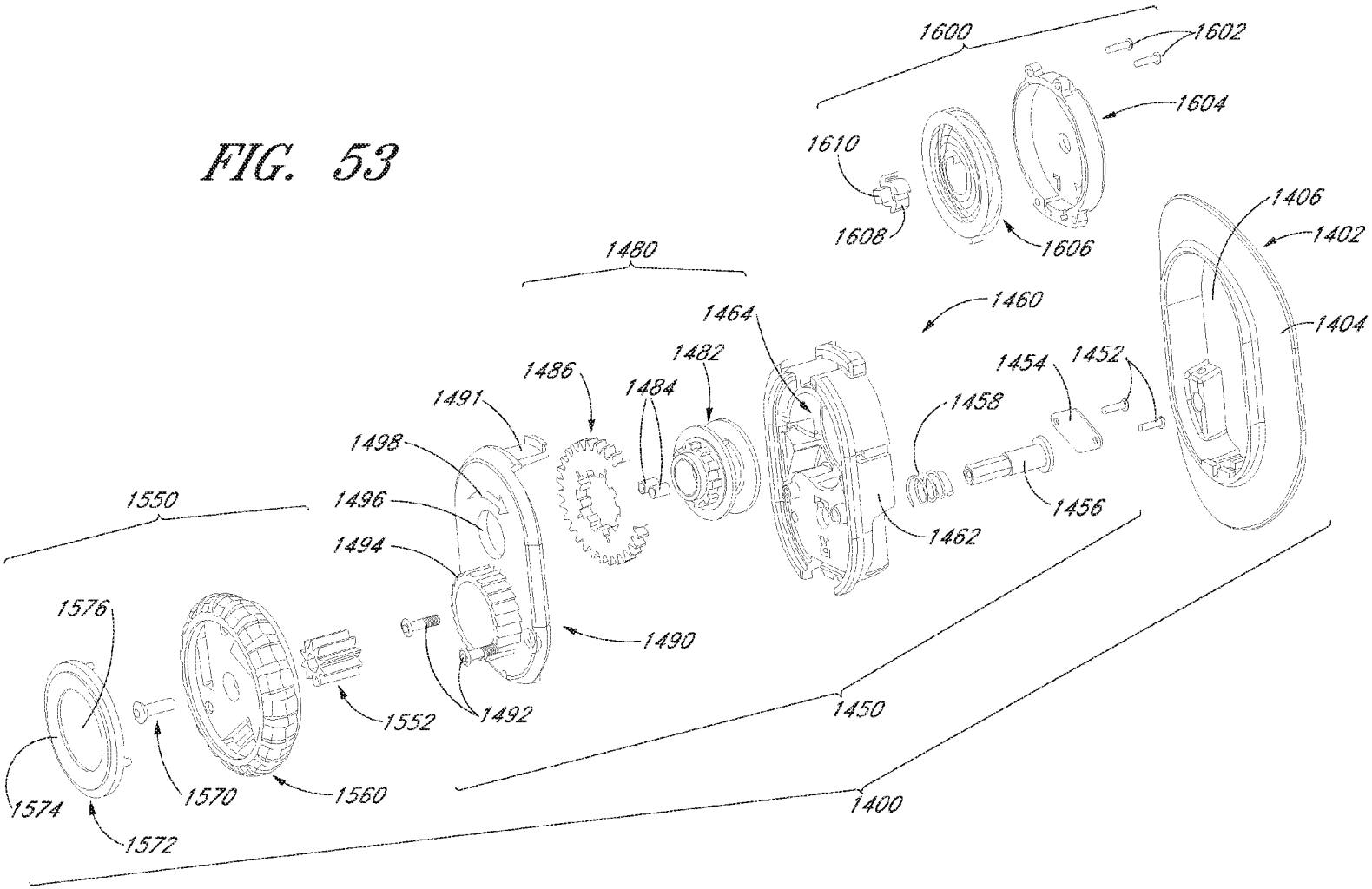
FIG. 53 is an exploded top perspective view of one embodiment of a tightening mechanism.

FIG. 53 illustrates a top perspective exploded view of one embodiment of a tightening mechanism 1400. The embodiment of FIG. 53 includes a base member (or bayonet) 1402, a housing assembly 1450 including a spool assembly 1480, and a control mechanism, such as a rotatable knob assembly 1550. Housing assembly 1450 is configured to mount within inner cavity 1406 of bayonet 1402 while spool assembly 1480 is generally configured to be placed within an inner cavity 1462 of housing 1460. Knob assembly 1550 can be mechanically coupled to housing 1460 to provide tightening mechanism 1400. In some embodiments, tightening mechanism 1400 further includes a coiler assembly 1600. Rotatable knob assembly 1550 is preferably slideably movable along an axis A between two positions with respect to housing 1560.

In many embodiments, the spool assembly 1480 is off axis from the knob assembly 1550. This allows for a mechanically geared tightening mechanism 1400 which maintains a low profile relative to the surrounding mounting surface.

Bayonet 1402 may include a mounting flange 1404 useful for mounting tightening mechanism 1400 to the outside structure of an article of footwear. Preferably, flange 1404 extends circumferentially around inner and outer sections 1412 and 1414. In alternative embodiments, flange 1404 extends only partially around the circumference of sections 1412 and 1414 and may comprise one or more distinct portions. Though flange 1404 is shown with an ovular shape, it may also be rectangular, circular, square, or any of a number of other regular or irregular shapes. Flange 1404 may be similar to flange 1204 disclosed herein above.

Mechanism 1400 may be mounted on the outer surface of the footwear or underneath some or all of the outer structure of the footwear by means of stitching, hook and loop fasteners, rivets, or the like. Though tightening mechanism 1400 need not be manufactured in various components, it may be advantageous to do so. For example, portions of tightening mechanism 1400 may be manufactured at various locations and later brought together to form the completed mechanism. In one instance, bayonet 1402 may be fixed to the footwear independent from the rest of tightening mechanism 1400. The footwear with bayonet 1402 may then be transported to one or more locations where the rest of tightening mechanism 1400 is installed. In addition, modularity allows a user of an article incorporating mechanism 1400 to replace individual components when needed.

As with other embodiments disclosed herein, tightening mechanism 1400 may be mounted in a number of different positions on the footwear, including, but not limited to, on the tongue, on the ankle portion in the case of a high top such as a hiking boot or a snow board boot, on the instep of the footwear, or on the rear of the footwear. If the footwear includes an inner boot, tightening mechanism may be mounted thereon rather than on the surface of the footwear. If the footwear includes a canopy or other covering across the instep area, the mechanism 1400 may be mounted thereon or adjacent thereto. Embodiments of tightening mechanism 1400 may be used with some or all of the various lacing components disclosed herein above. For example, tightening mechanism could be used with the multi-zone lacing system 800 shown in FIG. 28. Embodiments of mechanism 1400 could be used in place of either first 802 or second 804 lace tightening mechanisms which are shown arranged to tighten first 23*a* and second 23*b* laces.

Referring now to FIGS. 54A through 54F, there are shown a number of different views of the bayonet 1402. Side views, such as 54E and 54I, are representative of both sides of the illustrated embodiment. Generally, tightening mechanism 1400 is symmetrical along its central axis (except for indicia located in various places on the mechanism). This embodiment of bayonet 1402 is configured for use at a location remote from the tongue, or midline of the lacing system, for instance on the side of the footwear or on the rear of the footwear. Inner section 1412, disposed on the side facing the footwear, preferably extends further from flange 1404 than does section 1412 to accommodate lace exit holes 1410. FIG. 54A is a rear view of bayonet 1402. FIG. 54B is a perspective rear view of bayonet 1402 showing lace entry holes 1410. FIG. 54C is a top view of bayonet 1402 showing lace exit holes 1408. Lace 23 may enter through lace entry holes 1410 and exit lace exit holes 1408 to join with housing 1450 (see FIG. 55 for housing 1450). FIG. 54D is a perspective front view of bayonet 1402. FIG. 54E is a side view of bayonet 1402 that shows lace entry hole 1410 disposed on inner section 1412 of bayonet 1402. FIG. 54F is an end view of bayonet 1402 showing entry holes 1410. FIG. 54F also shows the general arrangement of inner section 1412 and outer section 1414 for a particular embodiment.

In a preferred embodiment, lace holes mounted on the rear or inside of bayonet 1402 facilitate lace guides disposed inside the structure of the footwear. For cosmetic or structural reasons, it may be valuable to have the lace 23 completely hidden from the surface of the footwear. As will be understood, lace entry holes 1410 could easily be located at various other positions on inner section 1412 with similar effects.

Figure 54I:
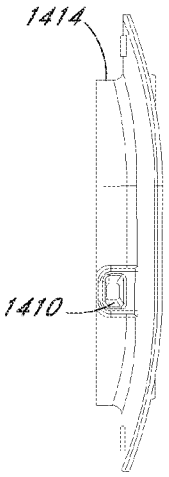
Figure 54H:
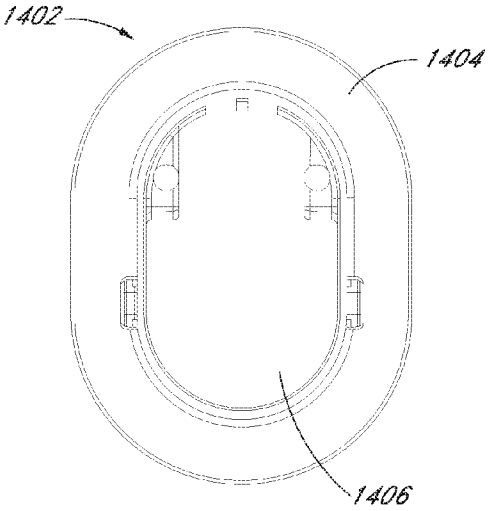
Figure 54K:
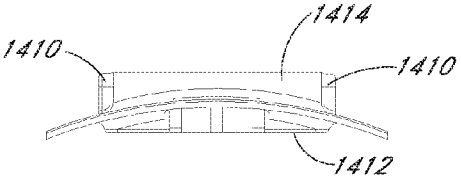
Figure 54G:
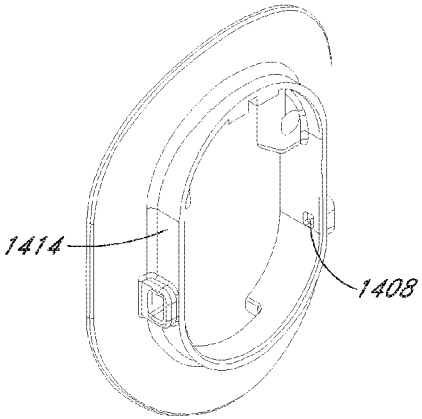
Figure 54J:
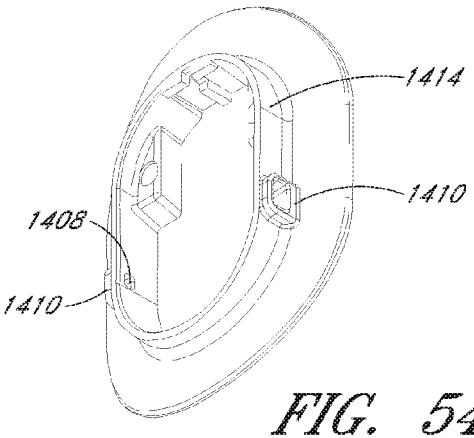

FIGS. 54I through 54K illustrate various views of an alternative bayonet 1402. This embodiment may preferably be used for a tongue mounted, front mounted, or midline centered tightening mechanism or in another location in which it might be advantageous for the lace 23 to rest on the outer surface of the structure to which tightening mechanism 1400 is mounted. Side lace entry ports 1410 are located on outer section 1414 of bayonet 1402. Accordingly, outer section 1414 is deeper than inner section 1412. Lace exit holes 1408 again allow lace 23 to pass through bayonet 1402 to couple with housing 1450. It is also possible to form bayonet 1402 with equally deep inner 1412 and outer 1414 sections.

Figure 55B:
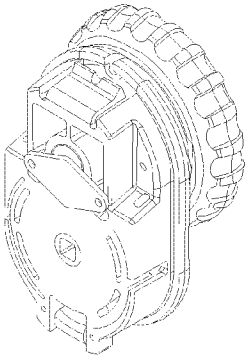
FIGS. 55A through 55F are various views of an assembled component of an embodiment of a tightening mechanism.
Figure 55D:
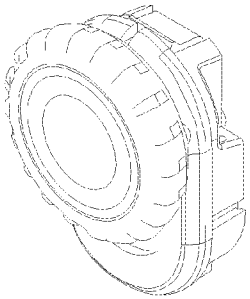
Figure 55E:
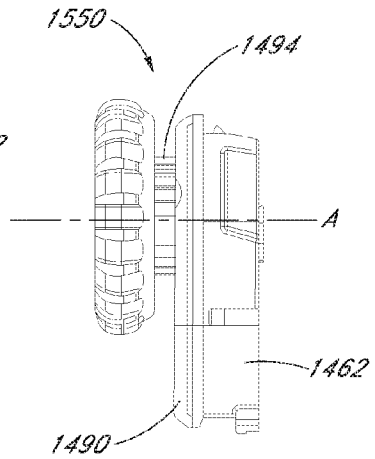
Figure 55F:
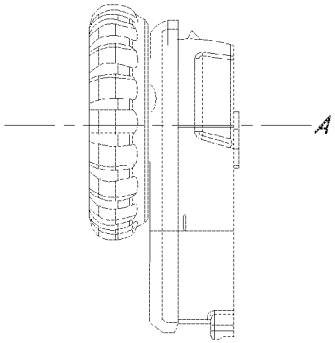
Figure 55A:
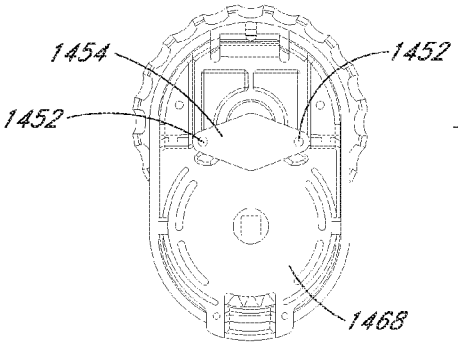
Figure 55C:
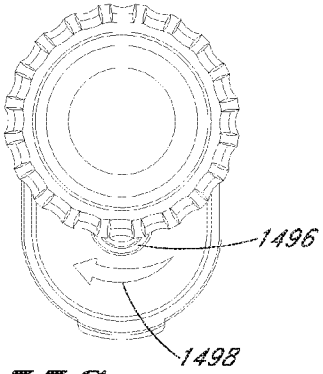
Figure 56B:
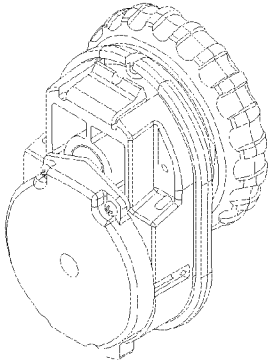
FIGS. 56A through 56F are various views of an assembled component of an embodiment of a tightening mechanism.
Figure 56D:
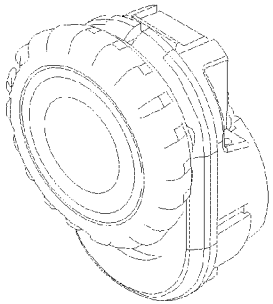
Figure 56E:
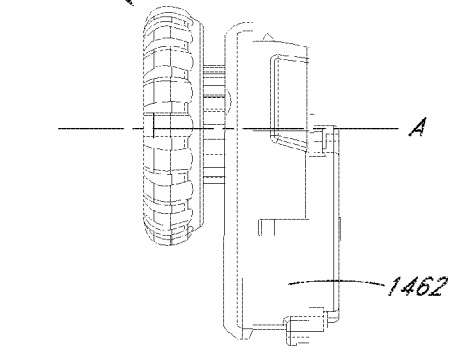
Figure 56F:
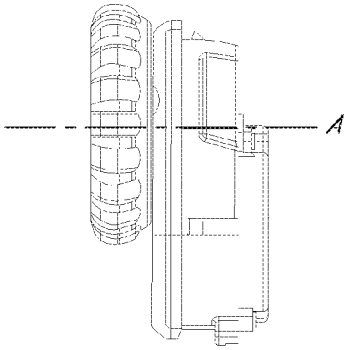
Figure 56A:
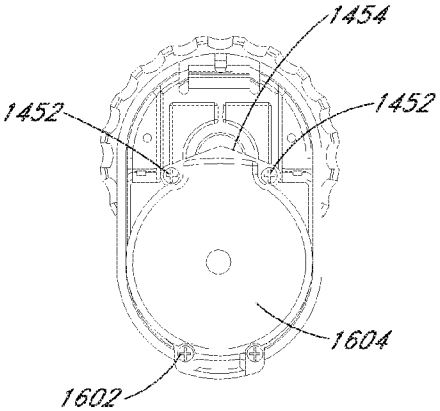
Figure 56C:
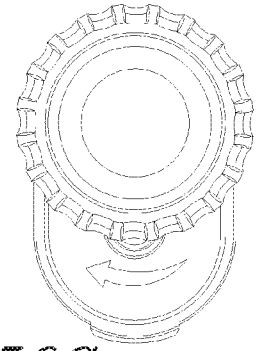

FIGS. 55A through 55D illustrate one embodiment of housing 1450 coupled to knob assembly 1550. FIG. 55A is a rear view showing backing plate 1468 secured to housing 1462. In the illustrated embodiment, backing plate 1468 is removeably secured with screws. However, in alternative embodiments, one may use any of a number of other securing means, both removable or permanent, including rivets, snaps, or pins as will be understood by one of skill in the art. Backing plate 1468 provides a backing to cavity 1464 in housing 1462. As shown in FIG. 53, spool 1482 is configured to mount within cavity 1464 and, in this embodiment, rest against backing plate 1468. Similarly, plate 1454 is secured to the rear side of housing 1462 to provide a seat for shaft 1456 (shown in FIG. 53). The upper surface of housing 1464 is enclosed by cover 1490 which includes access hole 1496 and housing teeth 1492. In a preferred embodiment, cover 1490 is removeably secured to housing 1462 by a combination of screws 1492 and a lipped flange 1491. Other securing means may be used as disclosed herein above with respect to this and other embodiments. Preferably, cover 1490 is removeably secured to allow access to the inner components of tightening mechanism 1400, e.g. spool assembly 1480. Such a cover facilitates replacement of the various components and may ease replacement of the lace 23 in the housing 1460 and the spool 1480.

FIGS. 56A through 56D illustrate another embodiment of housing 1450 coupled to knob assembly 1550 and differ from FIGS. 55A through 55D only in that this illustrated embodiment includes a coiler assembly 1600. As illustrated in FIG. 53, coiler assembly consists of a spring boss 1608 positioned in the center of power spring 1606. Boss 1608 and spring 1606 are positioned within coiler backing 1604 which is, in turn, secured to housing 1462 by coiler screws 1602. Coiler assembly 1600 works in a similar fashion to the coiling systems described herein above. Central boss post 1610 engages centered engagement section 1500 of spool 1482. As such, as spool 1482 is rotated through interaction with pinion gear 1552 of knob assembly 1550, so too is the spring boss 1608. As discussed above, spring boss 1608 is coupled to power spring 1606 such that pulling lace 23 from spool 1482 biases the spring 1606. When the lace 23 is released, spring 1606 rotates spool 1482 to take up excess lace length.

In a first, also referred to herein as a coupled or an engaged position (shown in FIGS. 55F and 56F), knob 1550 is mechanically engaged with an internal gear mechanism located within housing assembly 1460, as described more fully below. In a second, also referred to herein as an uncoupled or a disengaged position (shown in FIGS. 55E and 56E), knob 1550 is disposed upwardly or outwardly with respect to the first position and is mechanically disengaged from the gear mechanism. Disengagement of knob 1550 from the internal gear mechanism is preferably accomplished by pulling the control mechanism outward, away from mounting flange 1404, along axis A. Alternatively, the components may be disengaged using a button or release, or a combination of a button and rotation of knob 1550, or variations thereof, as will be appreciated by those of skill in the art and as herein described above.

Figure 57A:
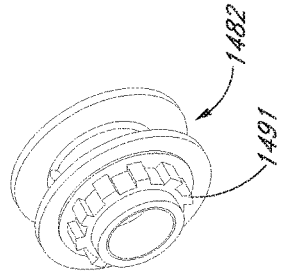
FIGS. 57A and 57F are various views of one component of an embodiment of a tightening mechanism.
Figure 57C:
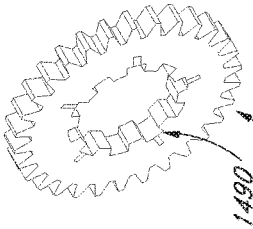
Figure 57B:
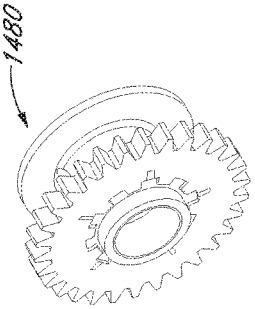
Figure 57D:
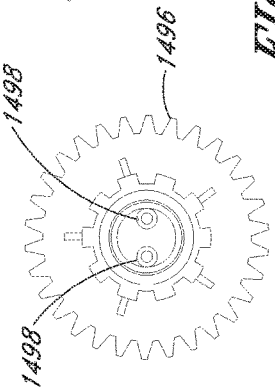
Figure 57D:
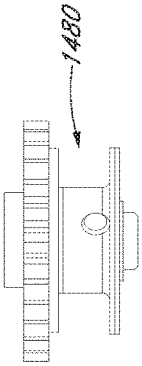
Figure 57E:
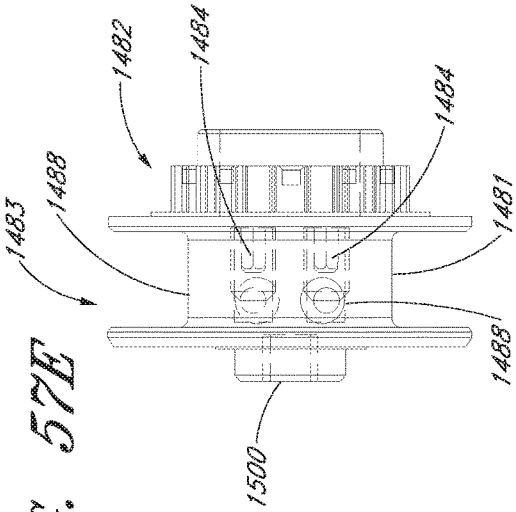
Figure 57F:
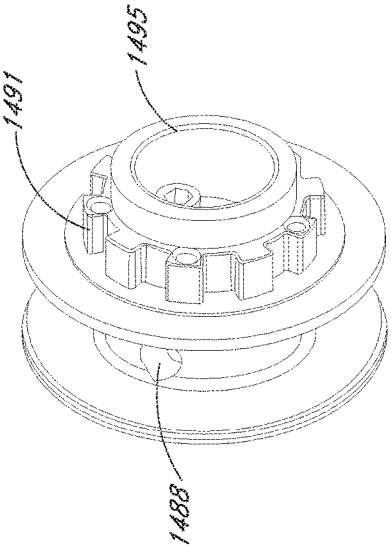

Referring now to FIGS. 57A through 57F, elements of the spool assembly 1480 are shown in greater detail. Spool 1482 includes annular groove 1483. The base of spool 1482 is defined by cylindrical wall 1481. In many embodiments, spool 1482 includes at least one lace entry hole 1488, often it includes three or more holes 1488, and most preferably, it includes two holes 1488. Lace 23 may be removeably secured to spool 1482 with, for example, spool screws 1484 which pass through spool screw holes 1498 (FIG. 57C). Though it is preferable for each screw 1484 to secure an individual lace end, it is also possible for a single screw to secure multiple lace ends. Other means for releasably securing the lace to the spool are also envisioned as disclosed above. For example, lace 23 may be tied to spool 1482 as discussed with above in reference to spool 1240 of tightening mechanism 1200. It is also possible for lace 23 to be permanently affixed to the spool by welding or the like as will be appreciated by those of skill in the art. Releasable laces advantageously allow for replacement of individual components of tightening mechanism 1400 rather than replacement of the entire structure to which it is attached.

The cylindrical wall 1481 has a diameter of generally less than about 0.75 inches, often no more than about 0.5 inches, and, in one embodiment, the diameter of the cylindrical wall 1481 is approximately 0.4 inches.

The depth of the annular groove 1483 is generally less than a ½ inch, often less than ⅜ of an inch, and, in certain embodiments, is no more than about a ¼ inch. In one embodiment, the depth is approximately 3/16 of an inch. The width of the annular groove 1483 at about the opening thereof is generally no greater than about 0.25 inches, and, in one embodiment, is no more than about 0.13 inches.

Spool assembly 1480 preferably includes spool 1482 and main gear 1486. Main gear 1486 and spool 1482 are shown manufactured separately and later mechanically attached. Inner attachment teeth 1490 are configured to matingly engage with spool teeth 1491 to secure main gear 1486 to spool 1482. In alternative embodiments, main gear 1486 and spool 1482 are manufactured from the same piece. Spool assembly 1480 may comprise a metal. Alternatively, it may comprise a nylon or other rigid polymeric material, a ceramic, or any combination thereof.

Spool screw holes 1498 are located in spool cavity 1495. Access to holes 1498 is facilitated by access hole 1496 and cover 1490. As such, lace 23 can be released from spool 1482 without fully disassembling housing 1450. Rather, removal of knob assembly 1550 permits access to access hole 1496. In some embodiments, knob 1560 is sized to allow access to access hole 1496 without removal of knob assembly 1550.

Knob assembly 1550 (FIG. 58), preferably includes a cap 1572, a knob screw 1570, a knob 1560, and a pinion gear 1552. When engaged with knob 1560, cap 1572 loosely secures knob screw 1570 such that screw 1570 remains with knob assembly 1550 when the assembly is removed from the housing assembly 1450. Cap 1572 may include indicia 1574 or may present a smooth surface. Advantageously, cap 1572 includes knob screw access hole 1576 such that knob screw 1570 may be engaged by an appropriate tool without removal of cap 1572 from knob 1560. Pinion gear 1552 is configured to mount within cavity 1564 of knob 1560.

Figure 58:
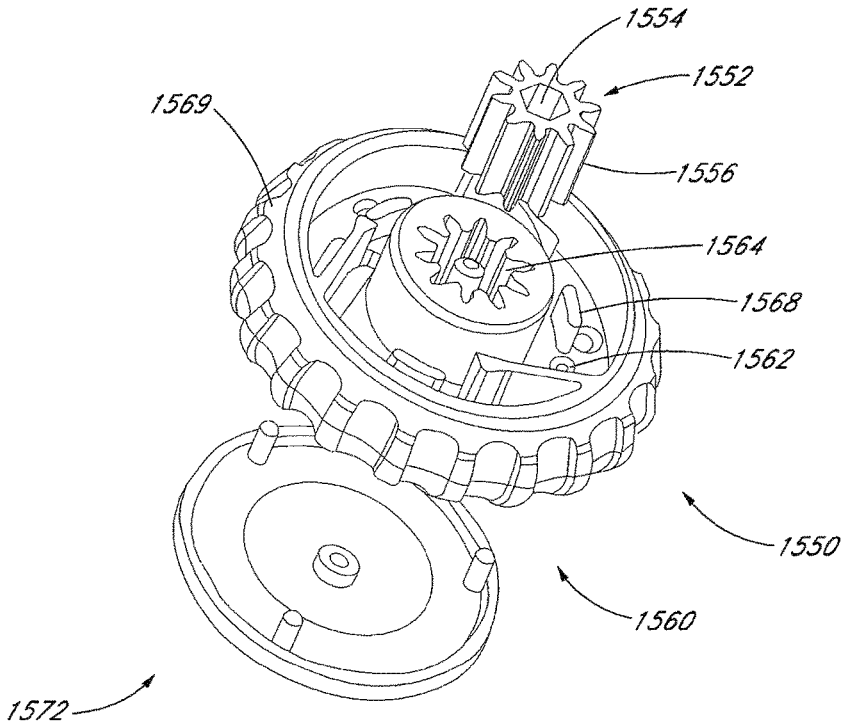
FIG. 58 is a bottom perspective exploded view of one component of an embodiment of a tightening mechanism.
Figure 59A:
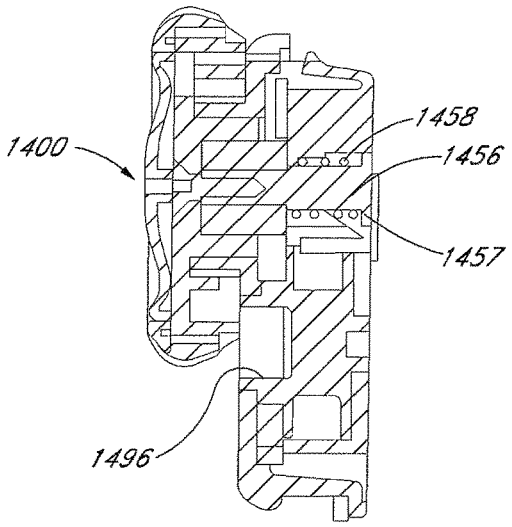
FIGS. 59A and 59B are cross sectional side views of a component of an embodiment of a tightening mechanism.
Figure 59B:
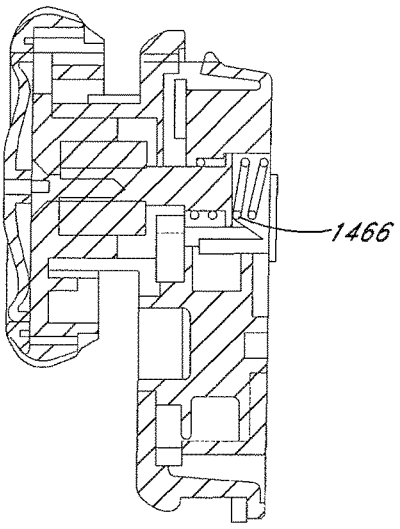

As shown in FIG. 58, knob 1560 preferably includes pawls 1562 for engagement with housing teeth 1494. Pawls 1562 and housing teeth 1494 are preferably configured to limit the direction of rotation of knob 1560. Tightening mechanism 1400 may be manufactured for right or left handed operation as discussed above with reference to other embodiments. The illustrated embodiment is configured for right handed operation. Indicia are used on the components to ensure that right handed components are used with other right handed components. Knob 1560 may also include protrusions 1568 which prevent mounting a right handed knob assembly on a left handed housing. Gripping surface 1569 of knob 1560 may be manufactured separately or together with knob 1560. Preferably, an over mold of rubber, or some other friction enhancing material, is used to provide for increased traction on the knob 1560.

Main gear 1486 includes gear teeth 1496 for engagement with pinion gear teeth 1556. The ratio of the main gear to the pinion gear is a factor in determining the amount of mechanical advantage achieved by tightening mechanism 1400. In some embodiments, this gear ratio will be greater than about 1 to 1, often at least about 2 to 1, in one embodiment at least about 3 to 1, and can be up to between about 4 to 1 or about 6 to 1. In many embodiments of the present invention, main gear 1486 will have an outside diameter of at least about 0.5 inches, often at least about 0.75 inches, and, in one embodiment, at least about 1.0 inches. The outside diameter of main gear 1486 will generally be less than about 2 inches, and preferably less than about 1.5 inches. In many embodiments, the pinion gear 1552 with have an outside diameter of at least about ¼ inches, often at least about 0.5 inches, and, in one embodiment, at least about % inches. The outside diameter of pinion gear 1552 will generally be less than about 1.0 inches, and preferably less than about 0.4 inches.

In many embodiments of the present invention, the knob 1560 will have an outside diameter of at least about 0.75 inches, often at least about 1.0 inches, and, in one embodiment, at least about 1.5 inches. The outside diameter of the knob 1560 will generally be less than about 2.25 inches, and preferably less than about 1.75 inches.

The lace for cooperating with the forgoing cylindrical wall 1481 is generally small enough in diameter that the annular groove 1483 can hold at least about 14 inches, preferably at least about 18 inches, in certain embodiments at least about 22 inches, and, in one embodiment, approximately 24 inches or more of length, excluding attachment ends of the lace. At the fully wound end of the winding cycle, the outside diameter of the cylindrical stack of wound lace is less than about 100% of the diameter of the knob 1560, and, preferably, is less than about 75% of the diameter of the knob 1560. In one embodiment, the outer diameter of the fully wound up lace is less than about 65% of the diameter of the knob 1560.

Mechanical advantage is achieved by a combination of gear ratio and the effective spool diameter to knob ratio. This combination of ratios results in larger mechanical advantage than either alone while maintaining a compact package. In some embodiments of the present invention, the combined ratios will be greater than 1.5 to 1, in one embodiment at least about 2 to 1, in another about 3 to 1, and in another about 4 to 1. The rations are generally less than about 7 to 1 and are often less than about 4.5 to 1.

The maximum effective spool diameter less than about 75% of the diameter of the knob 1300 even when the spool is at its fully wound maximum, maintains sufficient leverage so that gearing or other leverage enhancing structures are not necessary. As used herein, the term effective spool diameter refers to the outside diameter of the windings of lace around the cylindrical wall 1252, which, as will be understood by those of skill in the art, increases as additional lace is wound around the cylindrical wall 1252.

In one embodiment, approximately 24 inches of lace will be received by 15 revolutions about the cylindrical wall 1252. Generally, at least about 10 revolutions, often at least about 12 revolutions, and, preferably, at least about 15 revolutions of the lace around the cylindrical wall 1252 will still result in an effective spool diameter of no greater than about 65% or about 75% of the diameter of the knob 1301.

In general, laces having an outside diameter of less than about 0.060 inches, and often less than about 0.045 inches will be used. In certain preferred embodiments, lace diameters of less than about 0.035 will be used.

FIGS. 60A and 60B illustrate engaged and non-engaged states of the housing assembly 1450 and knob assembly 1550. Knob assembly 1550 is mechanically coupled to housing assembly via shaft 1456 and knob screw 1570. Spring 1458 engages housing 1462 on one end and shaft cap 1457 on the other. When knob assembly 1550 is coupled to shaft 1456, spring 1458 biases knob assembly 1550 in the engaged position such that pawls 1562 of knob 1560 engage housing teeth 1494 of housing cover 1490 and pinion gear teeth 1556 of pinion gear 1552 engage main gear teeth 1496 of main gear 1486.

In the non-engaged or disengaged position, shaft cap 1457 engages flange 1466 to secure knob assembly 1550 in the disengaged position. Pushing knob 1560 back towards housing assembly 1450 disengages flange 1466 and knob assembly 1550 re-engages with housing assembly 1450. In some embodiments, pawls 1562 remain engaged with housing teeth 1494 to prevent rotation of the knob 1560 in the reverse direction even in the disengaged position. However, pinion gear 1552 becomes disengaged from the main gear 1486 in the disengaged position, allowing free rotation of spool assembly 1480.

Though discussed in terms of footwear, which includes, but is not limited to, ski boots, snow boots, ice skates, horseback riding boots, hiking shoes, running shoes, athletic shoes, specialty shoes, and training shoes, the closure systems disclosed herein may also provide efficient and effective closure options in a number of various different applications. Such applications may include use in closure or attachment systems on back packs and other articles for transport or carrying, belts, waistlines and/or cuffs of pants and jackets, neck straps and headbands for helmets, gloves, bindings for watersports, snow sports, and other extreme sports, or in any situation where a system for drawing two objects together is advantageous.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Figure 60:
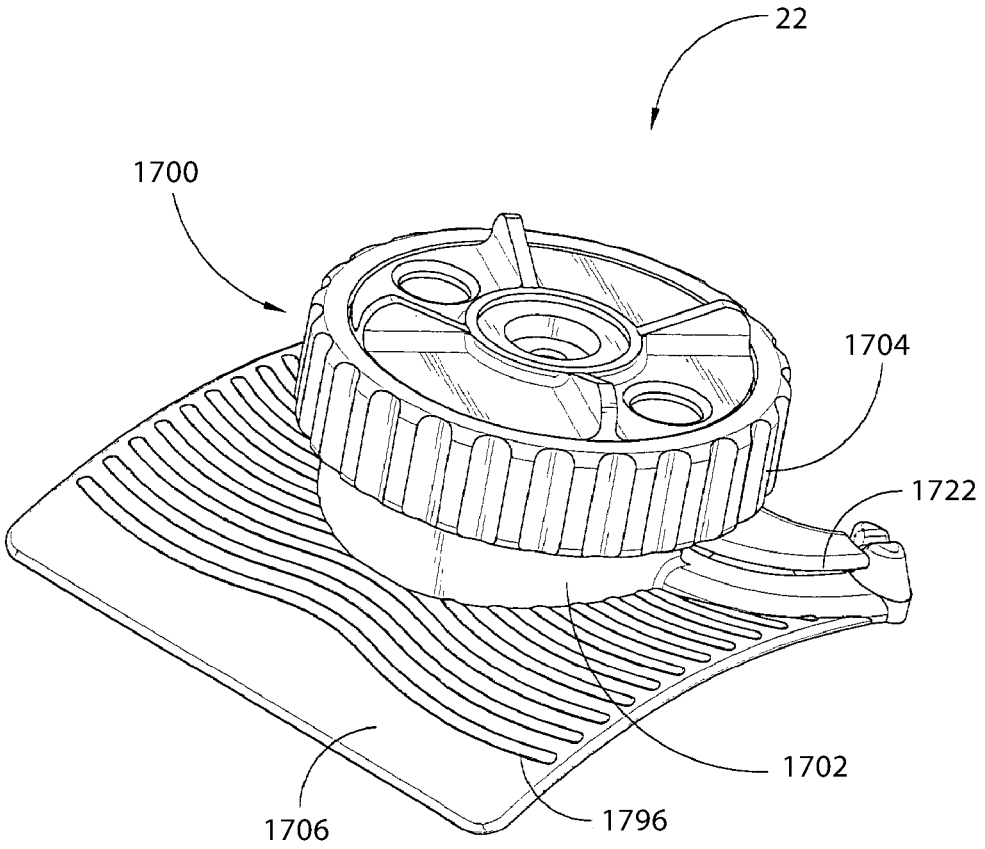
FIG. 60 is a perspective view of one embodiment of a reel for use with a lacing system in accordance with an alternative embodiment incorporating mounting structure and a safety device to inhibit accidental loosing of the lace.
Figure 61:
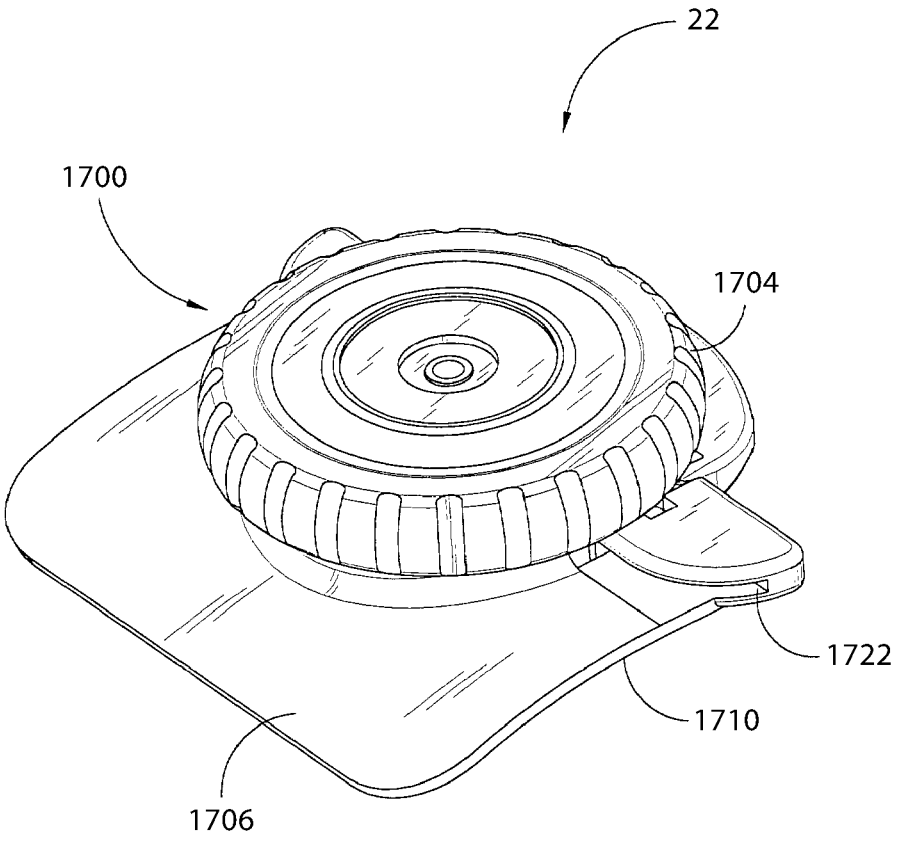
FIG. 61 is a perspective view of another embodiment of the lacing system.
Figure 62:
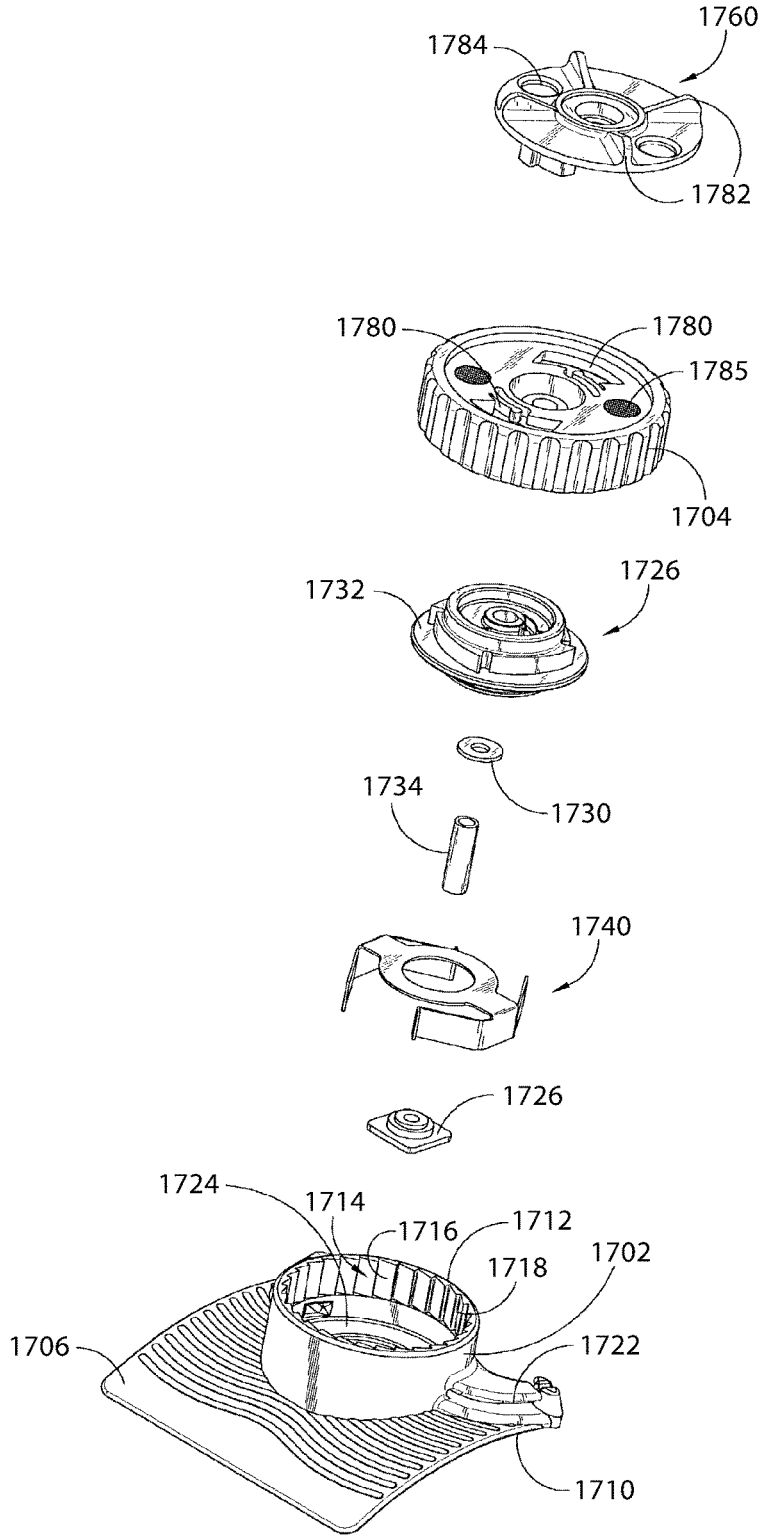
FIG. 62 is an exploded view of the reel of FIG. 60.

With reference to FIGS. 60-62, alternative embodiments of a lacing system 22 have an outer housing 1700 comprising a base member 1702 and a knob 1704. The outer housing is preferably injection molded out of any suitable material, as discussed above, but in one embodiment, is formed of nylon. Of course, any suitable manufacturing process that produces mating parts fitting within the design tolerances is suitable for the manufacture of the components disclosed herein.

The base member 1702 is generally a hollow cylinder further having a relatively thin and flat mounting flange 1706 that extends generally radially from around about half of the base member 1702 circumference. In some embodiments, the mounting flange 1706 extends from approximately the bottom surface 1710 of the base member, while in other embodiments, the mounting flange 1706 extends from about midway between the top edge 1712 and the bottom surface of the base member. The mounting flange 1706, as described above, is configured to be attached to the footwear in any acceptable manner. In one preferred embodiment, the mounting flange 1706 is stitched onto the footwear during manufacture. As discussed above, it may be securely attached by any suitable method, such as, for example, by adhesives, rivets, threaded fasteners, and the like. Alternatively, the mounting flange 1706 may be removably attached, such as by a releasable mechanical bonding structure in the form of cooperating hook and loop structure, for example.

The mounting flange 1706 may be disposed between layers of the footwear upper, or may be disposed on top of, or underneath, the footwear upper material. The method and location of attachment of the base member 1702 is dictated primarily by fashion design, and hence, could conceivably be mounted in any of a number of locations and by any suitable method.

The base member 1702 cylindrical portion includes sloped teeth 1714 formed into its inner surface. The base member teeth 1714 may be formed during the molding process, or may be subsequently cut therein, and each defines a sloped portion 1716 and a substantially radial surface 1718. In one embodiment, the sloped portion 1716 of each tooth 1714 allows relative clockwise rotation of a cooperating pawl, while inhibiting relative counterclockwise rotation of an engaging pawl. Of course, the teeth direction could be reversed as desired. The number and spacing of teeth 1714 controls the fineness of adjustment possible, and the specific number and spacing can be designed to suit the intended purpose by one of skill in the art in light of this disclosure. However, in many applications, it is desirable to have a fine adjustment of the lace tension, and the inventors hereof have found that approximately 20 to 40 teeth 1714 are sufficient to provide an adequately fine adjustment of the lace tension.

The base member 1702 additionally contains a pair of lace entry holes 1720 (FIG. 69) for allowing each end of a lace to enter therein. As discussed above, the base member 1702 lace entry holes 1720 may be made more robust by the addition of higher durometer materials either as inserts or coatings to reduce the wear caused by the laces abrading against the base member 1702 entry holes 1720. Additionally, the site of the entry hole can be rounded or chamfered to provide a larger area of contact with the lace to further reduce the pressure abrasion effects of the lace rubbing on the base unit.

A lace guide 1722 can be formed integrally with the base member and can be configured depending upon the specific application of the lacing system 22. For example, in a traditional lacing application where the laces zigzag across the tongue of the boot or shoe, the laces may extend in a lacing path that enters the base member from directions that are diametrically opposed. For this application, the lace guides 1722 may extend substantially radially from the base member 1702, as discussed above. Alternatively, in applications where the lace path results in substantially parallel laces entering the base member, a pair of lace guides 1722 can be integrally molded into the base unit to receive the laces and direct them to opposing sides of the spool for subsequent winding and collection.

It is preferable that the inner bottom surface 1724 of the base member is highly lubricious to allow mating components an efficient sliding engagement therewith. Accordingly, in one embodiment, a washer or bushing 1726 is disposed within the cylindrical portion of the base member 1702, and may be formed of any suitable lubricious polymer, such as PTFE, for example, or may be formed of a lubricious metal. Alternatively, the inner bottom surface 1724 of the base member 1702 may be coated with any of a number of coatings designed to reduce its coefficient of friction and thereby allow any components sharing surface contact therewith to easily slide.

With additional reference to FIG. 63, a spool 1726 is configured to reside within the cylindrical portion of the base member and is configured with sloped teeth 1728, such as those found on a ratchet, as has been described herein above in great detail. In one preferred embodiment, the spool 1726 is formed of metal, such as aluminum, by any standard chip producing, material removal machining operation. Alternatively, the spool 1726 may be cast or molded, and may be formed of any suitable polymer. In another preferred embodiment, the spool is formed of nylon and may optionally have a metal plate insert.

In cooperating with the washer or bushing 1726 disposed on the Inner bottom surface 1724 of the base member 1702, the lower surface of the spool 1726 is likewise configured for efficient sliding engagement. Accordingly, a second washer 1730 formed of highly lubricious material may be provided, or alternatively, the lower surface of the spool 1726 may be configured to reduce its coefficient of friction such that the spool 1726 easily spins within the base member 1702. In the illustrated embodiment, this is accomplished by providing a lip 1731 that offers a small surface area that contacts the bottom surface 1724 of the base member 1702.

The spool 1726 has one or more grooves 1733 formed therein to receive the lace 1735. As described in detail above, there may be one or more grooves that are configured to receive the wound up lace. In one embodiment, the lace passes through holes 1737 formed in the spool base member 1732 and are securely held in the spool. In one embodiment, the lace 1735 has two ends that are tied together. In this particular embodiment, the spool 1726 can be configured with a recess to accompany the knot formed by the lace ends.

The spool base 1732 is preferably circular in shape and is configured to reside within the base member 1702. In order to inhibit contact between the outer spool surface and the inner periphery of the base member 1702, an axle 1734 is provided that extends through the central axis of the spool 1726 to maintain the spool 1726 in the center of the base member 1702.

In one preferred embodiment, the axle 1734 is a metallic hollow tube, such as a brass tube, that fits down through the center axis of the spool 1726. The axle 1734 may be configured with bored ends, or may be threaded, for receiving threaded fasteners. In one embodiment, a screw passes through the knob 1704, through the axle 1734, and threads into a threaded insert provided in the base member 1702. Alternatively, a screw passes through the bottom of the outer housing and is threaded into one end of the axle 1734. The spool 1726 is installed onto the axle 1734, and the knob 1704 is attached to the axle 1734 by a second threaded fastener. In either case, the base member 1702 and knob 1704 are interconnected by the axle 1734, which provides an axis of rotation for the spool 1726.

Additionally, the spool 1726 may contain a bushing, bearing, or other form of friction reducing device along its central axis to allow it to easily revolve around the axle 1734. The axle 1734 can additionally carry a washer 1730 disposed between the reel and the washer or bushing 1726 disposed in the base member 1702 to further reduce rotational friction of the spool 1726. This type of rotatable connection maintains the spool 1726 at the center of the base member 1702 and thereby inhibits friction caused by the outer periphery of the spool 1726 contacting the inner periphery of the base member 1702, while still allowing the spool 1726 to freely spin within the base member 1702. Accordingly, without any interference from other components, the rotatable connection of the spool 1726 allows it to freely rotate in either direction.

Figure 63:
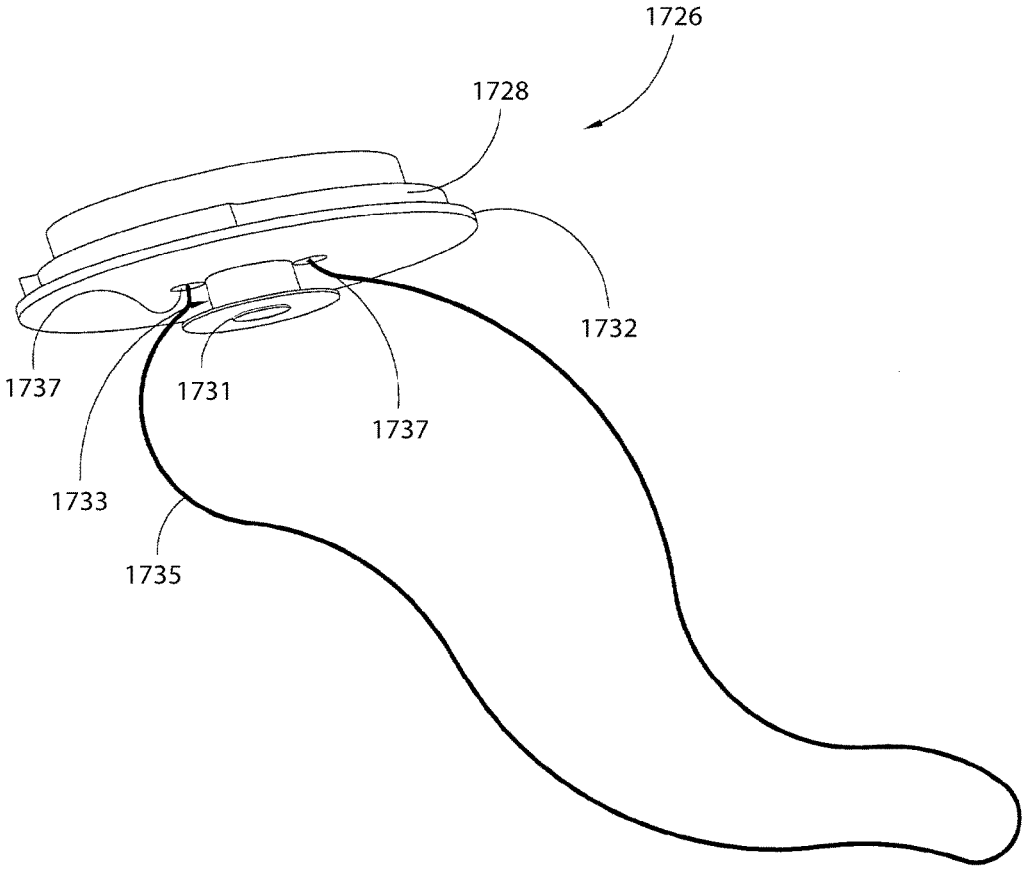
FIG. 63 is a bottom perspective view of a spool with attached lace.

With reference to FIG. 63, the spool 1726 is additionally configured with one or more sloped teeth 1728 disposed generally above the spool base 1732. The spool teeth 1728 are preferably configured to allow relative counterclockwise rotation, while inhibiting relative clockwise rotation of a corresponding pawl.

As discussed above, it is preferable that the laces are attached to the spool 1726 at substantially diametrically opposed locations to provide a simultaneous and equivalent tension to each lace as a winding force is imparted to the spool 1726. Moreover, the preferred lace attachment configuration applies balanced forces to the spool 1726 to protect the spool 1726 from transverse bending forces that could cause the journal connection to prematurely wear. For example, if the laces engaged the spool 1726 from directions forming a ninety-degree angle, the forces imparted by the tension in the wound laces would apply a shear force to the axle 1734 of the spool 1726. If, however, the laces were diametrically attached to the spool 1726, the resultant force on the spool 1726 from the equivalent opposing tension forces would be zero, thus protecting the spool 1726 and its journaled connection from wear resulting from transverse forces.

The spool 1726 further comprises one or more annular grooves, as described above, configured to receive the wound up lace. The groove is preferably configured to contain the full length of the lace while minimizing any tendency for the lace to become loose within the housing 1700 and potentially becoming jammed, or interfering with additional components contained within the outer housing 1700. In some preferred embodiments, two annular grooves separated by an annular ridge are provided to segregate each end of the lace to reduce the likelihood of jamming or binding the mechanism. The lace grooves are preferably located below the spool teeth 1728 and spool base, but could optionally be located above the spool teeth 1728.

Figure 64:
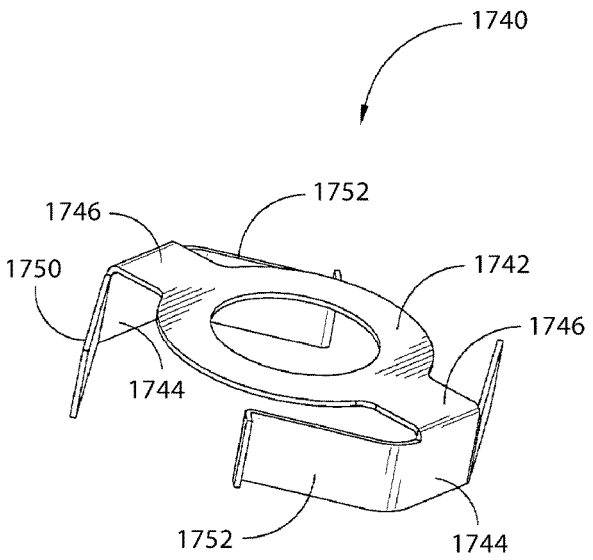
FIG. 64 is a perspective view of a pawl spring for use with the reel embodiments of FIGS. 60 and 61.
Figure 65:
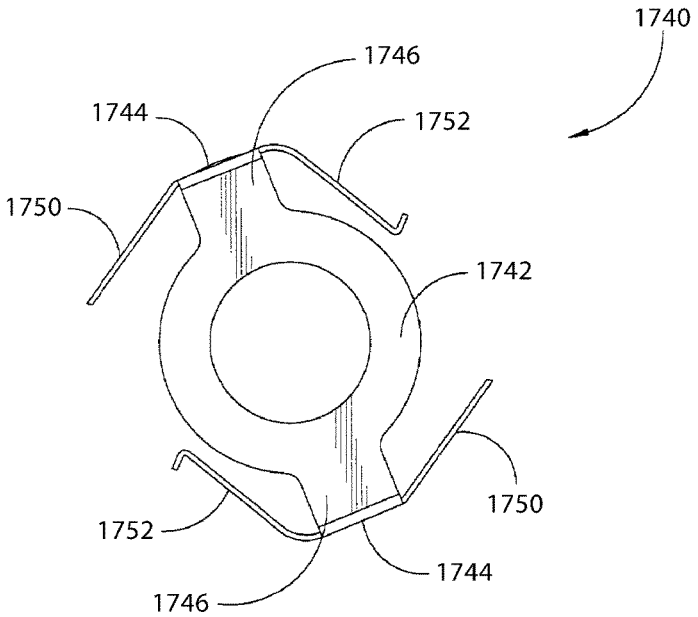
FIG. 65 is a top plan view of the pawl spring of FIG. 63.

As illustrated in FIGS. 64 and 65, a pawl spring 1740 comprises a central horizontally flat circular section 1742 attached to two diametrical arm sections 1744. In the illustrated embodiment, each arm section 1744 is attached to the circular section 1742 by a corresponding bridge 1746, and may be attached in any suitable manner, such as by welding, or may be formed integrally therewith. The arm sections 1744 are generally disposed below the central flat circular section 1742 and are flat in a vertical plane.

Extending in a counterclockwise direction from each arm section is an outer pawl 1750. Each outer pawl 1750 is configured to terminate outside the periphery of the spool base 1732, as described later below, and is configured to contact the base member sloped teeth 1716. Therefore, when turning one direction, the outer pawls 1750 are free to rotate relative to the base member 1702, while the base member 1702 sloped teeth inhibit relative movement in the opposite direction.

Extending in a clockwise direction from each arm section is a spool pawl 1752. The spool pawl 1752 is configured to terminate within the periphery of the spool base 1732, as described later, and is configured to contact the sloped teeth 1728 of the spool 1726. Therefore, while turning one direction, the spool pawls 1752 interfere with the sloped teeth 1728 of the spool 1726, and cause the spool 1726 to turn concurrently with the pawl spring 1742. However, if the spool pawls 1752 are removed from contact with the spool sloped teeth 1728, the spool 1726 is free to rotate. Of course, it should be understood that the illustrated components could be reversed such that the tightening and loosening directions are opposite from those described. However, for clarity, the reel will primarily be discussed by utilizing a design in which a clockwise rotation tightens the lace, while a counterclockwise rotation allows the lace to unwind.

In one preferred embodiment, the pawl spring 1742, arms sections 1744, and pawls 1750, 1752 are formed unitarily from a high temper sheet metal. The entire spring 1742 may be stamped out of a single sheet of high temper sheet metal, such as, for example, spring steel or stainless steel, and then the arm sections 1744 can be plastically bent to be orthogonal to the original plane of the flat material. Additionally, the spool pawls 1752 and outer pawls 1750 can be permanently bent relative to the arm sections 1744. This may be done either prior or subsequent to the arm sections receiving a bend.

The residual stresses formed in the spring 1740 may optionally be compensated for such as by heat working to allow the relieve the residual stresses caused by plastic deformation. In other embodiments, the residual stresses are beneficial as they add to the resiliency of the spring 1740. For example, the spool pawl 1752 is configured to be biased inwardly; however, the residual stresses created by 'bending the spool pawl 1752 with respect to the arm section 1744 will tend to force the spool pawl 1752 outward. To compensate for this stress, which could ultimately cause the spool pawl 1752 to lose its desired bias, the spool pawl 1752 may be bent to a more acute angle than necessary and then bent back to its desired angle. By bending the spool pawl 1752 beyond the desired angle and then plastically returning it to its desired angle, the residual stresses now naturally bias the spool pawl 1752 in an inward direction.

Those of ordinary skill in the art will readily realize that several types of springs and/or spring-loaded devices will provide an equivalent structure and equivalent function to that of the disclosed pawl spring 1740. However, the applicants believe the disclosed method is a suitably quick and efficient construction.

Returning to FIGS. 60-62, a knob 1704 is configured to fit over and close the open end of the base member 1702 and generally circumscribe the outer periphery thereof. The knob 1704 can be securely attached to the spool 1726 or axle by a screw, as described above. In this way, the outer housing 1700 is complete with the base member 1702 and the knob 1704 both securely attached to the spool 1726. Of course, the knob 1704 may be attached through alternative structure. For example, the knob 1704 and base member 1702 can have a cooperating annular ridge and annular groove designed to provide a secure connection therebetween. In this type of connection, the annular ridge can be configured on either the knob 1704 or the base member 1702, with the corresponding annular groove being formed on the other component. Furthermore, to provide additional support to the spool 1726, the knob 1704 can contain an integral axle configured to extend down into the spool 1726 for providing a rotational connection. The knob 1704 may be subsequently removed by prying the knob 1704 from the lower unit, with the required force determined by the specific configuration of the cooperating annular groove and ridge. In either disclosed embodiment, the spool 1726 is journaled for rotational movement within the outer housing 1700.

Figure 66:
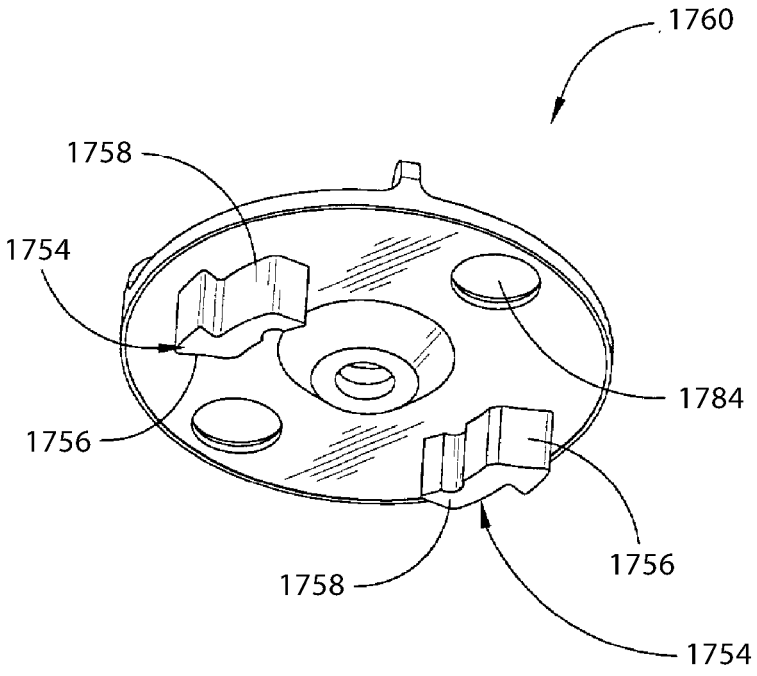
FIG. 66 is a perspective bottom view of a knob insert of the reel of FIG. 60.
Figure 69:
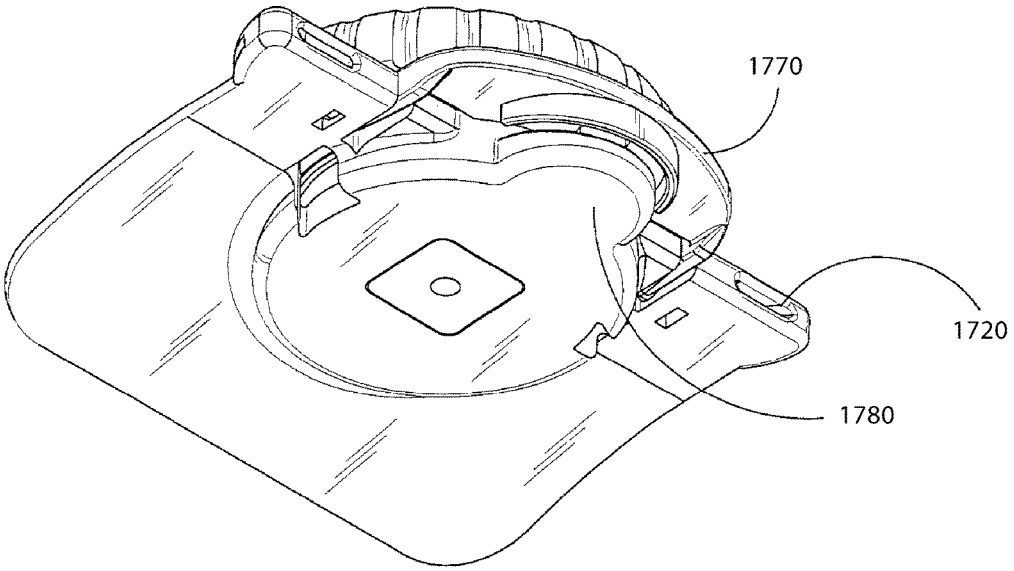
FIG. 69 is a perspective bottom view of the reel of FIG. 61 showing the safety release lever.

The pawl spring 1740 is constrained to rotate with the knob 1704 in at least one direction, such as a winding direction, which is some embodiments is clockwise. This may be accomplished in any of a number of ways, one of which is by forming protrusions on the underside of the knob 1704 that contact the pawl spring 1740 as the knob 1704 is rotated, thereby imparting a rotational force to the pawl spring 1740. With reference to FIGS. 66 and 69, a portion of the underside of the knob 1704 has a pair of protrusions 1754 extending therefrom. Each protrusion 1754 contains an interfering surface 1756 that contacts the bridge 1746 of the pawl spring 1740 and causes it to rotate concurrently therewith. Additionally, each protrusion contains a ramp 1758, as will be discussed in greater detail below.

An alternative structure that allows the knob 1704 to impart a rotational force to the pawl spring 1740 comprises a recess formed into the underside of the knob 1704 that corresponds generally with the shape of the pawl spring 1740 such that when the outer housing 1700 and its internal components are assembled, the pawl spring 1740 center section 1742 and bridge sections 1746 securely reside within the recess in the underside of the knob 1704. Of course, the pawl spring 1740 may be constrained for concurrent rotation in one or both directions with the knob 1704 by any suitable method, such as alternative interfering structure, adhesives, clips, snaps, mechanical bonding, chemical bonding, heat bonding, or any such suitable interaction.

Figure 68:
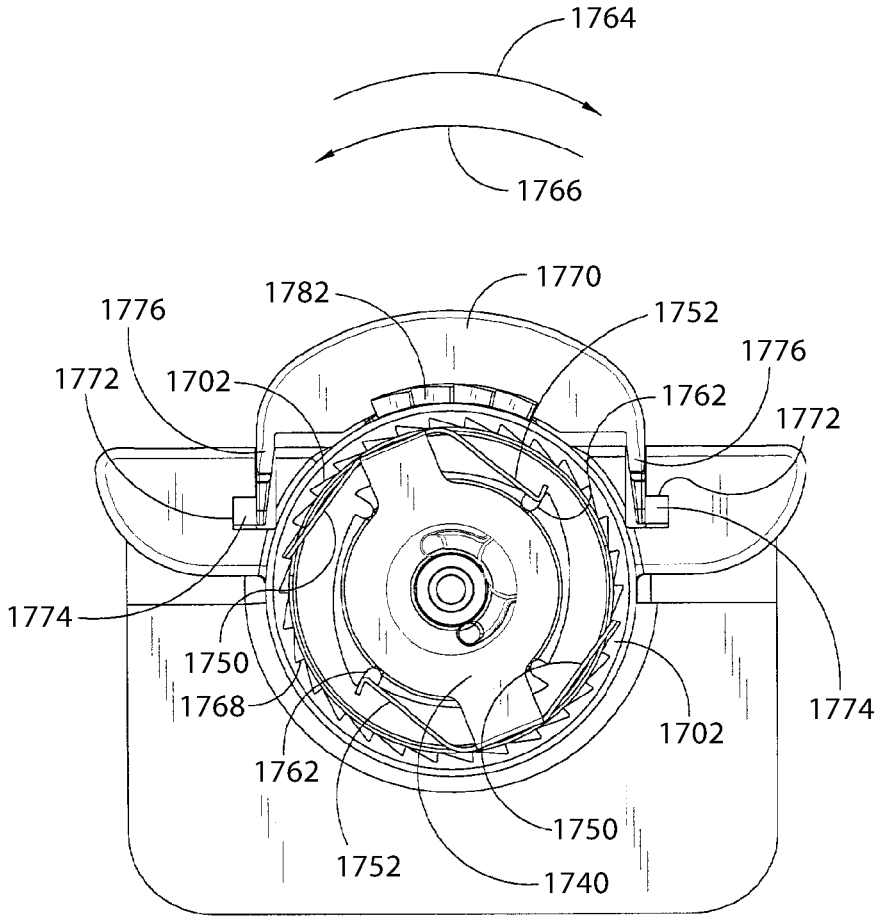
FIG. 68 is a top plan view of the reel of FIGS. 60 and 61 with the knob removed to display the interior components.

Referring to FIG. 68, the interaction and operation of the components is illustrated. As the knob 1704 and concomitant spring 1740 are rotated in a clockwise direction, the outer pawls 1750 slide past the base member 1702 sloped teeth. Simultaneously, the spool pawls 1752 contact and interfere with the spool teeth 1728, also referred to herein as ratchet teeth, thereby imparting a rotating force to the spool 1726. Thus, as the knob 1704 turns clockwise, the spool 1726 also turns clockwise, thereby winding the lace about the spool 1726.

Moreover, as the outer pawls 1750 slide past the base member teeth 1716 and are repeatedly deflected by the high slope of the teeth 1716 and resiliently spring outwardly to contact the low slope of the teeth 1716, an audible and tactile feedback is provided to the user to indicate incremental winding and tightening of the lace about the spool 1726.

The spacing of the base member 1702 sloped teeth controls the precision of incremental adjustment. For example, if only two or three base member teeth 1716 are present, the knob 1704 must be wound either one half or one third revolutions, respectively, to reach the next increment. Otherwise, the tension in the lace will cause the spool 1726 to unwind until the outer pawls 1750 contact the base member 1702 teeth. Accordingly, while the number and spacing of the base member teeth 1716 is not critical to practice the invention, those of ordinary skill will realize that an appropriate number of base member teeth 1716 should be provided to provide acceptable adjustment increments, such as, for example, 20 to 40 or more teeth.

As the lace becomes wound about the spool 1726, its tension increases and thereby imparts a rotation force to the spool 1726 in an unwinding direction. This unwinding force is counteracted by the interference between the spool pawls 1752 and the spool teeth 1728 in combination with the interference between the outer pawls 1750 and base member 1702 teeth.

For example, during initial turning of the knob 1704 and pawl spring 1740 in a clockwise direction, the spool pawls 1752 resiliently fall down the slope of the spool teeth 1728 and contact the substantially radial tooth face 1762 of the adjacent tooth. Further rotation of the knob 1704 and pawl spring 1740 in a winding direction 1764 imparts a torque, or winding force, to the spool 1726, which rotates and thereby winds the lace about the spool 1726. When the winding force is removed, any tension in the lace will impart a torque in an unwinding direction 1766, or unwinding force, to the spool 1726 and cause it to rotate in a counterclockwise direction. Consequently, as the spool 1726 attempts to turn in a counterclockwise direction, the interaction between the radial tooth face 1762 and the spool pawl 1752 cause the pawl spring 1740 to rotate counterclockwise with the spool 1726. As such, the outer pawls 1750 contact the substantially radial face 1768 of the base member 1702 teeth and thereby prevent further unwinding of the spool 1726.

In order to effectuate unwinding of the spool 1726, it must become free of the spool pawls 1752. In the illustrated embodiment, this is accomplished by rotating the knob 1704 and pawl spring 1740 in a counterclockwise direction through predetermined angular displacement, which in one embodiment, is about one quarter turn. As the knob 1704 and pawl spring 1740 are rotated counterclockwise, structure on the knob 1704 will contact the spool pawls 1752, which deflect outwardly in response thereto, thus freeing the spool 1726 for rotation.

Figure 67:
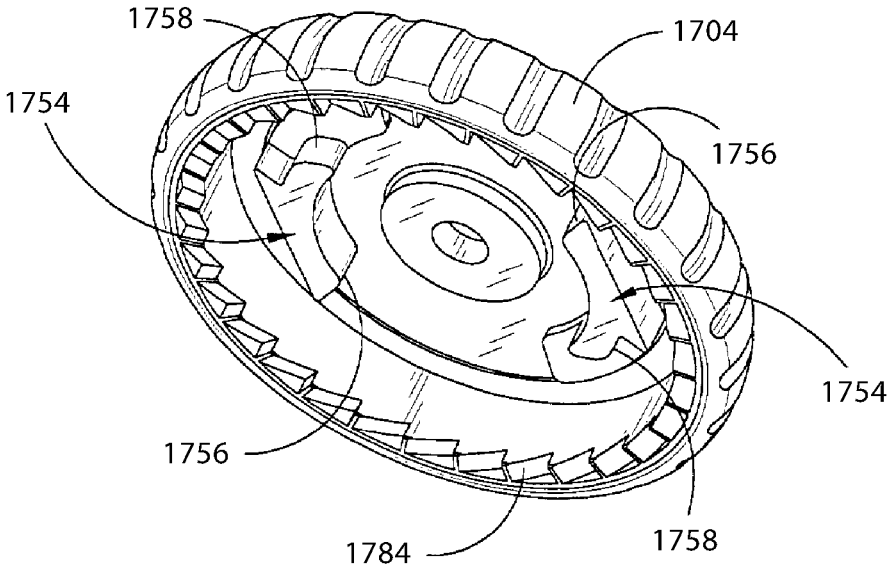
FIG. 67 is a perspective bottom view of the knob of the reel of FIG. 61.

More specifically, one or more ramps 1756 (FIGS. 66 and 67) are formed on the underside of the knob 1704. The ramps 1756 are configured such that counterclockwise rotation of the knob 1704 causes the ramps 1756 to contact the spool pawls 1752, which slide up the ramps 1756 and thereby deflect outwardly away from the spool teeth 1728. Once the spool pawls 1752 extend up the ramp a sufficient distance, the spool pawls 1752 are clear of the spool teeth 1728. Accordingly, the spool pawls 1752 will be deflected a sufficient distance to become free from the spool 1726, thereby allowing the spool 1726 to freewheel spin in response to the unwinding force applied by the tensioned lace. In this embodiment, the knob 1704 must be held in its releasing position until the spool 1726 unwinds; otherwise, the spool pawl 1752 will resiliently return to its unbiased position and interfere with continued unwinding of the spool 1726.

Of course, other suitable methods and structure could be used to effectuate unwinding of the spool 1726. For example, a push button (not shown) located on top of the knob 1704 could be coupled to the spool pawls 1752 in such a way that depression of the push button forces the spool pawls 1752 resiliently outward, thus allowing free rotation of the spool 1726. Other structure causing the spool pawls 1752 to deflect outwardly will be readily apparent to those of skill in the art in light of the present disclosure.

Accordingly, in the described embodiments, as the illustrated spool pawl 1752 deflects outwardly, its interfering contact with the spool 1726 is released, which is then free to rotate. As such, the spool 1726 unwinds in response to the unwinding force imparted by the lace tension, thereby loosing the tension in the lace and releasing the closing force of the footwear about the wearer's foot. The lace is preferably maintained within the reel such that it cannot escape once loosened.

An important realization is that it may be possible for the knob 1704 to become inadvertently twisted during use, such as by impact with another object like another shoe, sporting implement, or the ground, for example, thereby resulting in unintentional or accidental unwinding of the laces. This could have unfortunate results, especially during strenuous physical activity when strict fit and control of the footwear is critical. Accordingly, the reel or knob 1704 can be configured with a safety mechanism for preventing unintentional and accidental unwinding.

In one embodiment, as illustrated in FIG. 68, the safety mechanism comprises a lever 1770 or button that must be depressed in order to rotate the knob 1704 in a counterclockwise direction. The lever is hingedly connected to the base member 1702 in any suitable manner. However, in one embodiment, a pair of apertures 1772 are provided for receiving a pair of pins 1774 extending from connecting arms 1776 of the lever 1770. Additionally, it is preferable that the lever 1770 is biased in an upward direction, and accordingly, a spring can be provided underneath the lever 1770 to give the desired bias. As illustrated, the base member 1702 includes a lever flange 1780 that defines the lever travel limit in a depressed direction and further contains a boss (not shown) for holding a coil spring (not shown) between the lever flange 1780 and lever 1770. Accordingly, as the lever 1770 is depressed, the coil spring becomes compressed, thereby imparting a restoring force to bias the lever in an upward direction.

The lever interacts with the knob 1704 to prevent unintentional counterclockwise rotation. In one embodiment, this is accomplished by providing lock teeth 1782 on the lever 1770 that cooperate with knob teeth 1784 (of FIG. 39) to prevent relative rotation of the knob 1704. The lever 1770 is biased upwardly, thus biasing the lock teeth 1782 against the knob teeth 1784, which interfere with one another to inhibit counterclockwise rotation of the knob 1704 relative to the lever 1770. The knob teeth 1782 can be strategically spaced around the knob 1704 to coincide with the winding increments of the reel. As such, for each winding increment, there is a corresponding locking position that allows the lever teeth 1782 to lock the knob 1704 at that particular location. However, such a correspondence between the winding increments and the locking increments is not crucial to the present invention.

The lock teeth 1782 and knob teeth 1784 are preferably configured to allow rotation of the knob 1704 in a tightening direction without interference between the respective teeth 1782, 1784. However, the teeth 1782, 1784 are configured to inhibit rotation of the knob 1704 in a loosening direction by interference between the lock teeth 1782 and knob teeth 1784. Thus, in order to rotate the knob 1704 in a counterclockwise direction and release the spool 1726, the lever 1770 must be depressed, thereby separating the lock teeth 182 and knob teeth 1784. Only then can the knob 1704 be rotated counterclockwise to release the spool 1726, as described above.

With particular reference to FIG. 66 and additionally to FIG. 62, an alternative embodiment comprises a knob 1704 configured with a knob insert, or rotatable actuator 1760, that rotates independently of the knob 1704. For example, the knob 1704 is configured with one or more arc grooves 1780 configured to receive the protrusions 1754 of the rotatable actuator. The arc grooves 1780 and protrusions 1754 can cooperate to securely attach the actuator 1760 to the knob 1704, yet still allow relative rotation therebetween. The actuator 1760 is configured with one or more upwardly extending tabs 1782 that allow a user to grip and rotate the actuator 1760 independently of the knob 1704. Moreover, the rotatable actuator 1760 carries one or more ramps 1756 on its lower surface, as discussed above, that interact with the pawl spring 1740 to effectuate a release of the spool pawls 1752 from the spool teeth 1728, as also described above. One or more alignment holes 1784 may be provided through the actuator 1760 to allow a user to visually verify the locked or unlocked status of the spool. For example, holes 1784 can be located through the actuator 1760 and the knob 1704 can be configured with a visual indicator, such as one or more colored dots 1785. The colored dots 1785 are preferably located such that when the actuator 1760 is positioned to lock the spool 1726 one color is viewable through the holes 1784, and when the actuator 1760 is positioned to unlock the spool 1726 a different color is viewable through the holes 1784.

In order to release the spool 1726 and unwind the laces, a user simply rotates either the knob 1704 or actuator, depending on the particular embodiment, in a counterclockwise direction thus causing the ramps 1756 to engage and deflect the spool pawls 1752 outwardly, thereby allowing the spool 1726 to unwind the tensioned laces. Thus, a safety mechanism is provided that inhibits unintentional and accidental loosing of the reel and lace. Of course, it is to be understood that a counterclockwise rotation is not the only direction of rotation that can release the spool. In some embodiments, a right reel is tightened by rotating the knob in a clockwise direction and the spool is released by rotating the knob in a counterclockwise direction; and a left reel is tightened by rotating the knob in a counterclockwise direction and the spool is released by rotating the knob in a clockwise direction.

Therefore, a right reel and a left reel can be configured for opposite directional rotation to allow a user to more naturally grip and manipulate the reel. It is currently believed that an overhand motion, e.g. a clockwise rotation with a person's right hand, is a more natural motion and can provide a greater torque to tighten the reel. Therefore, by configuring a right and left reel for opposite rotation, each reel is configured to be tightened with an overhand motion by tightening the right reel with the right hand, and tightening the left reel with the left hand.

In several of the above described embodiments, the lace includes two free ends that can be inserted and fixed within the spool 1726. One particular advantage of these embodiments is that the lace can be removed and replaced, such as by threading through the guide members and inserted and affixed into the spool 1726, as necessary, without having to replace any ancillary components. However, other embodiments provide a closed loop lace, which is permanently engaged with the spool 1726. In these embodiments, a removable spool and lace unit allows replacement of the spool and lace assembly as a unit. Such a replaceable spool and lace does not require subsequent threading of the lace through the guide members or the outer housing, and further does not require steps to secure the lace within the spool 1726, thus making lace replacement a fast and efficient process. However, in order to effectuate such a replacement, a closed loop lace must be able to enter the guide members without having a free end to thread through a tubular guide member.

When referring to the term "closed loop lace," it should be interpreted to mean a lace that enters the spool 1726 at two or more locations, whether it has two free ends affixed within the spool 1726, or is a truly continuous lace having no ends.

With returning reference to FIGS. 60 and 61, the base member 1702 incorporates lace guides 1722 having an open channel. The base member 1702 has a generally C-shaped channel into which the lace may be inserted or removed. As described above, the channel 1792 may selectively be closed by a flap or other closure device for maintaining the lace within the channel when not under tension. A tension applied to the lace will maintain it within the channel.

As described above, the base member 1702 may contain a mounting 1706 flange adapted for fastening to a shoe or boot. The mounting flange 1706 can be configured with ridges 1796 or grooves to offer increased frictional holding between the flange portion and connected material. Moreover, grooves can offer a decreased thickness to facilitate puncture, such as for stitching, yet offer an increased thickness to inhibit pull through of the stitching. Ridges or ribs can function in a similar manner to provide an area of increased thickness to increase the flange resistance to stitching pull through pressures. Of course, the base member 1702 can be mounted to the footwear in any suitable manner, such as through adhesives, fasteners, mechanical or chemical bonding, mechanical structure, and the like.

While the function of the embodiments disclosed in relation to FIGS. 60 and 61 is substantially similar, it should be apparent to one of ordinary skill in the art that great artistic license can be taken with the design of the outer housing to appease the whims of the fashion conscious.

What is claimed is:

1. A reel based closure system, comprising:

a housing, comprising an outer housing wall with housing teeth on an inner surface of the outer housing wall, wherein the outer housing wall defines an interior region;

a spool rotatably positioned within the interior region of the housing, the spool comprising:

an upper flange;

an annular channel that receives a tension member as the spool rotates within the interior region of the housing, wherein as the spool rotates in a first direction within the interior region of the housing, the tension member winds about the channel, and wherein as the spool rotates in a second direction within the interior region of the housing, the tension member unwinds from about the channel; and a spool tooth coupled to the upper flange of the spool;

a knob comprising an axially extending protrusion, the knob being rotatably coupled with the housing;

a pawl component disposed within the housing and operationally coupled to the knob and the spool, the pawl component comprising:

a first pawl member that is configured to engage with the housing teeth; and a second pawl member that is engagable with the spool tooth and transitionable between a first position and a second position, wherein the second pawl member engages the spool tooth in the first position to prevent rotation of the spool in the second direction, and wherein the second pawl member is disengaged from the spool tooth in the second position to enable the spool to rotate in the second direction and thereby unwind the tension member;

wherein the second pawl member transitions from the first position to the second position as the knob rotates the axially extending protrusion into contact with the second pawl member.

2. The reel based closure system of claim 1, comprising a shaft that couples the knob to the housing.

3. The reel based closure system of claim 1, wherein the pawl component comprises a pawl base that extends radially from a main body of the pawl component and that is coupled with the first pawl member and the second pawl member.

4. The reel based closure system of claim 3, wherein the first pawl member extends from the pawl base in a first direction and the second pawl member extends from the pawl base in a second direction that is opposite to the first direction.

5. The reel based closure system of claim 1, wherein engagement of the axially extending protrusion and the second pawl member causes the second pawl member to move radially outward to disengage the second pawl member from the spool tooth.

6. The reel based closure system of claim 1, wherein the spool comprises four spool teeth coupled to the upper flange of the spool and spaced equidistant atop the upper flange.

7. The reel based closure system of claim 6, wherein each spool tooth curves radially outwardly.

8. The reel based closure system of claim 1, wherein with the second pawl member engaged with the spool tooth in the first position, a rotation of the knob in the first direction causes the second pawl member to drive rotation of the spool in the first direction.

9. The reel based closure system of claim 1, wherein the second pawl member comprises a curved lip.

10. The reel based closure system of claim 1, further comprising a lever or button mechanism that is engageable with the knob to prevent rotation of the knob in the second direction and that is actuatable to disengage the knob and the lever or button mechanism to enable rotation of the knob in the second direction.

11. The reel based closure system of claim 1, wherein the reel based closure system is attached to a shoe.

12. A reel based closure system comprising:

a housing having teeth operationally coupled therewith;

a spool rotatably disposed within the housing, the spool being coupled with a tension member such that as the spool rotates in a first direction, the tension member winds about the spool and as the spool rotates in a second direction, the tension member unwinds from about the spool;

a knob rotatably coupled with the housing;

a pawl component disposed between the knob and the spool and operationally coupled therewith, the pawl component comprising:

a first pawl member that engages with the teeth operationally coupled with the housing; and a second pawl member that is engagable with the spool and that transitions between a first position and a second position, wherein:

in the first position, the second pawl member engages with the spool to prevent rotation of the spool in the second direction, and in the second position, the second pawl member is disengaged from the spool to enable rotation of the spool in the second direction;

wherein a rotation of the knob in the second direction causes the second pawl member to transition from the first position to the second position while the first pawl member remains engaged with the teeth operationally coupled with the housing.

13. The reel based closure system of claim 12, further comprising a spool tooth coupled to the spool, wherein the second pawl member engages the spool tooth in the first position to prevent rotation of the spool in the second direction.

14. The reel based closure system of claim 13, wherein the knob comprises an axially extending protrusion that engages with the second pawl member upon rotation of the knob in the second direction, and wherein engagement of the axially extending protrusion and the second pawl member causes the second pawl member to transition from the first position to the second position.

15. The reel based closure system of claim 13, wherein the spool comprises a plurality of spool teeth that are spaced equidistant atop an upper surface of the spool, and wherein each spool tooth comprises a curved outer edge.

16. The reel based closure system of claim 12, wherein a distal end of the second pawl member moves radially outward relative to the spool as the second pawl member transitions from the first position to the second position.

17. The reel based closure system of claim 12, wherein the pawl component comprises a pawl base that extends radially from a main body of the pawl component and that is coupled with the first pawl member and the second pawl member.

18. The reel based closure system of claim 12, further comprising a lever or button mechanism that is engageable with the knob to prevent rotation of the knob in the second direction and that is actuatable to disengage the knob and the lever or button mechanism to enable rotation of the knob in the second direction.

19. The reel based closure system of claim 12, wherein the reel based closure system is attached to a shoe.

20. A shoe tensioning system, comprising:

a shoe;

a tension member coupled to the shoe;

a reel based tensioning system coupled to the shoe and the tension member, the reel based tensioning system comprising:

a housing having housing teeth disposed on an inner surface of the housing;

a spool rotatably disposed within the housing, the spool being coupled with the tension member such that rotation of the spool in a first direction winds the tension member about the spool and rotation of the spool in a second direction unwinds the tension member from about the spool;

a knob rotatably coupled with the housing; and a pawl component disposed between the knob and the spool and operationally coupled therewith, the pawl component comprising:

a first pawl member that engages with the housing teeth; and a second pawl member that is engagable with the spool and transitionable between a first position and a second position such that in the first position, the second pawl member engages with the spool to prevent rotation of the spool in the second direction, and in the second position, the second pawl member is disengaged from the spool to enable rotation of the spool in the second direction;

wherein rotation of the knob in the second direction causes the second pawl member to transition from the first position to the second position.

21. The shoe tensioning system of claim 20, wherein the spool further comprises a spool tooth, and wherein the second pawl member engages the spool tooth in the first position to prevent rotation of the spool in the second direction.

22. The shoe tensioning system of claim 21, wherein the spool comprises a plurality of spool teeth that are spaced equidistant atop an upper surface of the spool, and wherein each spool tooth comprises a curved outer edge.

23. The shoe tensioning system of claim 20, wherein the knob comprises an axially extending protrusion that engages with the second pawl member upon rotation of the knob in the second direction, wherein engagement of the axially extending protrusion and the second pawl member causes the second pawl member to transition from the first position to the second position.

24. The shoe tensioning system of claim 20, wherein a distal end of the second pawl member moves radially outward relative to the spool as the second pawl member transitions from the first position to the second position.

25. The shoe tensioning system of claim 20, wherein the reel based tensioning system further comprises a lever or button mechanism that is engageable with the knob to prevent rotation of the knob in the second direction and that is actuatable to disengage the knob and the lever or button mechanism to enable rotation of the knob in the second direction.

* * * * *